US008882284B2

(12) United States Patent
Tong et al.

(10) Patent No.: US 8,882,284 B2
(45) Date of Patent: Nov. 11, 2014

(54) LED LAMP OR BULB WITH REMOTE PHOSPHOR AND DIFFUSER CONFIGURATION WITH ENHANCED SCATTERING PROPERTIES

(75) Inventors: Tao Tong, Oxnard, CA (US); Ronan Le Toquin, Fremont, CA (US); Bernd Keller, Santa Barbara, CA (US); Eric Tarsa, Goleta, CA (US); Mark Youmans, Goleta, CA (US); Theodore Lowes, Lompoc, CA (US); Nicholas W. Medendorp, Jr., Raleigh, NC (US); Antony Van De Ven, Sai Kung (HK); Gerald Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 399 days.

(21) Appl. No.: 13/018,291

(22) Filed: Jan. 31, 2011

(65) Prior Publication Data

US 2011/0267801 A1 Nov. 3, 2011

Related U.S. Application Data

(63) Continuation-in-part of application No. 12/848,825, filed on Aug. 2, 2010, now Pat. No. 8,562,161, and a (Continued)

(51) Int. Cl.
*F21V 9/16* (2006.01)
*F21V 5/00* (2006.01)

(Continued)

(52) U.S. Cl.
CPC . *F21V 9/16* (2013.01); *F21K 9/135* (2013.01); *F21K 9/56* (2013.01); *F21Y 2101/02* (2013.01);

(Continued)

(58) Field of Classification Search
USPC ..... 362/311.01–311.05, 543–549, 555, 362/800, 249.01–249.03; 313/110–117
See application file for complete search history.

(56) References Cited

U.S. PATENT DOCUMENTS 3,581,162 A 5/1971 Wheatley
4,204,246 A 5/1980 Arii et al. ..... 361/699

(Continued)

FOREIGN PATENT DOCUMENTS

CN 1425117 6/2003
CN 1802533 7/2006

(Continued)

OTHER PUBLICATIONS

International Search Report and Written Opinion for PCT Application No. PCT/US2011/000397 mailed May 24, 2011.

(Continued)

*Primary Examiner* — Donald Raleigh
(74) *Attorney, Agent, or Firm* — Koppel, Patrick, Heybl & Philpott

(57) ABSTRACT

An LED lamp or bulb is disclosed that comprises a light source, a heat sink structure and an optical cavity. The optical cavity comprises a phosphor carrier having a conversions material and arranged over an opening to the cavity. The phosphor carrier comprises a thermally conductive transparent material and is thermally coupled to the heat sink structure. An LED based light source is mounted in the optical cavity remote to the phosphor carrier with light from the light source passing through the phosphor carrier. A diffuser dome is included that is mounted over the optical cavity, with light from the optical cavity passing through the diffuser dome. The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle.

58 Claims, 40 Drawing Sheets

Related U.S. Application Data continuation-in-part of application No. 12/889,719, filed on Sep. 24, 2010, and a continuation-in-part of application No. 12/975,820, filed on Dec. 22, 2010.

(60) Provisional application No. 61/339,516, filed on Mar. 3, 2010, provisional application No. 61/339,515, filed on Mar. 3, 2010, provisional application No. 61/386,437, filed on Sep. 24, 2010, provisional application No. 61/424,665, filed on Dec. 19, 2010, provisional application No. 61/424,670, filed on Dec. 19, 2010, provisional application No. 61/434,355, filed on Jan. 19, 2011, provisional application No. 61/435,326, filed on Jan. 23, 2011, provisional application No. 61/435,759, filed on Jan. 24, 2011.

(51) Int. Cl.

| | |
|---|---|
| ***F21K 99/00*** | (2010.01) |
| *F21Y 101/02* | (2006.01) |
| *F21V 3/00* | (2006.01) |
| *F21V 29/00* | (2006.01) |
| *F21V 3/02* | (2006.01) |
| *F21V 7/20* | (2006.01) |

(52) U.S. Cl.

CPC ..... *F21V 3/00* (2013.01); *F21V 29/2231* (2013.01); *F21V 29/2256* (2013.01); *F21V 3/02* (2013.01); *F21V 7/20* (2013.01)

USPC ..... 362/84; 362/311.02; 362/311.06; 362/257

(56) References Cited

U.S. PATENT DOCUMENTS

| | | | | |
|---|---|---|---|---|
| 5,463,280 | A | 10/1995 | Johnson | |
| 5,561,346 | A | 10/1996 | Byrne | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,890,794 | A | 4/1999 | Abtahi et al. | |
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,350,041 | B1 | 2/2002 | Tarsa | |
| 6,404,131 | B1 | 6/2002 | Kawano et al. | 315/82 |
| 6,465,961 | B1 | 10/2002 | Cao | |
| 6,517,221 | B1 | 2/2003 | Xie | 362/373 |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,910,794 | B2 | 6/2005 | Rice | 362/547 |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,094,362 | B2 | 8/2006 | Setlur et al. | 352/301 |
| 7,140,753 | B2 | 11/2006 | Wang et al. | 362/294 |
| 7,144,135 | B2 | 12/2006 | Martin et al. | |
| 7,160,012 | B2 | 1/2007 | Hilscher et al. | 362/555 |
| 7,165,866 | B2 | 1/2007 | Li | |
| 7,172,314 | B2 | 2/2007 | Currie et al. | |
| 7,213,940 | B1 | 5/2007 | Van De Ven | |
| D546,980 | S | 7/2007 | Lo | |
| 7,270,446 | B2 | 9/2007 | Chang et al. | 362/294 |
| D553,267 | S | 10/2007 | Yuen | |
| 7,350,936 | B2 | 4/2008 | Ducharme et al. | 362/231 |
| 7,354,174 | B1 | 4/2008 | Yan | |
| 7,377,674 | B2 | 5/2008 | Klinkman et al. | 362/484 |
| 7,396,142 | B2 | 7/2008 | Laizure, Jr. et al. | |
| 7,405,857 | B2 * | 7/2008 | Ma et al. | 359/261 |
| D581,556 | S | 11/2008 | To et al. | D26/2 |
| 7,549,782 | B2 | 6/2009 | Ng et al. | 362/555 |
| 7,600,882 | B1 | 10/2009 | Morejon et al. | |
| 7,607,802 | B2 | 10/2009 | Kang et al. | 362/294 |
| 7,614,759 | B2 | 11/2009 | Negley | |
| 7,618,157 | B1 | 11/2009 | Galvez | |
| 7,663,315 | B1 | 2/2010 | Hulse | |
| 7,686,478 | B1 | 3/2010 | Hulse | |
| 7,726,836 | B2 | 6/2010 | Chen | |
| 7,740,365 | B2 * | 6/2010 | Huttner et al. | 362/97.3 |
| 7,753,568 | B2 | 7/2010 | Hu et al. | 362/373 |
| 7,810,954 | B2 * | 10/2010 | Kolodin | 362/277 |
| 7,824,065 | B2 | 11/2010 | Maxik | |
| D629,928 | S | 12/2010 | Chen et al. | |
| 7,884,538 | B2 | 2/2011 | Mitsuishi et al. | 313/502 |
| 7,976,335 | B2 | 7/2011 | Weber et al. | 439/487 |
| 8,021,025 | B2 | 9/2011 | Lee | |
| 8,235,571 | B2 * | 8/2012 | Park | 362/555 |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,309,969 | B2 | 11/2012 | Suehiro et al. | 257/79 |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,410,512 | B2 | 4/2013 | Andrews | 257/99 |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,568,009 | B2 | 10/2013 | Chiang et al. | 362/563 |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2002/0047516 | A1 | 4/2002 | Iwasa | |
| 2003/0021113 | A1 | 1/2003 | Begemann | |
| 2003/0038291 | A1 | 2/2003 | Cao | |
| 2004/0201990 | A1 | 10/2004 | Neyer | |
| 2004/0223315 | A1 | 11/2004 | Suehiro et al. | 362/84 |
| 2005/0068776 | A1 | 3/2005 | Ge | 362/296 |
| 2005/0142379 | A1 * | 6/2005 | Juni et al. | 428/690 |
| 2005/0174780 | A1 | 8/2005 | Park | 362/294 |
| 2005/0242711 | A1 | 11/2005 | Bloomfield | |
| 2005/0276053 | A1 | 12/2005 | Nortrup et al. | 362/294 |
| 2006/0097245 | A1 | 5/2006 | Aanegola et al. | 257/26 |
| 2006/0097385 | A1 | 5/2006 | Negley | 257/722 |
| 2006/0105482 | A1 | 5/2006 | Alferink et al. | 438/22 |
| 2006/0138435 | A1 | 6/2006 | Tarsa et al. | 257/89 |
| 2006/0152140 | A1 | 7/2006 | Brandes | 313/503 |
| 2006/0180774 | A1 | 8/2006 | Endo | 250/485.1 |
| 2006/0227558 | A1 | 10/2006 | Osawa et al. | 362/351 |
| 2007/0090737 | A1 | 4/2007 | Hu et al. | 313/11 |
| 2007/0139938 | A1 | 6/2007 | Petroski | |
| 2007/0139949 | A1 | 6/2007 | Tanda et al. | 362/551 |
| 2007/0158668 | A1 | 7/2007 | Tarsa et al. | 257/98 |
| 2007/0206375 | A1 | 9/2007 | Lys et al. | |
| 2007/0215890 | A1 | 9/2007 | Harbers et al. | 257/98 |
| 2007/0223219 | A1 | 9/2007 | Medendorp | |
| 2007/0263405 | A1 | 11/2007 | Ng | |
| 2007/0267976 | A1 | 11/2007 | Bohler et al. | 315/112 |
| 2007/0274080 | A1 | 11/2007 | Negley et al. | 362/341 |

(56) References Cited

U.S. PATENT DOCUMENTS

| | | | | |
|---|---|---|---|---|
| 2007/0285924 | A1 | 12/2007 | Morris et al. | 362/264 |
| 2007/0297183 | A1 | 12/2007 | Coushaine | |
| 2008/0037257 | A1 | 2/2008 | Bolta | |
| 2008/0062694 | A1 | 3/2008 | Lai et al. | 362/294 |
| 2008/0080165 | A1 | 4/2008 | Kim | |
| 2008/0093615 | A1 | 4/2008 | Lin et al. | 257/98 |
| 2008/0106893 | A1 | 5/2008 | Johnson et al. | 362/228 |
| 2008/0117620 | A1 | 5/2008 | Hama et al. | 362/84 |
| 2008/0128735 | A1 | 6/2008 | Yoo | |
| 2008/0149166 | A1 | 6/2008 | Beeson et al. | 136/248 |
| 2008/0173884 | A1 | 7/2008 | Chitnis et al. | 257/98 |
| 2008/0179611 | A1 | 7/2008 | Chitnis et al. | 257/98 |
| 2008/0308825 | A1 | 12/2008 | Chakraborty et al. | 257/98 |
| 2009/0001399 | A1 | 1/2009 | Diana et al. | 257/98 |
| 2009/0015137 | A1 | 1/2009 | Su et al. | 313/503 |
| 2009/0046473 | A1 | 2/2009 | Tsai et al. | 362/373 |
| 2009/0058256 | A1 | 3/2009 | Mitsuishi et al. | 313/487 |
| 2009/0059559 | A1 | 3/2009 | Pabst | |
| 2009/0086492 | A1 | 4/2009 | Meyer | |
| 2009/0095960 | A1 | 4/2009 | Murayama | 257/79 |
| 2009/0101930 | A1 | 4/2009 | Li | |
| 2009/0103293 | A1 | 4/2009 | Harbers et al. | |
| 2009/0103296 | A1 | 4/2009 | Harbers et al. | |
| 2009/0116217 | A1 | 5/2009 | Teng et al. | |
| 2009/0141474 | A1* | 6/2009 | Kolodin | 362/84 |
| 2009/0175041 | A1 | 7/2009 | Yuen et al. | |
| 2009/0184618 | A1 | 7/2009 | Hakata et al. | |
| 2009/0190353 | A1 | 7/2009 | Barker | 362/249 |
| 2009/0195186 | A1 | 8/2009 | Guest et al. | 315/294 |
| 2009/0201679 | A1 | 8/2009 | Konaka | 362/235 |
| 2009/0217970 | A1 | 9/2009 | Zimmerman et al. | 136/252 |
| 2009/0262516 | A1 | 10/2009 | Li | 362/84 |
| 2009/0283779 | A1 | 11/2009 | Negley et al. | 257/88 |
| 2009/0296387 | A1 | 12/2009 | Reisenauer et al. | 362/235 |
| 2009/0316073 | A1 | 12/2009 | Chen et al. | 349/64 |
| 2009/0316383 | A1 | 12/2009 | Son | |
| 2009/0322197 | A1 | 12/2009 | Helbing | |
| 2009/0322208 | A1 | 12/2009 | Shaikevitch et al. | 313/503 |
| 2009/0322800 | A1 | 12/2009 | Atkins | 345/690 |
| 2009/0323333 | A1 | 12/2009 | Chang | |
| 2010/0014839 | A1 | 1/2010 | Benoy et al. | 386/117 |
| 2010/0020547 | A1* | 1/2010 | Olsson | 362/311.02 |
| 2010/0025700 | A1 | 2/2010 | Jung et al. | |
| 2010/0026185 | A1 | 2/2010 | Betsuda et al. | 315/32 |
| 2010/0038660 | A1 | 2/2010 | Shuja | 257/98 |
| 2010/0046231 | A1 | 2/2010 | Medinis | 362/294 |
| 2010/0060144 | A1 | 3/2010 | Justel et al. | 313/503 |
| 2010/0091487 | A1 | 4/2010 | Shin | 362/235 |
| 2010/0096967 | A1 | 4/2010 | Marinus et al. | 313/46 |
| 2010/0102707 | A1 | 4/2010 | Fukuda et al. | 313/503 |
| 2010/0134047 | A1 | 6/2010 | Hasnain | |
| 2010/0140655 | A1 | 6/2010 | Shi | 257/99 |
| 2010/0149783 | A1 | 6/2010 | Takenaka et al. | 362/84 |
| 2010/0149814 | A1 | 6/2010 | Zhai et al. | 257/88 |
| 2010/0155763 | A1 | 6/2010 | Donofrio | |
| 2010/0170075 | A1 | 7/2010 | Kanade et al. | 29/428 |
| 2010/0201284 | A1 | 8/2010 | Kraus | |
| 2010/0207502 | A1 | 8/2010 | Cao et al. | 313/46 |
| 2010/0219735 | A1 | 9/2010 | Sakai et al. | 313/46 |
| 2010/0232134 | A1 | 9/2010 | Tran | 362/84 |
| 2010/0314985 | A1 | 12/2010 | Premysler | 313/46 |
| 2010/0327745 | A1 | 12/2010 | Dassanayake et al. | |
| 2010/0328925 | A1 | 12/2010 | Hoelen et al. | 362/84 |
| 2011/0037368 | A1 | 2/2011 | Huang | 313/46 |
| 2011/0074296 | A1 | 3/2011 | Shen et al. | |
| 2011/0080096 | A1 | 4/2011 | Dudik et al. | 315/112 |
| 2011/0080740 | A1* | 4/2011 | Allen et al. | 362/294 |
| 2011/0089830 | A1 | 4/2011 | Pickard et al. | 315/32 |
| 2011/0095686 | A1 | 4/2011 | Falicoff et al. | 315/35 |
| 2011/0133222 | A1 | 6/2011 | Allen et al. | 257/88 |
| 2011/0175528 | A1* | 7/2011 | Rains et al. | 315/51 |
| 2011/0176316 | A1 | 7/2011 | Phipps et al. | |
| 2011/0205733 | A1 | 8/2011 | Lenderink et al. | 362/231 |
| 2011/0215696 | A1 | 9/2011 | Tong et al. | 313/46 |
| 2011/0216523 | A1 | 9/2011 | Tong et al. | 362/84 |
| 2011/0267835 | A1 | 11/2011 | Boonekamp et al. | 362/555 |
| 2012/0040585 | A1 | 2/2012 | Huang | |
| 2012/0161626 | A1 | 6/2012 | Van de Ven et al. | 315/35 |
| 2012/0320591 | A1 | 12/2012 | Liao et al. | 362/249 |
| 2013/0049018 | A1 | 2/2013 | Ramer et al. | 257/81 |
| 2013/0063945 | A1 | 3/2013 | Wu et al. | 362/249 |
| 2013/0249374 | A1 | 9/2013 | Lee et al. | 313/12 |

FOREIGN PATENT DOCUMENTS

| | | | |
|---|---|---|---|
| CN | 1013388887 | A | 1/2009 |
| DE | 10251955 | A1 | 5/2004 |
| DE | 102004051382 | | 4/2006 |
| DE | 102006061164 | | 6/2008 |
| DE | 10 2007 037862 | A1 | 10/2008 |
| DE | 202008013667 | | 12/2008 |
| DE | 102011004718 | | 8/2012 |
| EP | 0876085 | A2 | 11/1998 |
| EP | 0890059 | A1 | 1/1999 |
| EP | 1058221 | A2 | 6/2000 |
| EP | 1881259 | | 1/2008 |
| EP | 2146135 | A2 | 1/2010 |
| EP | 2154420 | | 2/2010 |
| EP | 2469154 | | 6/2012 |
| FR | 2941346 | | 7/2010 |
| GB | 2345954 | A | 7/2001 |
| GB | 2 366 610 | A | 3/2002 |
| GB | 2366610 | A | 3/2002 |
| JP | H03081903 | | 4/1991 |
| JP | H06283006 | | 10/1994 |
| JP | H09265807 | | 10/1997 |
| JP | H11177149 | | 7/1999 |
| JP | 11-213730 | A | 8/1999 |
| JP | H11260125 | | 9/1999 |
| JP | 200002222 | | 1/2000 |
| JP | 200017330 | | 6/2000 |
| JP | 2001118403 | | 4/2001 |
| JP | 2003515899 | | 5/2003 |
| JP | 2004146225 | | 5/2004 |
| JP | 2004241318 | | 8/2004 |
| JP | 2005-093097 | A | 4/2005 |
| JP | 20051008700 | | 4/2005 |
| JP | 2005244226 | | 9/2005 |
| JP | 2005-286267 | A | 10/2005 |
| JP | 2005277127 | | 10/2005 |
| JP | 2005021635 | | 11/2005 |
| JP | 2006156187 | | 6/2006 |
| JP | 20066159187 | | 6/2006 |
| JP | WO 2006065558 | | 6/2006 |
| JP | 200640850 | A | 9/2006 |
| JP | 2006525648 | | 11/2006 |
| JP | 2006331683 | | 12/2006 |
| JP | 200759930 | | 3/2007 |
| JP | 3138653 | | 12/2007 |
| JP | 2008505448 | | 2/2008 |
| JP | 2008091140 | | 4/2008 |
| JP | 2008108835 | | 5/2008 |
| JP | 2008187195 | | 8/2008 |
| JP | 2008262765 | | 10/2008 |
| JP | 200828183 | | 11/2008 |
| JP | 2008288409 | | 11/2008 |
| JP | 2008300117 | | 12/2008 |
| JP | 2008300203 | | 12/2008 |
| JP | 2008300570 | | 12/2008 |
| JP | 2009-016058 | A | 1/2009 |
| JP | 2009016058 | | 1/2009 |
| JP | 2009016153 | | 1/2009 |
| JP | 2009021264 | | 1/2009 |
| JP | 2009117346 | | 5/2009 |
| JP | WO 2009093163 | | 7/2009 |
| JP | U3153766 | | 8/2009 |
| JP | WO 2009119038 | | 10/2009 |
| JP | 2009277586 | | 11/2009 |
| JP | 2009295299 | | 12/2009 |
| JP | WO 2009148543 | | 12/2009 |
| JP | 2010016223 | | 1/2010 |
| JP | 2010040494 | | 2/2010 |
| JP | 2010050473 | | 3/2010 |
| JP | 2010129300 | | 6/2010 |

(56) References Cited

FOREIGN PATENT DOCUMENTS

| | | | |
|---|---|---|---|
| JP | 2010267826 | | 11/2010 |
| KR | 100944181 | | 2/2010 |
| KR | 1020100037353 | | 4/2010 |
| KR | 100980588 | B1 | 9/2010 |
| KR | 3020110008445 | | 3/2011 |
| TW | D134005 | | 3/2010 |
| TW | 100300960 | | 3/2011 |
| TW | D141681 | | 7/2011 |
| WO | WO 00/17569 | A1 | 3/2000 |
| WO | 0124583 | A1 | 4/2001 |
| WO | WO 01/40702 | A1 | 6/2001 |
| WO | 0160119 | A2 | 8/2001 |
| WO | WO 2004100213 | A2 | 5/2004 |
| WO | WO 2005107420 | A2 | 11/2005 |
| WO | WO 2007146566 | A2 | 12/2007 |
| WO | WO 2008/018002 | A2 | 2/2008 |
| WO | WO 2008134056 | A1 | 4/2008 |
| WO | WO 2008/052318 | A1 | 5/2008 |
| WO | WO 2008/117211 | A1 | 10/2008 |
| WO | WO 2008/146229 | A2 | 12/2008 |
| WO | WO 2009052099 | | 4/2009 |
| WO | WO 2009/091562 | A2 | 7/2009 |
| WO | WO 2009/093163 | A2 | 7/2009 |
| WO | WO 2009093163 | A2 * | 7/2009 |
| WO | WO 2009/107052 | A1 | 9/2009 |
| WO | WO 2009107052 | | 9/2009 |
| WO | WO 2009/119038 | A2 | 10/2009 |
| WO | WO 2009125314 | A2 | 10/2009 |
| WO | WO 2009131627 | | 10/2009 |
| WO | WO 2009143047 | A2 | 11/2009 |
| WO | WO 2009/158422 | A1 | 12/2009 |
| WO | WO 2009158422 | A1 | 12/2009 |
| WO | WO 2010/012999 | A2 | 2/2010 |
| WO | WO 2010013893 | | 2/2010 |
| WO | WO 2010052640 | | 5/2010 |
| WO | WO 2010/119618 | A1 | 10/2010 |
| WO | WO 2010/128419 | A1 | 11/2010 |
| WO | WO 2011100193 | | 8/2011 |
| WO | 2012011279 | | 1/2012 |
| WO | 2012031533 | | 3/2012 |

OTHER PUBLICATIONS

International Search Report and Written Opinion for PCT Application No. PCT/US2010/003146 mailed Jun. 7, 2011.
Decision for Final Rejection for Japanese Patent Application No. 2001-542133 mailed Jun. 28, 2011.
Notice to Submit a Response from Korean Patent Application No. 30-2011-0008448, dated Apr. 16. 2012.
Notice to Submit a Response from Korean Patent Application No. 30-2011-0008445, dated Apr. 16. 2012.
Notice to Submit a Response from Korean Patent Application No. 30-2011-0008446, dated Apr. 16. 2012.
Office Action for Taiwanese Patent Application No. 100300961. dated May 7, 2012.
Office Action from Taiwanese Patent Application No. 100300960, dated May 7, 2012.
International Search Report and Written Opinion for PCT Application No. PCT/US2011/000399 mailed Jul. 12, 2011.
Decision to Refuse a European Patent Application for EP 09 152 962.8 dated Jul. 6, 2011.
International Search Report and Written Opinion for PCT/US2011/000403 mailed Aug. 23, 2011.
International Search Report and Written Opinion for PCT/US2011/000404 mailed Aug. 25, 2011.
International Search Report and Written Opinion for PCT/US2011/000398 mailed Aug. 30, 2011.
International Search Report and Written Opinion for PCT/US2011/000406 mailed Sep. 15, 2011.
International Search Report and Written Opinion for PCT Patent Application No. PCT/US2011/000405 mailed Nov. 2, 2011.
International Search Report and Written Opinion for PCT/US2011/000407 mailed Nov. 16, 2011.
Office Action of the IPO for Taiwan Patent Application No. TW 100300962 issued Nov. 21, 2011.
Office Action of the IPO for Taiwan Patent Application No. TW 100300961 issued Nov. 16, 2011.
Office Action of the IPO for Taiwan Patent Application No. TW 100300960 issued Nov. 15, 2011.
Office Action of the IPO for Taiwan Patent Application No. TW 100302770 issued Jan. 13, 2012.
International Search Report and Written Opinion for PCT Application No. PCT/US2011/000391 mailed Oct. 6, 2011.
International Search Report and Written Opinion for PCT Application No. PCT/US2011/000402 mailed Sep. 30, 2011.
International Search Report and Written Opinion from PCT Application No. PCT/US2012/044705 dated Oct. 9, 2012.
Notice to Submit a Response from Korean Patent Application No. 30-2011-0008446, dated Oct. 22, 2012.
Notice to Submit a Response from Korean Design Patent Application No. 30-2011-0024961, dated Sep. 10, 2012.
Office Action from U.S. Appl. No. 13/028,946, dated Jul. 16, 2012.
Response to OA from U.S. Appl. No. 13/028,946, filed Oct. 8, 2012.
Office Action from U.S. Appl. No. 13/029,025, dated Jul. 16, 2013.
Office Action from U.S. Appl. No. 13/430,478, dated Jun. 18, 2013.
Office Action from U.S. Appl. No. 12/901,405, dated Jul. 1, 2013.
Office Action from U.S. Appl. No. 13/022,490, dated Nov. 7, 2012.
Response to OA from U.S. Appl. No. 13/022,490, filed Feb. 1, 2013.
Office Action from U.S. Appl. No. 13/034,501, dated Dec. 3, 2012.
Response to OA from U.S. Appl. No. 13/034,501, filed Apr. 3, 2013.
Office Action from U.S. Appl. No. 13/028,946, dated Dec. 4, 2012.
Response to OA from U.S. Appl. No. 13/028,946, filed Jan. 29, 2013.
Office Action from U.S. Appl. No. 13/029,005, dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 12/985,275, dated Feb. 28, 2013.
Response to OA from U.S. Appl. No. 12/985,275, filed May 28, 2013.
Office Action from U.S. Appl. No. 13/022,490, dated Apr. 2, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/028,913, dated Apr. 29, 2013.
Office Action from U.S. Appl. No. 13/029,005, dated Jan. 4, 2013.
Response to OA from U.S. Appl. No. 13/029,005, filed Apr. 17, 2013.
Office Action from U.S. Appl. No. 12/848,825, dated Nov. 5, 2012.
Response to OA from U.S. Appl. No. 12/848,825, filed Feb. 5, 2013.
Office Action from U.S. Appl. No. 13/029,005. dated Jun. 11, 2013.
International Search Report and Written Opinion from PCT Application No. PCT/US2011/000389, dated May 6, 2013.
International Search Report and Written Opinion from PCT Application No. PCT/US2011/000390, dated May 6, 2013.
International Preliminary Report on Patentability from PCT/US2011/00389, dated May 8, 2013.
International Preliminary Report on Patentability from PCT/US2011/000390, dated May 8, 2013.
Reasons for Rejection from Japanese Patent Appl. No. 2011-198454, dated Mar. 7, 2013.
Notice of Reasons for Rejection from Japanese Patent Appl. No. 2012-543086, dated Aug. 27, 2013.
Decision of Dismissal of Amendment, Decision of Rejection from Japanese Patent Appl. No. 2011-231319, dated Oct. 15, 2013.
Office Action from Japanese Patent Appl. No. 2012-556063, dated Oct. 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from U.S. Appl. No. 13/028,913, dated Nov. 4, 2013.
Office Action from Japanese Patent Appl. No. 2012-556064, dated Oct. 29, 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029,068, dated Nov. 15, 2013.
Office Action from U.S. Appl. No. 13/029,025, dated Dec. 6, 2013.

(56) References Cited

OTHER PUBLICATIONS

First Office Action from Chinese Patent Appl. No. 201080062056.X, dated Feb. 12. 2014.
Office Action from U.S. Appl. No. 13/028,913, dated Feb. 19, 2014.
Office Action from U.S. Appl. No. 13/028,863, dated Mar. 4, 2014.
Office Action from U.S. Appl. No. 13/430,478, dated Feb. 21, 2014.
Office Action from U.S. Appl. No. 13/358,901, dated Mar. 6, 2014.
Office Action from U.S. Appl. No. 13/029,025, dated Mar. 19, 2014.
Office Action from U.S. Appl. No. 13/022,440, dated Oct. 17, 2013.
Office Action from U.S. Appl. No. 11/149,999, dated May 13, 2013.
Response to OA from U.S. Appl. No. 11/149,999, filed Sep. 13, 2013.
Office Action from U.S. Appl. No. 12/985,275, dated Aug. 27, 2013.
Office Action from U.S. Appl. No. 13/358,901, dated Oct. 9, 2013.
Office Action from U.S. Appl. No. 13/028,863, dated Jul. 30, 2013.
Office Action from U.S. Appl. No. 13/029,063, dated Apr. 1, 2014.
Office Action from U.S. Appl. No. 12/985,275, dated Apr. 10, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
First Office Action from Chinese Patent Application No. 2011800207069, dated May 5. 2014.
First Office Action from Chinese Patent Application No. 201180022606, dated May 4, 2014.
Notice of Reasons for Rejection from Japanese Patent Appl. No. 2012-543086, dated Dec. 24, 2013.
Office Action from Japanese Patent Appl. No, 2012-556062, dated Dec. 20, 2013.
International Preliminary Report on Patentability and Written Opinion from PCT/US2012/044705 dated Jan. 7, 2014.
Office Action from Japanese Patent appl. No. 2012-556063, dated Jan. 28, 2014.
Comments on the Written Opinion and Amendment of the Application from European Patent appl. No. 12740244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014.
Office Action from U.S. Appl. No. 13/034,501, dated Jan. 23, 2014.
Cree XLamp® XP-G LED, Product Info and Data Sheet, 14 Pages, May 13, 2011.
Cree XLamp® XP-E LED, Product Info and Data Sheet, 20 Pages, May 13, 2011.
Office Action from Japanese Patent Appl. No. 2012-556066, dated Mar. 14, 2014.
U.S. Appl. No. 11/656,759, filed Jan. 22, 2007 Chitnis.
U.S. Appl. No. 11/899,790, filed Sep. 7, 2007 Chitnis.
U.S. Appl. No. 11/473,089, filed Jun. 21, 2006 Tarsa.
U.S. Appl. No. 61/435,759, filed Jan. 24, 2011 Le.
U.S. Appl. No. 61/339,516, filed Mar. 3, 2010 Tong.
International Search Report and Written Opinion, PCT/US2009/063804, Mailed on Feb. 26, 2010.
U.S. Appl. No. 12/566,195, Van De Ven, filed Sep. 24, 2009.
U.S. Appl. No. 12/704,730, Van De Ven, filed Feb. 12, 2010
C.Crane Geobulb®-II LED Light Bulb, Item #2SW, Description, p. 1-2, Aug. 18, 2010.
C.Crane Geobulb®-II LED Light Bulb, Item #2SW, Specs, p. 1-2, Aug. 18, 2010.
Cree LR4, 4" Recessed Architectural Downlight, Product Info p. 1-2, Aug. 18, 2010.
Cree LR6, 6" Recessed Downlight Module, Product Info, p. 1-2.
U.S. Appl. No. 12/901,405, filed Oct. 8, 2010, Tong.
U.S. Appl. No. 61/339,515, filed Mar. 3, 2010, Tong.
U.S. Appl. No. 12/848,825, filed Aug. 2, 2010, Tong.
Office Action from U.S. Appl. No. 13/029,068, dated Jun. 13, 2014.
Office Action from U.S. Appl. No. 13/018,245, dated Jun. 10, 2014.
Decision of Rejection from Japanese Patent Appl. No. 2012-556064. dated Jun. 6. 2014.
Decision to Grant from Japanese Patent Appl. No. 2012-556066, dated Jul. 4, 2014.
First Office Action from Chinese Patent Appl. No. 201180020709.2. dated May 4. 2014.
Office Action from U.S. Appl. No. 13/028,946, dated May 27, 2014.
Office Action from U.S. Appl. No. 13/028,913, dated May, 22, 2014.

* cited by examiner

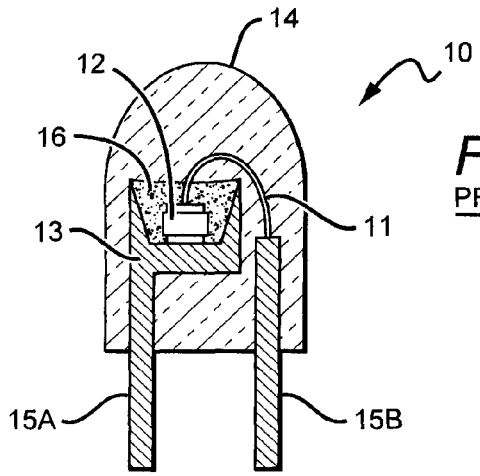
FIG. 1
PRIOR ART
FIG. 2
PRIOR ART
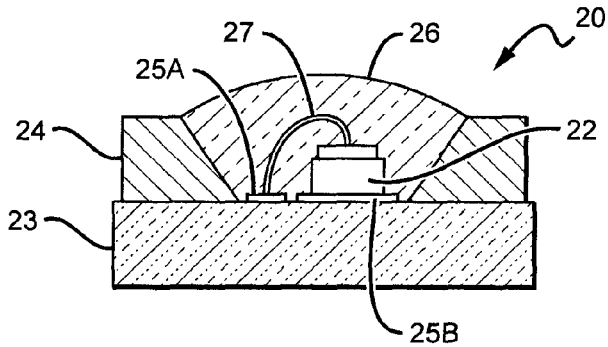
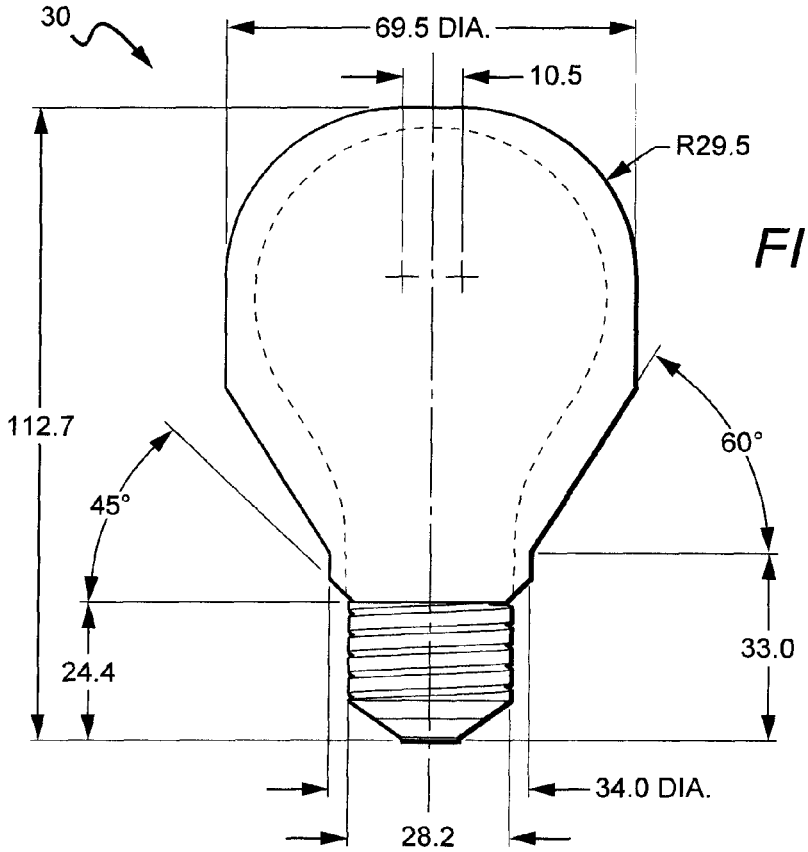
FIG. 3

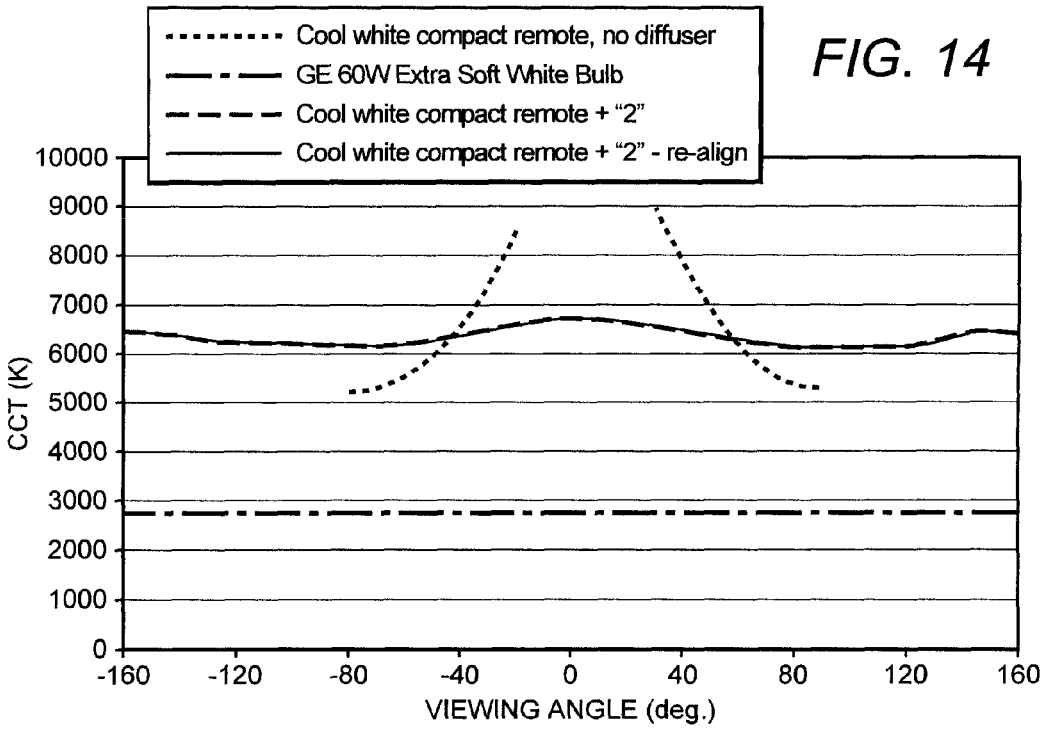
FIG. 14
FIG. 17
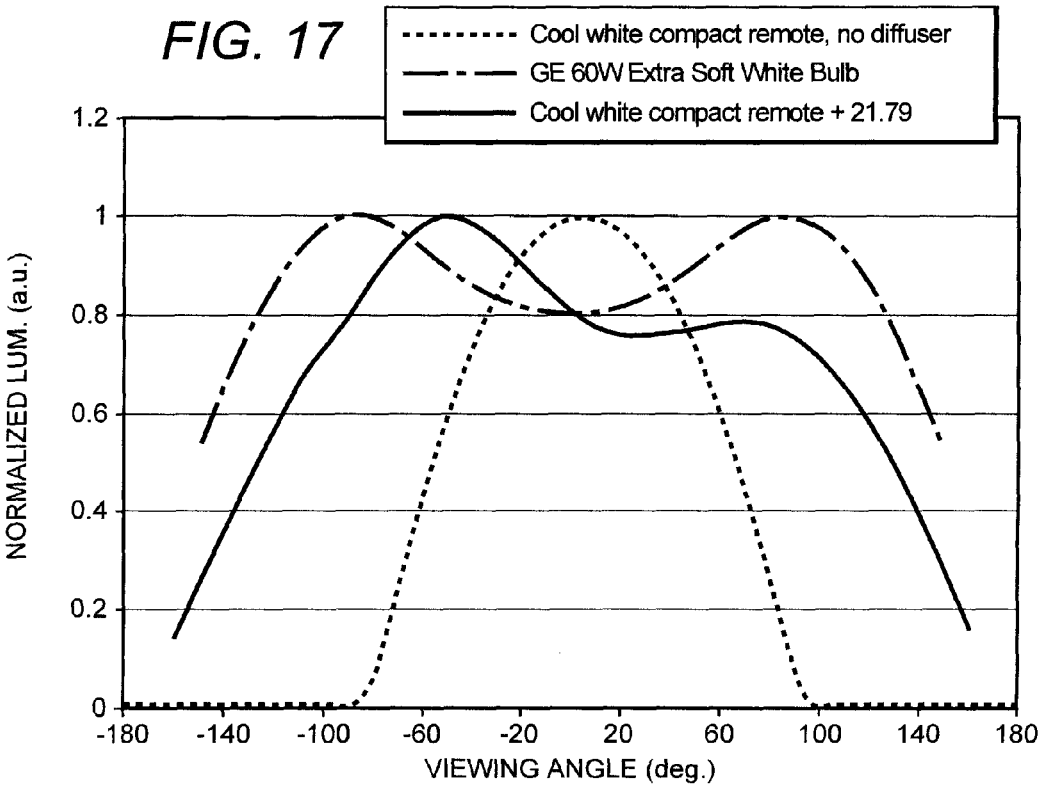

| COOL WHITE COMPACT REMOTE + | | "2" |
|---|---|---|
| | RESULT | E-STAR |
| FORWARD FLUX (<90°) | 58.0% | |
| BACKWARD FLUX (>90°) | 42.0% | |
| FLUX > 135° | 5.5% | >5% |
| MAX TO AVG. DIFF. 0° TO 135° | 15.8% | <20% |
| MIN TO AVG. DIFF. 0° TO 135° | 38.0% | <20% |
| MEAS. 0°. 45°, 90° AZIMUTHS | NO | YES |

| COOL WHITE COMPACT REMOTE + | | "2" |
|---|---|---|
| | RESULT | E-STAR |
| FORWARD FLUX (<90°) | 53.4% | |
| BACKWARD FLUX (>90°) | 46.6% | |
| FLUX > 135° | 6.9% | >5% |
| MAX TO AVG. DIFF. 0° TO 135° | 15.2% | <20% |
| MIN TO AVG. DIFF. 0° TO 135° | 25.6% | <20% |
| MEAS. 0°. 45°, 90° AZIMUTHS | NO | YES |

| COOL WHITE COMPACT REMOTE + | | 21.79 |
|---|---|---|
| | RESULT | E-STAR |
| FORWARD FLUX (<90°) | 59.9% | |
| BACKWARD FLUX (>90°) | 40.1% | |
| FLUX > 135° | 5.9% | >5% |
| MAX TO AVG. DIFF. 0° TO 135° | 12.9% | <20% |
| MIN TO AVG. DIFF. 0° TO 135° | 38.4% | <20% |
| MEAS. 0°. 45°, 90° AZIMUTHS | NO | YES |

| COOL WHITE COMPACT REMOTE + | | 21.79 |
|---|---|---|
| | RESULT | E-STAR |
| FORWARD FLUX (<90°) | 64.3% | |
| BACKWARD FLUX (>90°) | 35.7% | |
| FLUX > 135° | 4.9% | >5% |
| MAX TO AVG. DIFF. 0° TO 135° | 22.3% | <20% |
| MIN TO AVG. DIFF. 0° TO 135° | 48.4% | <20% |
| MEAS. 0°. 45°, 90° AZIMUTHS | NO | YES |

| COOL WHITE COMPACT REMOTE + | | 28 |
|---|---|---|
| | RESULT | E-STAR |
| FORWARD FLUX (<90°) | 63.1% | |
| BACKWARD FLUX (>90°) | 36.9% | |
| FLUX > 135° | 4.9% | >5% |
| MAX TO AVG. DIFF. 0° TO 135° | 17.5% | <20% |
| MIN TO AVG. DIFF. 0° TO 135° | 48.1% | <20% |
| MEAS. 0°. 45°, 90° AZIMUTHS | NO | YES |

| COOL WHITE COMPACT REMOTE + | | 28.0 |
|---|---|---|
| | RESULT | E-STAR |
| FORWARD FLUX (<90°) | 65.6% | |
| BACKWARD FLUX (>90°) | 34.4% | |
| FLUX > 135° | 4.8% | >5% |
| MAX TO AVG. DIFF. 0° TO 135° | 27.4% | <20% |
| MIN TO AVG. DIFF. 0° TO 135° | 50.6% | <20% |
| MEAS. 0°. 45°, 90° AZIMUTHS | NO | YES |

FIG. 26
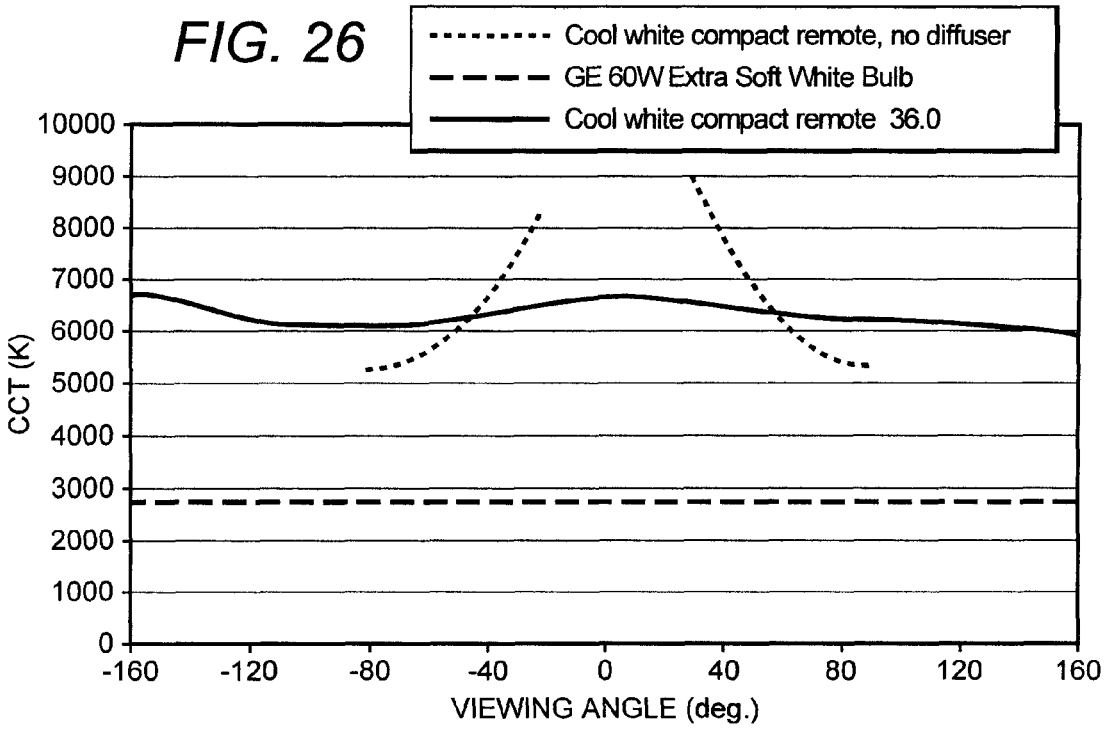
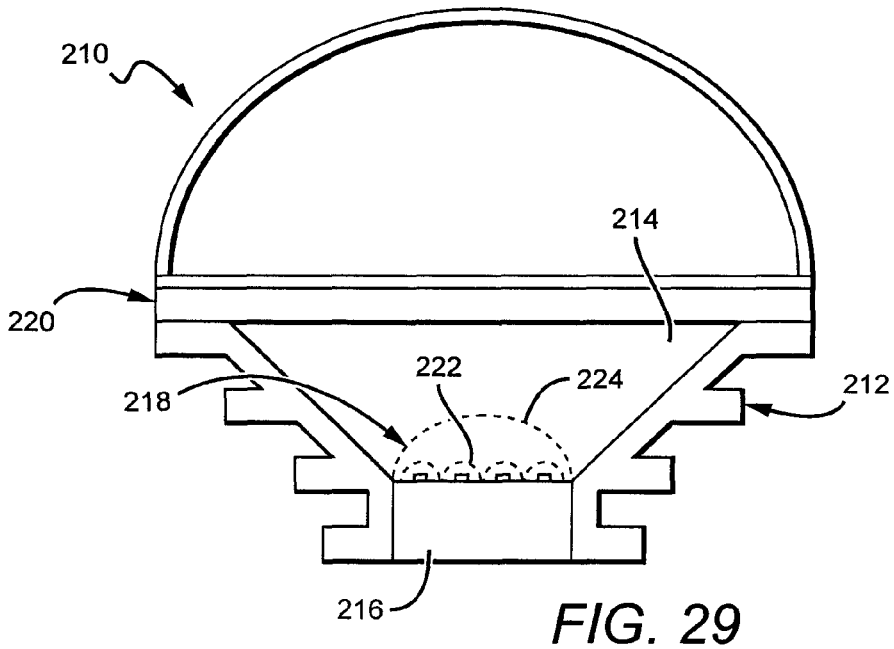
FIG. 29

| COOL WHITE COMPACT REMOTE + 36.0 | | |
|---|---|---|
| | RESULT | E-STAR |
| FORWARD FLUX (<90°) | 68.1% | |
| BACKWARD FLUX (>90°) | 31.9% | |
| FLUX > 135° | 3.2% | >5% |
| MAX TO AVG. DIFF. 0° TO 135° | 26.9% | <20% |
| MIN TO AVG. DIFF. 0° TO 135° | 61.2% | <20% |
| MEAS. 0°. 45°, 90° AZIMUTHS | NO | YES |

| COOL WHITE COMPACT REMOTE | | 36.0 |
|---|---|---|
| | RESULT | E-STAR |
| FORWARD FLUX (<90°) | 68.2% | |
| BACKWARD FLUX (>90°) | 31.8% | |
| FLUX > 135° | 4.6% | >5% |
| MAX TO AVG. DIFF. 0° TO 135° | 35.8% | <20% |
| MIN TO AVG. DIFF. 0° TO 135° | 55.9% | <20% |
| MEAS. 0°. 45°, 90° AZIMUTHS | NO | YES |

FIG. 34
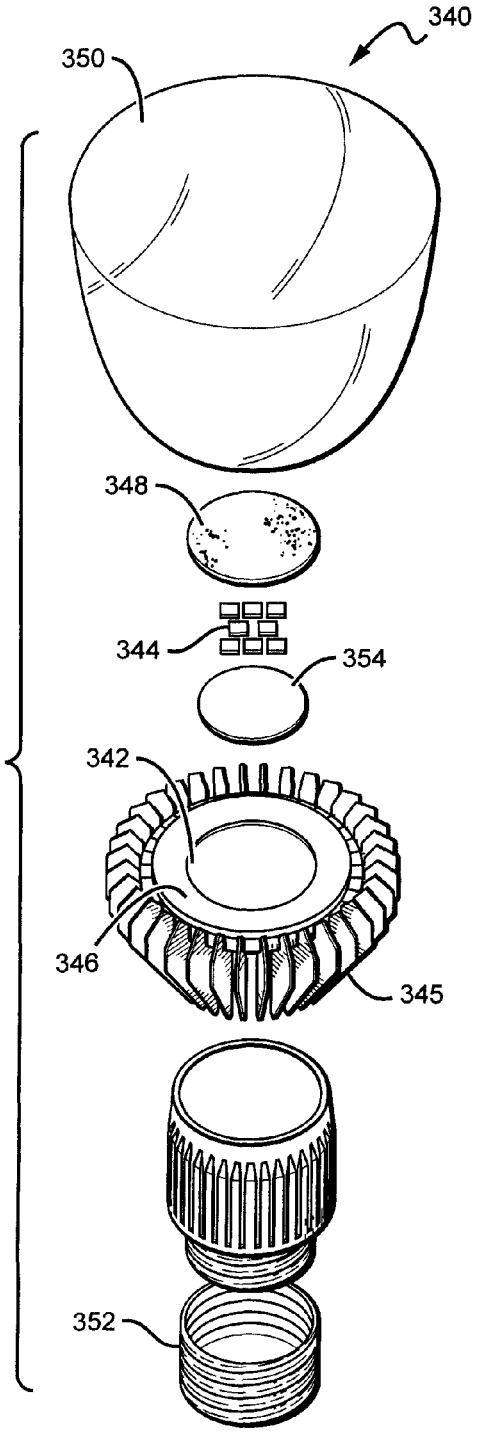
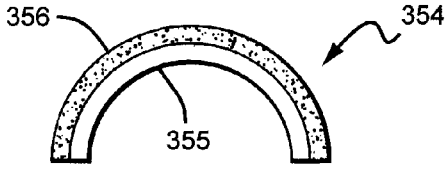
FIG. 35
FIG. 36
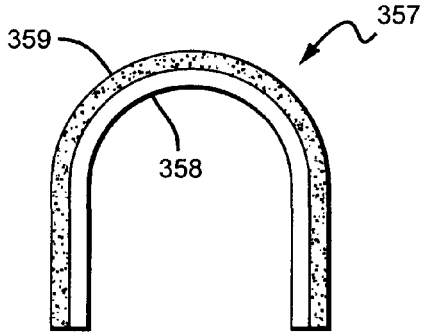
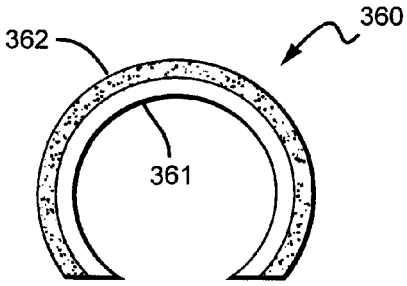
FIG. 37
FIG. 38
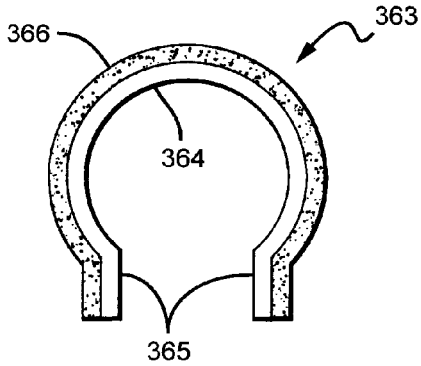

FIG. 42
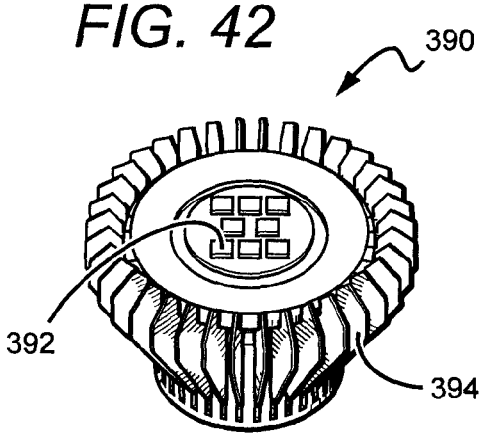
FIG. 43
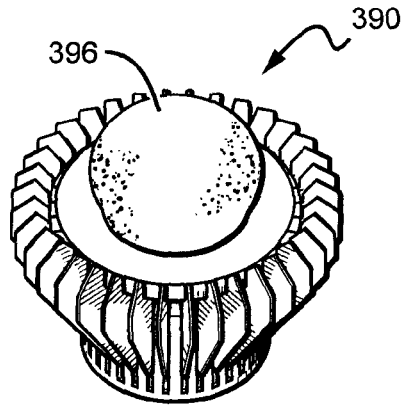
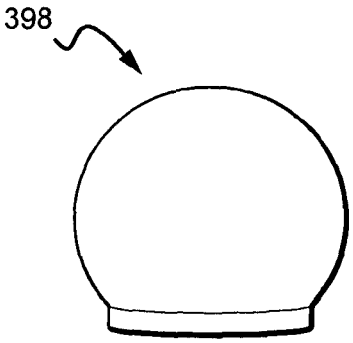
FIG. 44
FIG. 45
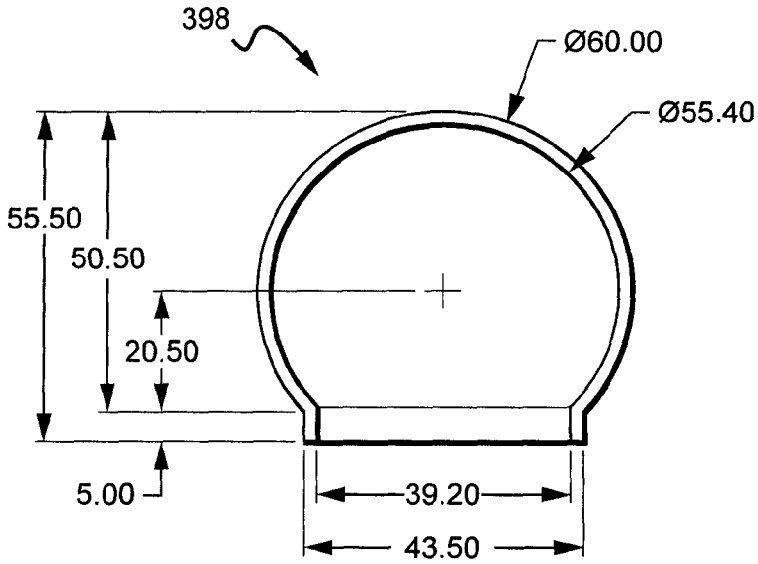

Phosphor miniglobe A (No diffuser)
GE 60W Extra Soft White Bulb
Phosphor miniglobe A+ Cree diffuser 6
NORMALIZED LUM. (a.u.)
1.2
1
0.8
0.6
0.4
0.2
0
-180
-140
-100
-60
-20
20
60
100
140
180
VIEWING ANGLE (deg.)

Phosphor miniglobe A (No diffuser)
GE 60W Extra Soft White Bulb
Phosphor miniglobe A+ Cree diffuser 6
CCT (K)
3500
3400
3300
3200
3100
3000
2900
2800
2700
2600
2500
-160
-120
-80
-40
0
40
80
120
160
VIEWING ANGLE (deg.)

| Phosphore miniglobe A + Cree Diffuser 6 | | |
|---|---|---|
| | RESULT | E-STAR |
| FORWARD FLUX (<90°) | 55.1% | |
| BACKWARD FLUX (>90°) | 44.9% | |
| FLUX > 135° | 8.5% | >5% |
| MAX TO AVG. DIFF. 0° TO 135° | 9.6% | <20% |
| MIN TO AVG. DIFF. 0° TO 135° | 25.3% | <20% |
| MEAS. 0°. 45°, 90° AZIMUTHS | NO | YES |

| Phosphore miniglobe A + Cree Diffuser 6 | | |
|---|---|---|
| | RESULT | E-STAR |
| FORWARD FLUX (<90°) | 58.3% | |
| BACKWARD FLUX (>90°) | 41.7% | |
| FLUX > 135° | 7.6% | >5% |
| MAX TO AVG. DIFF. 0° TO 135° | 11.4% | <20% |
| MIN TO AVG. DIFF. 0° TO 135° | 33.3% | <20% |
| MEAS. 0°. 45°, 90° AZIMUTHS | NO | YES |

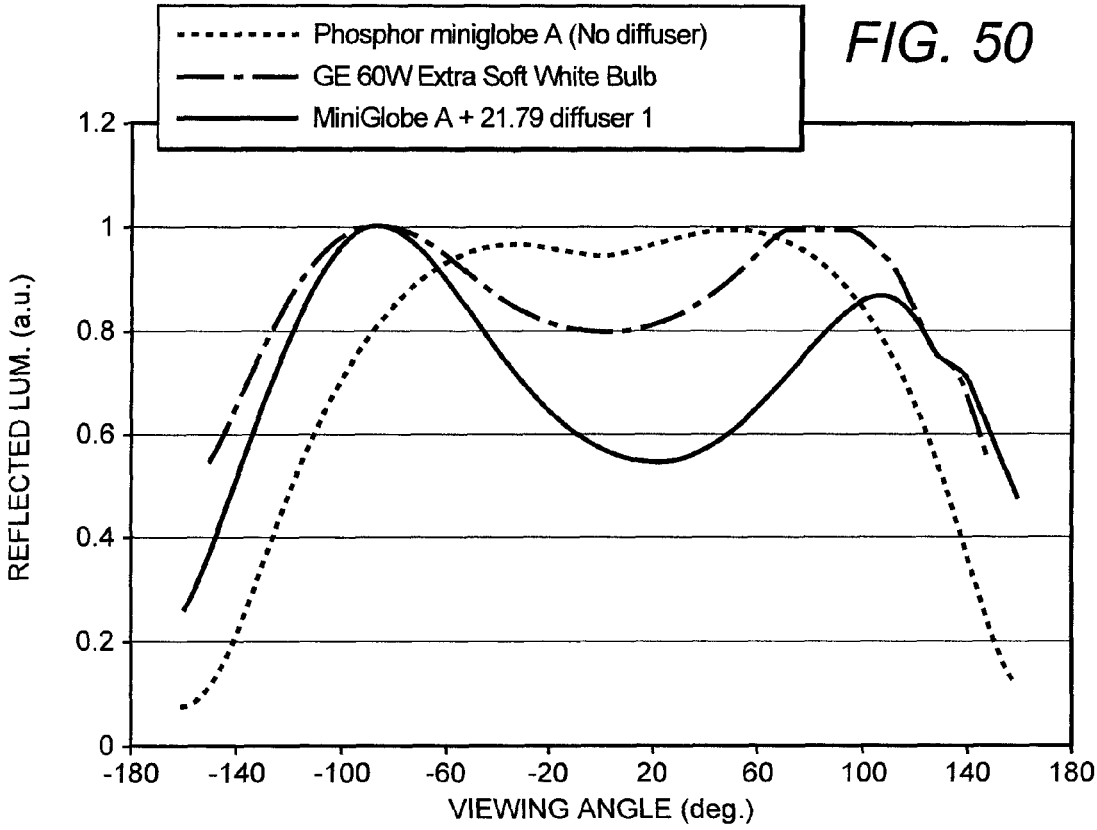
FIG. 50
FIG. 51
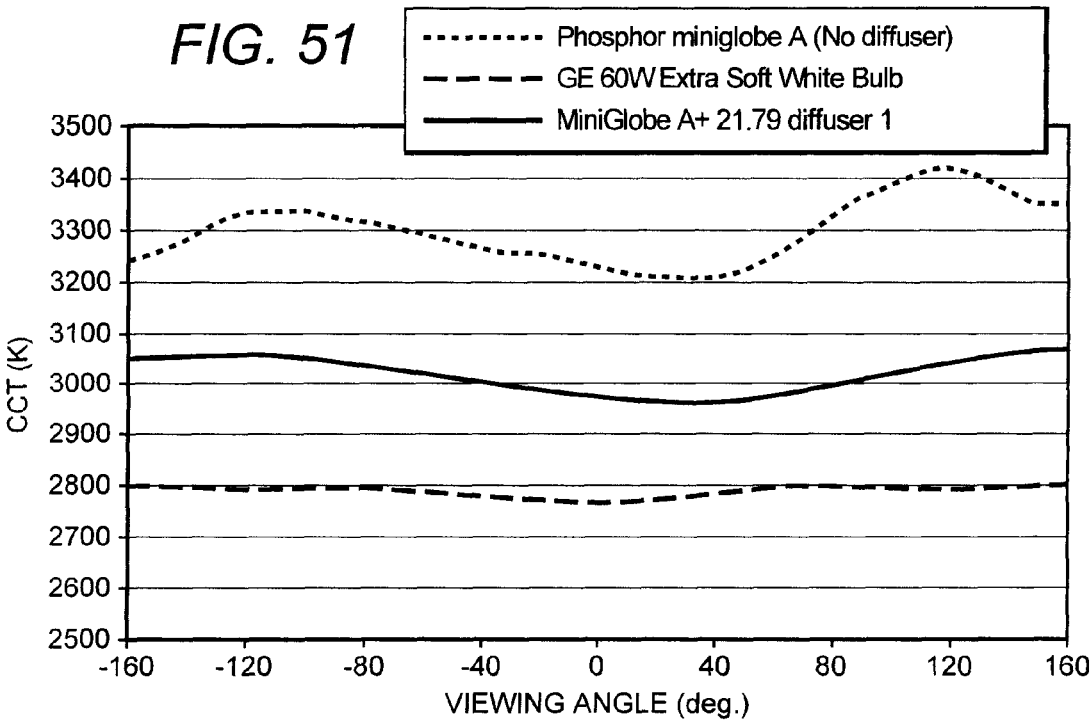

| MiniGlobe A + 21.79 diffuser 1 | | |
|---|---|---|
| | RESULT | E-STAR |
| FORWARD FLUX (<90°) | 47.2% | |
| BACKWARD FLUX (>90°) | 52.8% | |
| FLUX > 135° | 11.7% | >5% |
| MAX TO AVG. DIFF. 0° TO 135° | 16.9% | <20% |
| MIN TO AVG. DIFF. 0° TO 135° | 25.0% | <20% |
| MEAS. 0°. 45°, 90° AZIMUTHS | NO | YES |

| MiniGlobe A + 21.79 diffuser 1 | | |
|---|---|---|
| | RESULT | E-STAR |
| FORWARD FLUX (<90°) | 55.2% | |
| BACKWARD FLUX (>90°) | 44.8% | |
| FLUX > 135° | 6.9% | >5% |
| MAX TO AVG. DIFF. 0° TO 135° | 16.2% | <20% |
| MIN TO AVG. DIFF. 0° TO 135° | 33.0% | <20% |
| MEAS. 0°. 45°, 90° AZIMUTHS | NO | YES |

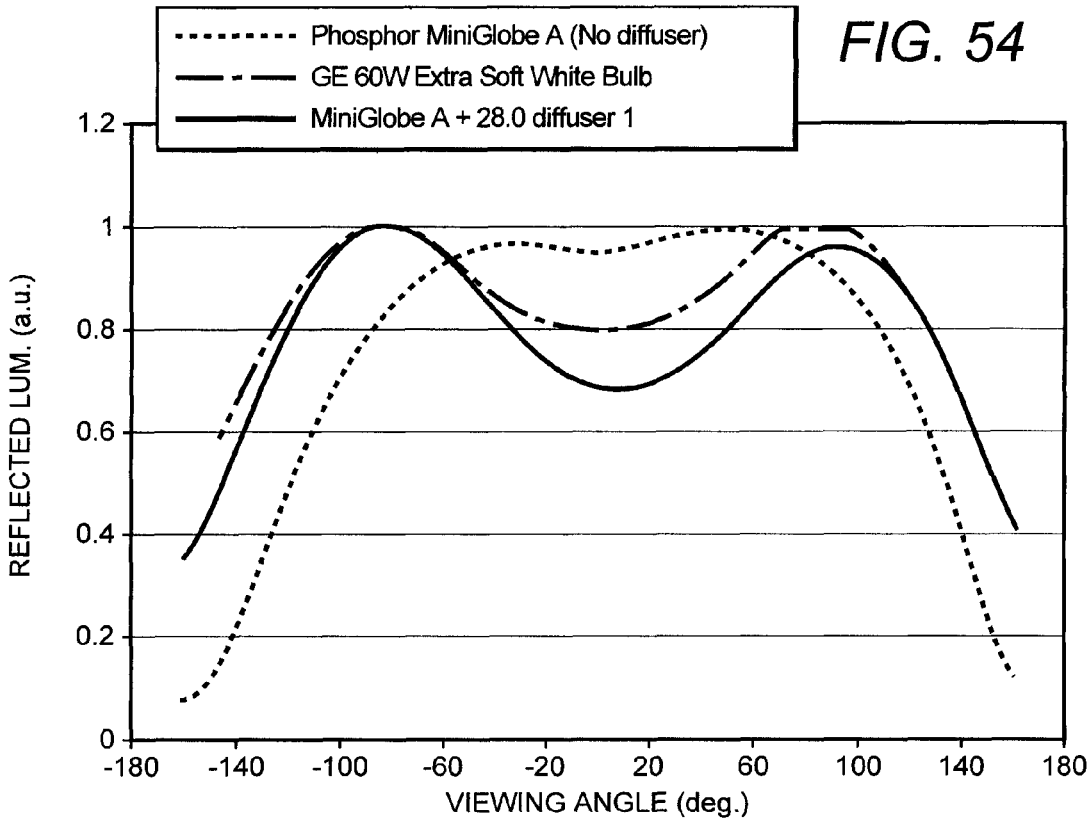
FIG. 54
FIG. 55
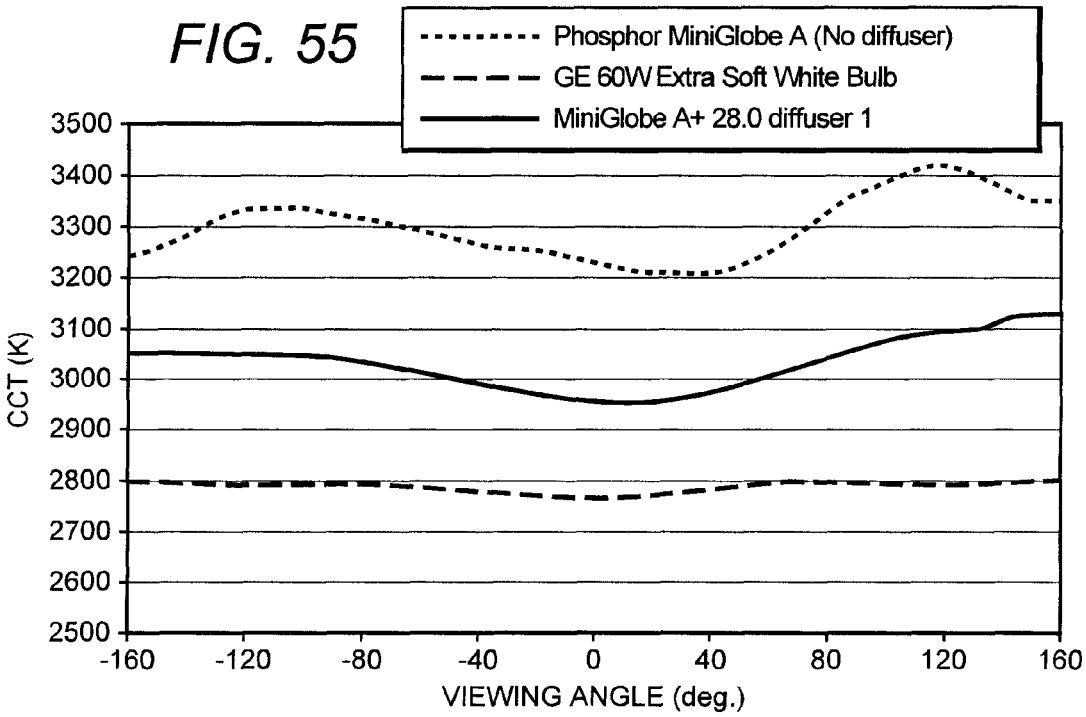

| MiniGlobe A + 28.0 Diffuser 1 | | |
|---|---|---|
| | RESULT | E-STAR |
| FORWARD FLUX (<90°) | 52.6% | |
| BACKWARD FLUX (>90°) | 47.4% | |
| FLUX > 135° | 9.1% | >5% |
| MAX TO AVG. DIFF. 0° TO 135° | 11.9% | <20% |
| MIN TO AVG. DIFF. 0° TO 135° | 20.3% | <20% |
| MEAS. 0°. 45°, 90° AZIMUTHS | NO | YES |

| MiniGlobe A + 28.0 Diffuser 1 | | |
|---|---|---|
| | RESULT | E-STAR |
| FORWARD FLUX (<90°) | 55.1% | |
| BACKWARD FLUX (>90°) | 44.9% | |
| FLUX > 135° | 8.0% | >5% |
| MAX TO AVG. DIFF. 0° TO 135° | 12.1% | <20% |
| MIN TO AVG. DIFF. 0° TO 135° | 28.0% | <20% |
| MEAS. 0°. 45°, 90° AZIMUTHS | NO | YES |

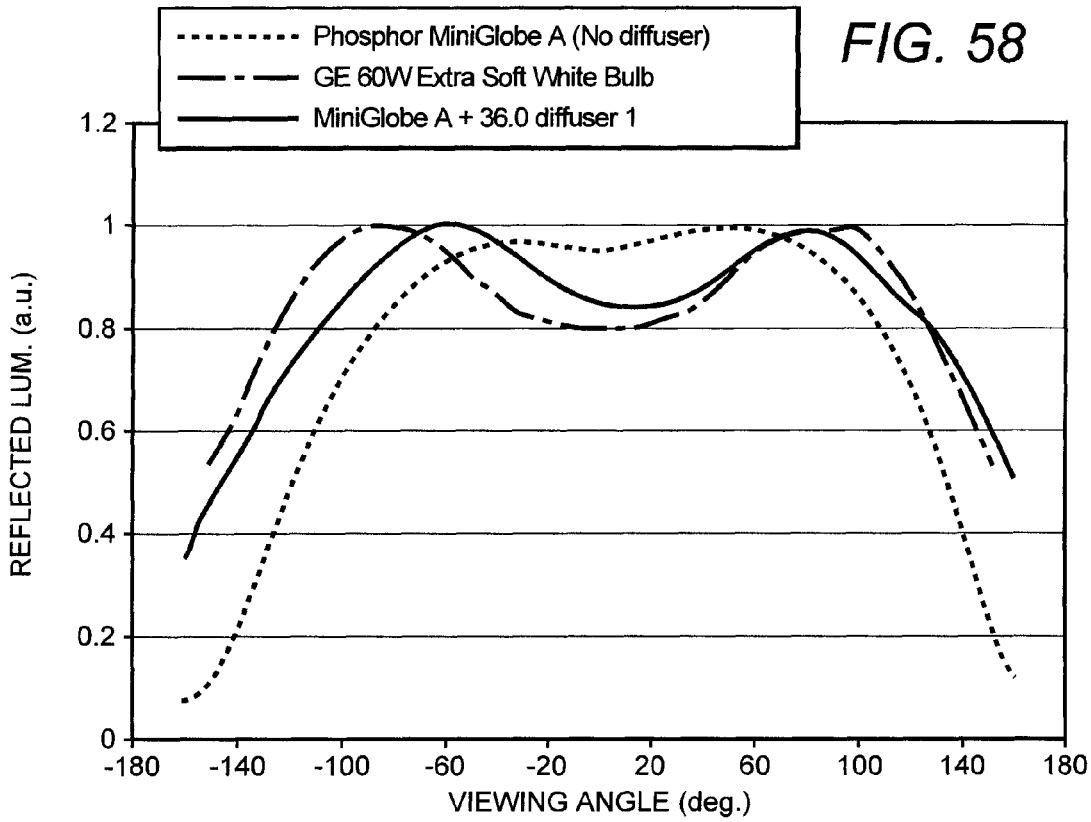
FIG. 58
FIG. 59
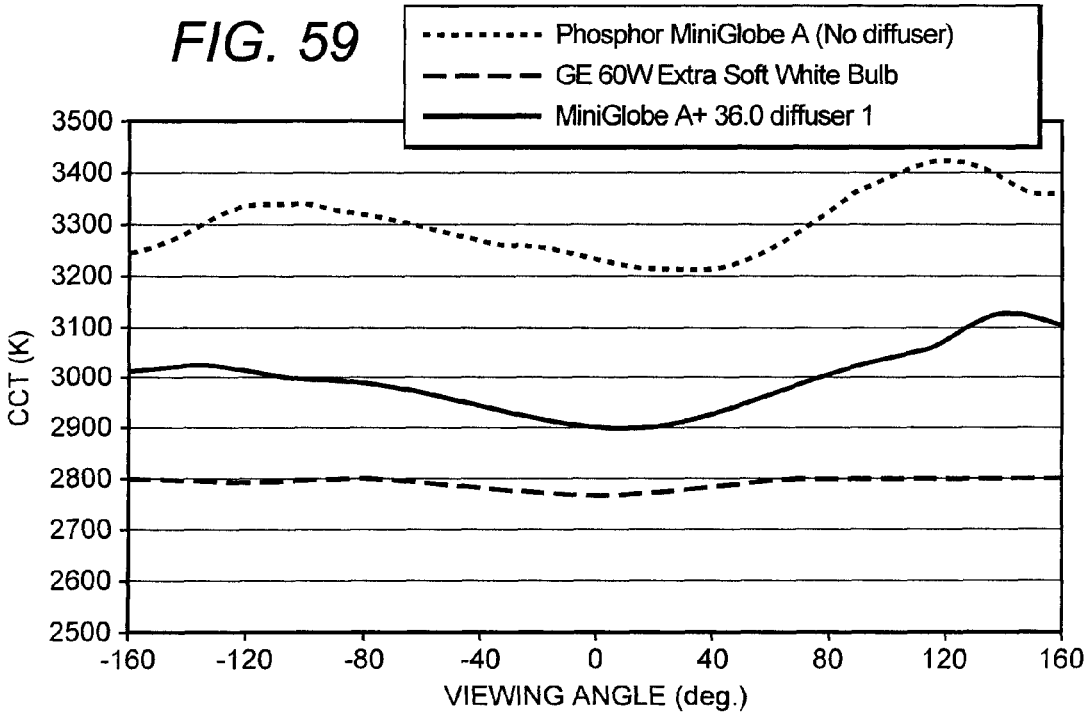

| MiniGlobe A + 36.0 Diffuser 1 | | |
|---|---|---|
| | RESULT | E-STAR |
| FORWARD FLUX (<90°) | 54.5% | |
| BACKWARD FLUX (>90°) | 45.5% | |
| FLUX > 135° | 9.7% | >5% |
| MAX TO AVG. DIFF. 0° TO 135° | 7.6% | <20% |
| MIN TO AVG. DIFF. 0° TO 135° | 18.9% | <20% |
| MEAS. 0°. 45°, 90° AZIMUTHS | NO | YES |

| MiniGlobe A + 36.0 Diffuser 1 | | |
|---|---|---|
| | RESULT | E-STAR |
| FORWARD FLUX (<90°) | 58.7% | |
| BACKWARD FLUX (>90°) | 41.3% | |
| FLUX > 135° | 7.8% | >5% |
| MAX TO AVG. DIFF. 0° TO 135° | 12.0% | <20% |
| MIN TO AVG. DIFF. 0° TO 135° | 31.1% | <20% |
| MEAS. 0°. 45°, 90° AZIMUTHS | NO | YES |

FIG. 67
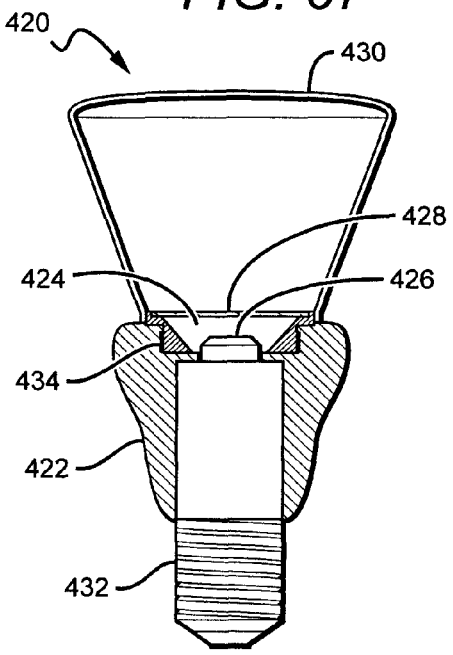
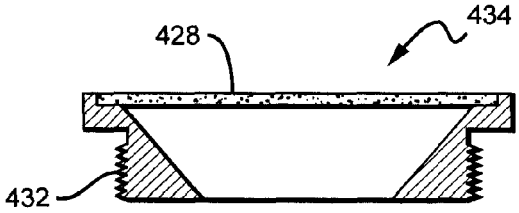
FIG. 68
FIG. 69
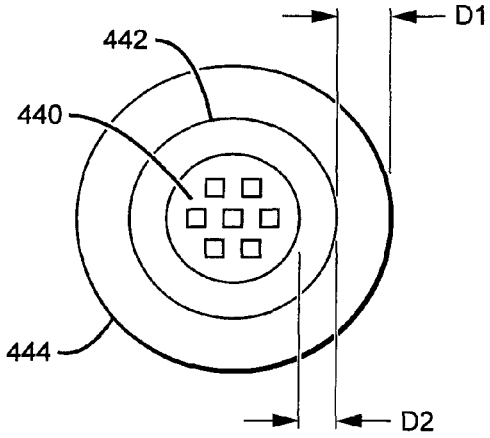
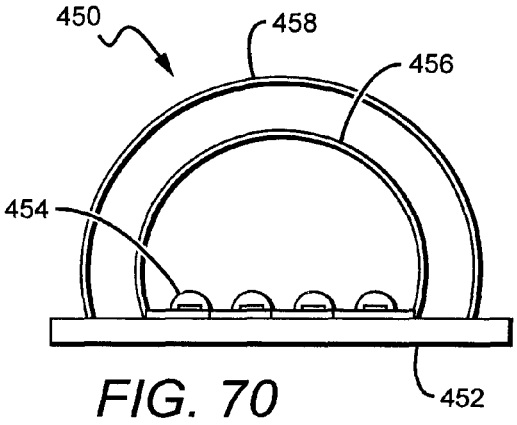
FIG. 70
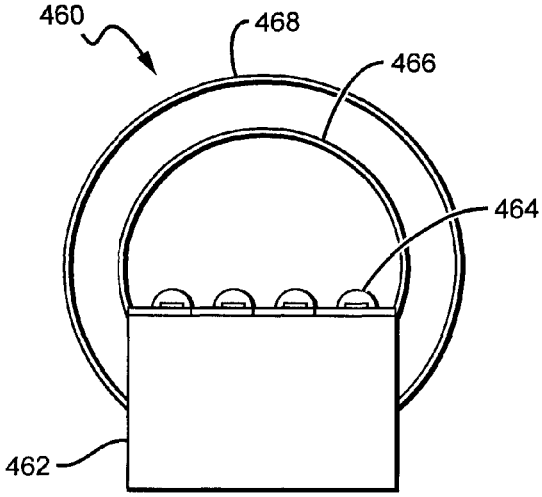
FIG. 71

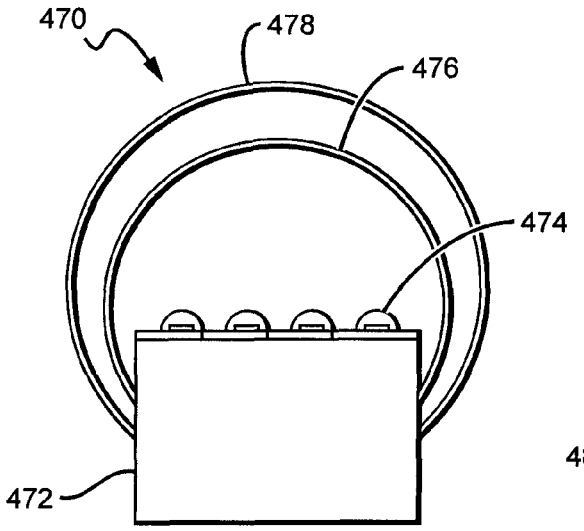
FIG. 72
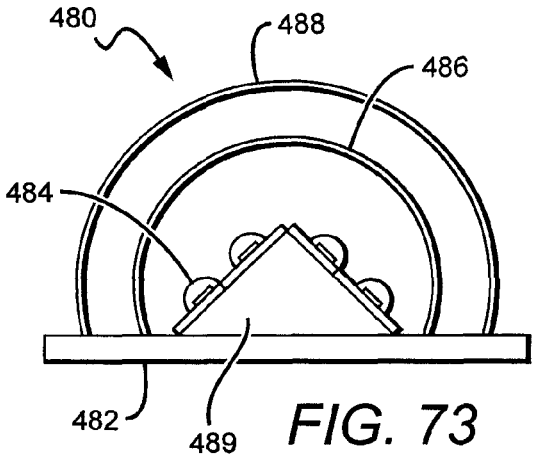
FIG. 73
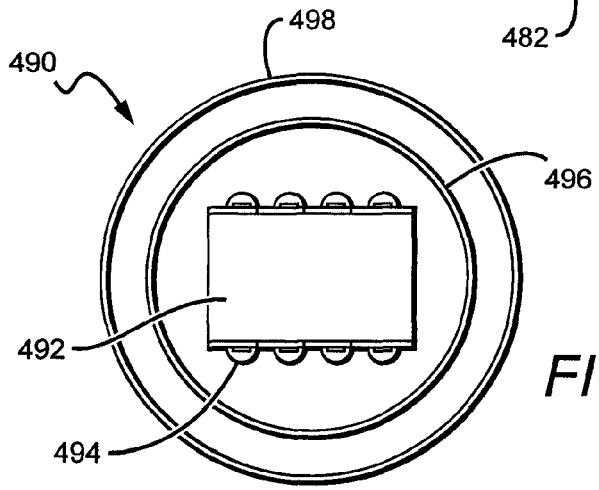
FIG. 74
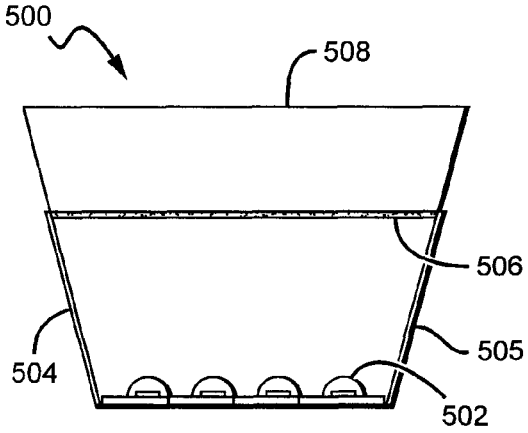
FIG. 75
FIG. 76
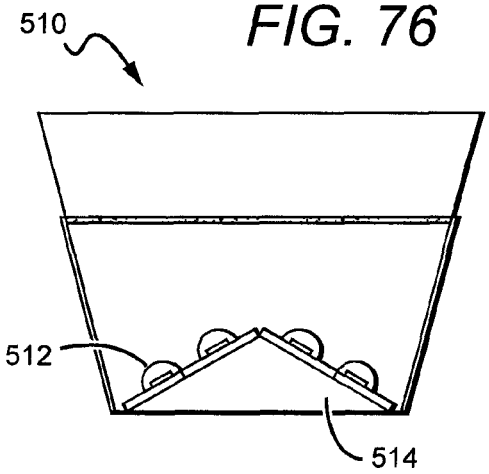

FIG. 77
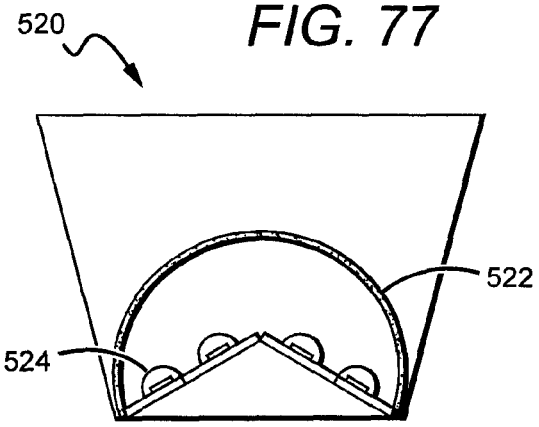
FIG. 78
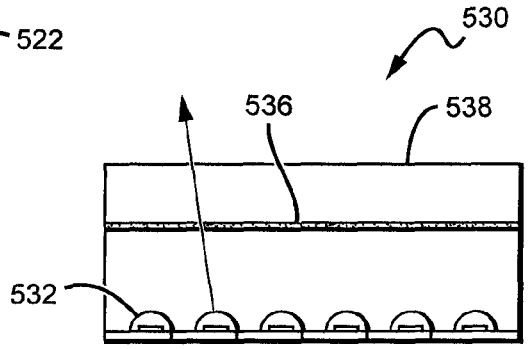
FIG. 79
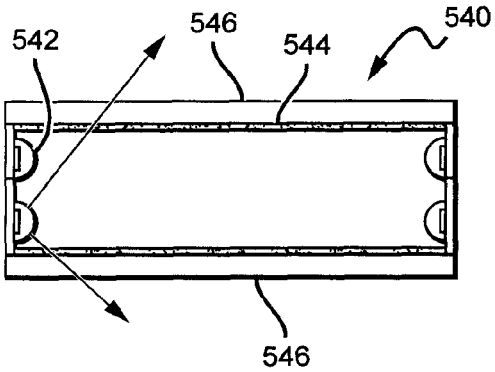
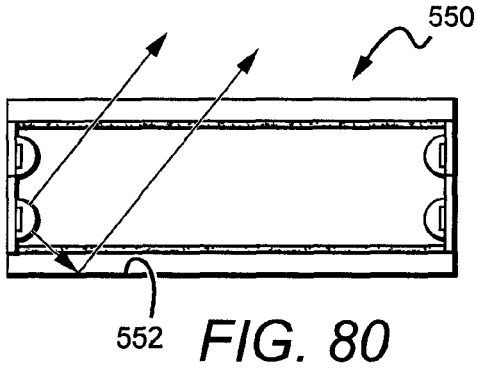
FIG. 80
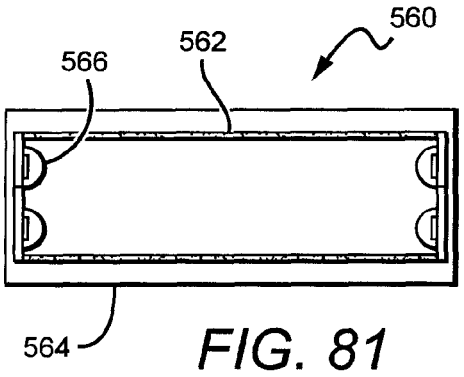
FIG. 81
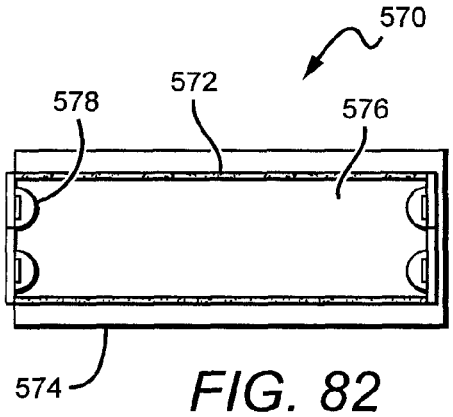
FIG. 82

FIG. 83
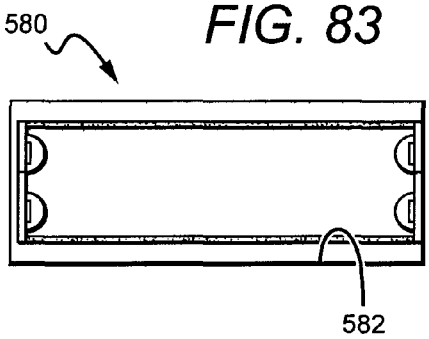
FIG. 84
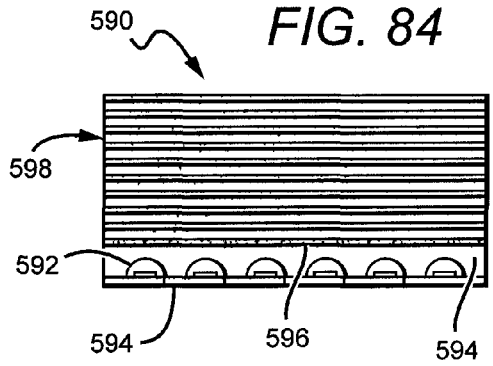
FIG. 85
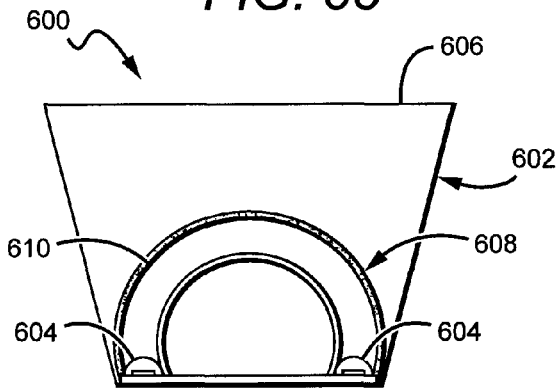
FIG. 86
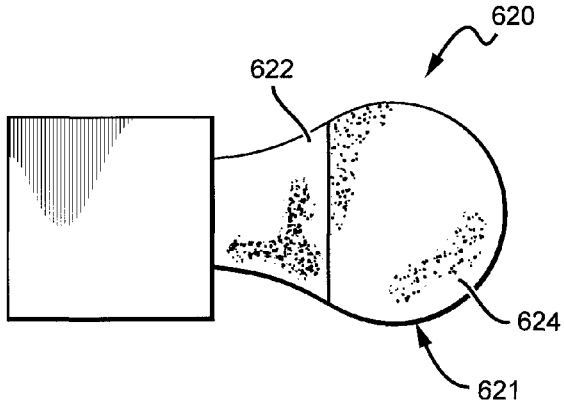
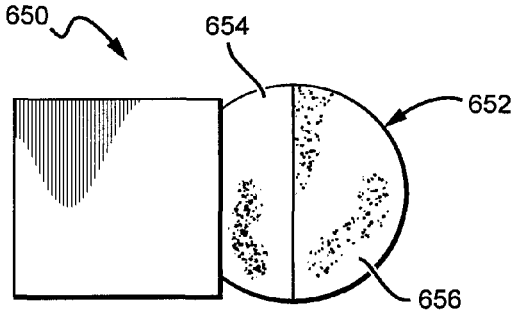
FIG. 88

LED LAMP OR BULB WITH REMOTE PHOSPHOR AND DIFFUSER CONFIGURATION WITH ENHANCED SCATTERING PROPERTIES

This application claims the benefit of U.S. Provisional Patent Application Ser No. 61/339,516, filed on Mar. 3, 2010, U.S. Provisional Patent Application Ser. No. 61/339,515, filed on Mar. 3, 2010, U.S. Provisional Patent Application Ser. No. 61/386,437, filed on Sep. 24, 2010, U.S. Provisional Application Ser. No. 61/424,665, filed on Dec. 19, 2010, U.S. Provisional Application Ser. No. 61/424,670, filed on Dec. 19, 2010, U.S. Provisional Patent Application Ser. No. 61/434,355, filed on Jan. 19, 2011, U.S. Provisional Patent Application Ser. No. 61/435,326, filed on Jan. 23, 2011, U.S. Provisional Patent Application Ser. No. 61/435,759, filed on Jan. 24, 2011. This application is also a continuation-in-part from, and claims the benefit of, U.S. patent application Ser. No. 12/848,825, filed on Aug. 2, 2010, now U.S. Pat. No. 8,562,161 U.S. patent application Ser. No. 12/889,719, filed on Sep. 24, 2010, and U.S. patent application Ser. No. 12/975,820, filed on Dec. 22, 2010.

This application was made with Government support under Department of Energy Contract No. DE-FC26-08NT01577. The Government has certain rights in this invention.

BACKGROUND OF THE INVENTION

1. Field of the Invention

This invention relates to solid state lamps and bulbs and in particular to efficient and reliable light emitting diode (LED) based lamps and bulbs capable of producing omnidirectional emission patterns.

2. Description of the Related Art

Incandescent or filament-based lamps or bulbs are commonly used as light sources for both residential and commercial facilities. However, such lamps are highly inefficient light sources, with as much as 95% of the input energy lost, primarily in the form of heat or infrared energy. One common alternative to incandescent lamps, so-called compact fluorescent lamps (CFLs), are more effective at converting electricity into light but require the use of toxic materials which, along with its various compounds, can cause both chronic and acute poisoning and can lead to environmental pollution. One solution for improving the efficiency of lamps or bulbs is to use solid state devices such as light emitting diodes (LED or LEDs), rather than metal filaments, to produce light.

Light emitting diodes generally comprise one or more active layers of semiconductor material sandwiched between oppositely doped layers. When a bias is applied across the doped layers, holes and electrons are injected into the active layer where they recombine to generate light. Light is emitted from the active layer and from various surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package 10 illustrated in FIG. 1, a single LED chip 12 is mounted on a reflective cup 13 by means of a solder bond or conductive epoxy. One or more wire bonds 11 connect the ohmic contacts of the LED chip 12 to leads 15A and/or 15B, which may be attached to or integral with the reflective cup 13. The reflective cup may be filled with an encapsulant material 16 which may contain a wavelength conversion material such as a phosphor. Light emitted by the LED at a first wavelength may be absorbed by the phosphor, which may responsively emit light at a second wavelength. The entire assembly is then encapsulated in a clear protective resin 14, which may be molded in the shape of a lens to collimate the light emitted from the LED chip 12. While the reflective cup 13 may direct light in an upward direction, optical losses may occur when the light is reflected (i.e. some light may be absorbed by the reflective cup due to the less than 100% reflectivity of practical reflector surfaces). In addition, heat retention may be an issue for a package such as the package 10 shown in FIG. 1*a*, since it may be difficult to extract heat through the leads 15A, 15B.

A conventional LED package 20 illustrated in FIG. 2 may be more suited for high power operations which may generate more heat. In the LED package 20, one or more LED chips 22 are mounted onto a carrier such as a printed circuit board (PCB) carrier, substrate or submount 23. A metal reflector 24 mounted on the submount 23 surrounds the LED chip(s) 22 and reflects light emitted by the LED chips 22 away from the package 20. The reflector 24 also provides mechanical protection to the LED chips 22. One or more wirebond connections 27 are made between ohmic contacts on the LED chips 22 and electrical traces 25A, 25B on the submount 23. The mounted LED chips 22 are then covered with an encapsulant 26, which may provide environmental and mechanical protection to the chips while also acting as a lens. The metal reflector 24 is typically attached to the carrier by means of a solder or epoxy bond.

LED chips, such as those found in the LED package 20 of FIG. 2 can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices".

LED chips which have a conversion material in close proximity or as a direct coating have been used in a variety of different packages, but experience some limitations based on the structure of the devices. When the phosphor material is on or in close proximity to the LED epitaxial layers (and in some instances comprises a conformal coat over the LED), the phosphor can be subjected directly to heat generated by the chip which can cause the temperature of the phosphor material to increase. Further, in such cases the phosphor can be subjected to very high concentrations or flux of incident light from the LED. Since the conversion process is in general not 100% efficient, excess heat is produced in the phosphor layer in proportion to the incident light flux. In compact phosphor layers close to the LED chip, this can lead to substantial temperature increases in the phosphor layer as large quantities of heat are generated in small areas. This temperature increase can be exacerbated when phosphor particles are embedded in low thermal conductivity material such as silicone which does not provide an effective dissipation path for the heat generated within the phosphor particles. Such elevated operating temperatures can cause degradation of the phosphor and surrounding materials over time, as well as a reduction in phosphor conversion efficiency and a shift in conversion color.

Lamps have also been developed utilizing solid state light sources, such as LEDs, in combination with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or changes its color by converting at least some of the light to a different wavelength through a phosphor or other conversion material. In some embodiments the separator spaces the light source a sufficient distance from the disperser such that heat from the light source will not transfer to the disperser when the light source is carrying elevated currents necessary for room illumination. Additional remote phosphor techniques are described in U.S. Pat. No. 7,614,759 to Negley et al., entitled "Lighting Device."

One potential disadvantage of lamps incorporating remote phosphors is that they can have undesirable visual or aesthetic characteristics. When the lamps are not generating light the lamp can have a surface color that is different from the typical white or clear appearance of the standard Edison bulb. In some instances the lamp can have a yellow or orange appearance, primarily resulting from the phosphor conversion material. This appearance can be considered undesirable for many applications where it can cause aesthetic issues with the surrounding architectural elements when the light is not illuminated. This can have a negative impact on the overall consumer acceptance of these types of lamps.

Further, compared to conformal or adjacent phosphor arrangements where heat generated in the phosphor layer during the conversion process may be conducted or dissipated via the nearby chip or substrate surfaces, remote phosphor arrangements can be subject to inadequate thermally conductive heat dissipation paths. Without an effective heat dissipation pathway, thermally isolated remote phosphors may suffer from elevated operating temperatures that in some instances can be even higher than the temperature in comparable conformal coated layers. This can offset some or all of the benefit achieved by placing the phosphor remotely with respect to the chip. Stated differently, remote phosphor placement relative to the LED chip can reduce or eliminate direct heating of the phosphor layer due to heat generated within the LED chip during operation, but the resulting phosphor temperature decrease may be offset in part or entirely due to heat generated in the phosphor layer itself during the light conversion process and lack of a suitable thermal path to dissipate this generated heat.

Another issue affecting the implementation and acceptance of lamps utilizing solid state light sources relates to the nature of the light emitted by the light source itself. In order to fabricate efficient lamps or bulbs based on LED light sources (and associated conversion layers), it is typically desirable to place the LED chips or packages in a co-planar arrangement. This facilitates manufacture and can reduce manufacturing costs by allowing the use of conventional production equipment and processes. However, co-planar arrangements of LED chips typically produce a forward directed light intensity profile (e.g., a Lambertian profile). Such beam profiles are generally not desired in applications where the solid-state lamp or bulb is intended to replace a conventional lamp such as a traditional incandescent bulb, which has a much more omni-directional beam pattern. While it is possible to mount the LED light sources or packages in a three-dimensional arrangement, such arrangements are generally difficult and expensive to fabricate.

SUMMARY OF THE INVENTION

The present invention provides lamps and bulbs generally comprising different combinations and arrangement of a light source, one or more wavelength conversion materials, regions or layers which are positioned separately or remotely with respect to the light source, and a separate diffusing layer. This arrangement allows for the fabrication of lamps and bulbs that are efficient, reliable and cost effective and can provide an essentially omnidirectional emission pattern, even with a light source comprised of a co-planar arrangement of LEDs. Additionally, this arrangement allows aesthetic masking or concealment of the appearance of the conversion regions or layers when the lamp is not illuminated. Various embodiments of the invention may be used to address many of the difficulties associated with utilizing efficient solid state light sources such as LEDs in the fabrication of lamps or bulbs suitable for direct replacement of traditional incandescent bulbs. Embodiments of the invention can be arranged to fit recognized standard size profiles such as those ascribed to commonly used lamps such as incandescent light bulbs, thereby facilitating direct replacement of such bulbs.

Embodiments of the invention can also comprise various arrangements having a conversion material positioned remote to the lamp light source, and diffusers can be provided over the conversion material and light source with the diffusers dispersing the light from the lamp's light source and/or conversion material into a desired pattern, such as near uniform color and/or intensity over a range of viewing angles.

The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle. The geometry and other aspects of the diffuser can be used in many different ways to modify the beam profile. For example, by extending the "bulb" portion of the diffuser element outside the profile of other lamp features, such as the heat sink portion such that the diffuser is visible from behind the lamp, additional light can be directed to angles of greater than 90° from the vertical axis of the lamp. The nature of the particles used to scatter the light and even the smoothness of the bulb and scattering film surfaces can also have a strong effect on the emitted profile for a given diffuser geometry.

By having a conversion material and diffuser remote to the light source, elevated electrical signals can be applied to the light source which can result in increased light output but can also cause the light source to operate at higher temperatures. The distance between the light source and conversion material(s) reduces the transfer of heat generated within the light source to the phosphor or conversion layer(s). This maintains high conversion efficiency and reliability while enabling a small chip count which leads to a lower manufacturing cost. Some embodiments can also comprise features that allow efficient conduction of conversion related heat away from the remote conversion material. The diffusers and conversion materials can have different shapes, and in some embodiments the geometry of the two can cooperate to provide a desired lamp emission pattern or uniformity.

One embodiment of a solid state lamp, according to the present invention comprises an LED based light source and a remote wavelength conversion material spaced from the LED light source. A diffuser is arranged remote to the remote wavelength conversion material wherein the diffuser comprises a geometry and light scattering properties to disperse the light from the LED light source and wavelength conversion material to a substantially omnidirection emission pattern.

Another embodiment of a solid state lamp according to the present invention comprises a forward emitting light emitting diode (LED) based light source, and a remote phosphor spaced from the LED light source. A diffuser is arranged remote to the remote phosphor. The diffuser is arranged with a scattering material, and is also arranged to provide for a substantially uniform lamp emission pattern of light from the LED light source and the remote phosphor.

A solid state lamp according to the present invention comprises an LED based light source, and a three dimensional remote phosphor spaced from the LED light source. A three dimensional diffuser is arranged remote to the remote phosphor, with the diffuser having a shape and varying scattering properties. Light that is emitted from the diffuser has reduced variation in spatial emission intensity profile over an angular range compared to the light emitted from the remote phosphor.

These and other aspects and advantages of the invention will become apparent from the following detailed description and the accompanying drawings which illustrate by way of example the features of the invention.

BRIEF DESCRIPTION OF THE DRAWINGS

FIG. 1 shows a sectional view of one embodiment of a prior art LED lamp;

FIG. 2 shows a sectional view of another embodiment of a prior art LED lamp;

FIG. 3 shows the size specifications for an A19 replacement bulb;

FIGS. 13 through 16 are graphs showing the emission characteristics of a lamp with the diffuser shown in FIG. 9 and flat remote phosphor disk shown schematically in FIG. 30;

FIGS. 17 through 20 are graphs showing the emission characteristics of a lamp with the diffuser shown in FIG. 10 and flat remote phosphor disk shown schematically in FIG. 30;

FIGS. 25 through 28 are graphs showing the emission characteristics of a lamp with the diffuser shown in FIG. 12 and flat remote phosphor disk shown schematically in FIG. 30;

FIG. 29 is a sectional view of another embodiment of a lamp according to the present invention having a diffuser dome;

FIG. 34 is an exploded view of the lamp shown in FIG. 32;

FIG. 35 is a sectional view of one embodiment of a three-dimensional phosphor carrier according to the present invention;

FIG. 36 is a sectional view of another embodiment of a three-dimensional phosphor carrier according to the present invention;

FIG. 37 is a sectional view of another embodiment of a three-dimensional phosphor carrier according to the present invention;

FIG. 38 is a sectional view of another embodiment of a three-dimensional phosphor carrier according to the present invention;

FIG. 42 is a perspective view of one embodiment of a lamp according to the present invention comprising a heat sink and light source;

FIG. 43 is a perspective view of the lamp in FIG. 42 with a dome shaped phosphor carrier;

FIG. 44 is a side view of one embodiment of a dome shaped diffuser according to the present invention;

FIG. 45 is a sectional view of the embodiment of dome shaped diffuser shown in FIG. 44 with dimensions;

FIGS. 50 through 53 are graphs showing the emission characteristics of a lamp with the diffuser shown in FIG. 10 and phosphor globe shown in FIG. 43;

FIGS. 54 through 57 are graphs showing the emission characteristics of a lamp with the diffuser shown in FIG. 11 and phosphor globe shown in FIG. 43;

FIGS. 58 through 61 are graphs showing the emission characteristics of a lamp with the diffuser shown in FIG. 12 and phosphor globe shown in FIG. 43;

FIG. 67 is a sectional view of another embodiment of a lamp according to the present invention;

FIG. 68 is a sectional view of one embodiment of a collar cavity according to the present invention;

FIG. 69 is a schematic showing the footprint of different feature of one embodiment of a lamp according to the present invention;

FIG. 70 is a sectional view of another embodiment of a lamp according to the present invention;

FIG. 71 is a sectional view of another embodiment of a lamp according to the present invention;

FIG. 72 is a sectional view of another embodiment of a lamp according to the present invention;

FIG. 73 is a sectional view of still another embodiment of a lamp according to the present invention;

FIG. 74 is a top view of another embodiment of a lamp according to the present invention;

FIG. 75 is a sectional view of flood light type embodiment of a lamp according to the present invention;

FIG. 76 is a sectional view of another embodiment of a flood light type lamp according to the present invention;

FIG. 77 is a sectional view of another embodiment of a flood light type lamp according to the present invention;

FIG. 78 is a sectional view of a two-dimensional panel embodiment of a lamp according to the present invention;

FIG. 79 is a sectional view of another two-dimensional panel embodiment of a lamp according to the present invention;

FIG. 80 is a sectional view of another two-dimensional panel embodiment of a lamp according to the present invention;

FIG. 81 is a sectional view of tube shaped embodiment of a lamp according to the present invention;

FIG. 82 is a sectional view of another tube shaped embodiment of a lamp according to the present invention;

FIG. 83 is a sectional view of another tube shaped embodiment of a lamp according to the present invention;

FIG. 84 is a sectional view of light emission panel embodiment of a lamp according to the present invention;

FIG. 85 is a sectional view of another flood light embodiment of a lamp according to the present invention;

FIG. 86 is a side view of still another embodiment of a lamp according to the present invention;

FIG. 88 is a side view of still another embodiment of a lamp according to the present invention.

DETAILED DESCRIPTION OF THE INVENTION

Figure 4:
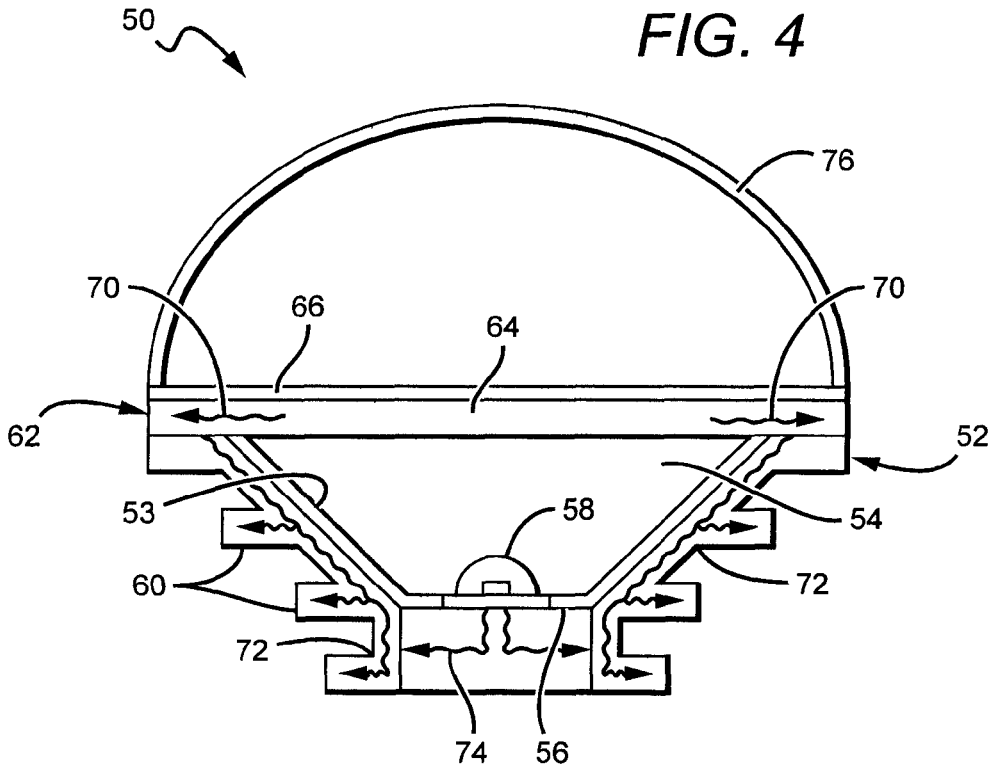
FIG. 4 is a sectional view of one embodiment of a lamp according to the present invention.

The present invention is directed to different embodiments of lamp or bulb structures that are efficient, reliable and cost effective, and that in some embodiments can provide an essentially omnidirectional emission pattern from directional emitting light sources, such as forward emitting light sources. The present invention is also directed to lamp structures using solid state emitters with remote conversion materials (or phosphors) and remote diffusing elements or diffuser. In some embodiments, the diffuser not only serves to mask the phosphor from the view by the lamp user, but can also disperse or redistribute the light from the remote phosphor and/or the lamp's light source into a desired emission pattern. In some embodiments the diffuser dome can be arranged to disperse forward directed emission pattern into a more omnidirectional pattern useful for general lighting applications. The diffuser can be used in embodiments having two-dimensional as well as three-dimensional shaped remote conversion materials, with a combination of features capable of transforming forward directed emission from an LED light source into a beam profile comparable with standard incandescent bulbs.

The present invention is described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

Some embodiments of lamps can have a dome-shaped (or frusto-spherical shaped) three dimensional conversion material over and spaced apart from the light source, and a dome-shaped diffuser spaced apart from and over the conversion material, such that the lamp exhibits a double-dome structure. The spaces between the various structures can comprise light mixing chambers that can promote not only dispersion of, but also color uniformity of the lamp emission. The space between the light source and conversion material, as well as the space between the conversion material, can serve as light mixing chambers. Other embodiments can comprise additional conversion materials or diffusers that can form additional mixing chambers. The order of the dome conversion materials and dome shaped diffusers can be different such that some embodiments can have a diffuser inside a conversion material, with the spaces between forming light mixing chambers. These are only a few of the many different conversion material and diffuser arrangement according to the present invention.

Some lamp embodiments according to the present invention can comprise a light source having a co-planar arrangement of one or more LED chips or packages, with the emitters being mounted on a flat or planar surface. In other embodiments, the LED chips can be non co-planar, such as being on a pedestal or other three-dimensional structure. Co-planar light sources can reduce the complexity of the emitter arrangement, making them both easier and cheaper to manufacture. Co-planar light sources, however, tend to emit primarily in the forward direction such as in a Lambertian emission pattern. In different embodiments it can be desirable to emit a light pattern mimicking that of conventional incandescent light bulbs that can provide nearly uniform emission intensity and color uniformity at different emission angles. Different embodiments of the present invention can comprise features that can transform the emission pattern from the non-uniform to substantially uniform within a range of viewing angles.

In some embodiments, a conversion layer or region that can comprise a phosphor carrier that can comprise a thermally conductive material that is at least partially transparent to light from the light source, and at least one phosphor material each of which absorbs light from the light source and emits a different wavelength of light. The diffuser can comprise a scattering film/particles and associated carrier such as a glass enclosure, and can serve to scatter or re-direct at least some of the light emitted by the light source and/or phosphor carrier to provide a desired beam profile. In some embodiments the lamps according to the present invention can emit a beam profile compatible with standard incandescent bulbs.

The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle. By masking the phosphor carrier and other internal lamp features the diffuser provides a desired overall lamp appearance when the lamp or bulb is not illuminated.

A heat sink structure can be included which can be in thermal contact with the light source and with the phosphor carrier in order to dissipate heat generated within the light source and phosphor layer into the surrounding ambient. Electronic circuits may also be included to provide electrical power to the light source and other capabilities such as dimming, etc., and the circuits may include a means by which to apply power to the lamp, such as an Edison socket, etc.

Different embodiments of the lamps can have many different shapes and sizes, with some embodiments having dimensions to fit into standard size envelopes, such as the A19 size envelope 30 as shown in FIG. 3. This makes the lamps particularly useful as replacements for conventional incandescent and fluorescent lamps or bulbs, with lamps according to the present invention experiencing the reduced energy consumption and long life provided from their solid state light sources. The lamps according to the present invention can also fit other types of standard size profiles including but not limited to A21 and A23.

In some embodiments the light sources can comprise solid state light sources, such as different types of LEDs, LED chips or LED packages. In some embodiments a single LED chip or package can be used, while in others multiple LED chips or packages can be used arranged in different types of arrays. By having the phosphor thermally isolated from LED chips and with good thermal dissipation, the LED chips can be driven by higher current levels without causing detrimental effects to the conversion efficiency of the phosphor and its long term reliability. This can allow for the flexibility to overdrive the LED chips to lower the number of LEDs needed to produce the desired luminous flux. This in turn can reduce the cost on complexity of the lamps. These LED packages can comprise LEDs encapsulated with a material that can withstand the elevated luminous flux or can comprise unencapsulated LEDs.

In some embodiments the light source can comprise one or more blue emitting LEDs and the phosphor layer in the phosphor carrier can comprise one or more materials that absorb a portion of the blue light and emit one or more different wavelengths of light such that the lamp emits a white light combination from the blue LED and the conversion material. The conversion material can absorb the blue LED light and emit different colors of light including but not limited to yellow and green. The light source can also comprise different LEDs and conversion materials emitting different colors of light so that the lamp emits light with the desired characteristics such as color temperature and color rendering.

Conventional lamps incorporating both red and blue LEDs chips can be subject to color instability with different operating temperatures and dimming. This can be due to the different behaviors of red and blue LEDs at different temperature and operating power (current/voltage), as well as different operating characteristics over time. This effect can be mitigated somewhat through the implementation of an active control system that can add cost and complexity to the overall lamp. Different embodiments according to the present invention can address this issue by having a light source with the same type of emitters in combination with a remote phosphor carrier that can comprise multiple layers of phosphors that remain relatively cool through the thermal dissipation arrangements disclosed herein. In some embodiments, the remote phosphor carrier can absorb light from the emitters and can re-emit different colors of light, while still experiencing the efficiency and reliability of reduced operating temperature for the phosphors.

The separation of the phosphor elements from the LEDs provides that added advantage of easier and more consistent color binning. This can be achieved in a number of ways. LEDs from various bins (e.g. blue LEDs from various bins) can be assembled together to achieve substantially wavelength uniform excitation sources that can be used in different lamps. These can then be combined with phosphor carriers having substantially the same conversion characteristics to provide lamps emitting light within the desired bin. In addition, numerous phosphor carriers can be manufactured and pre-binned according to their different conversion characteristics. Different phosphor carriers can be combined with light sources emitting different characteristics to provide a lamp emitting light within a target color bin.

Some lamps according to the present invention can also provide for improved emission efficiency by surrounding the light source by a reflective surface. This results in enhanced photon recycling by reflecting much of the light re-emitted from the conversion material back toward the light source. To further enhance efficiency and to provide the desired emission profile, the surfaces of the phosphor layer, carrier layer or diffuser can be smooth or scattering. In some embodiments, the internal surfaces of the carrier layer and diffuser can be optically smooth to promote total internal reflecting behavior that reduces the amount of light directed backward from the phosphor layer (either downconverted light or scattered light). This reduces the amount of backward emitted light that can be absorbed by the lamp's LED chips, associated substrate, or other non-ideal reflecting surfaces within the interior of the lamp.

The present invention is described herein with reference to certain embodiments, but it is understood that the invention can be embodied in many different forms and should not be construed as limited to the embodiments set forth herein. In particular, the present invention is described below in regards to certain lamps having one or multiple LEDs or LED chips or LED packages in different configurations, but it is understood that the present invention can be used for many other lamps having many different configurations. Examples of different lamps arranged in different ways according to the present invention are described below and in U.S. Provisional Patent application Ser. No. 61/435,759, to Le et al., entitled "Solid State Lamp", filed on Jan. 24, 2011, and incorporated herein by reference.

The embodiments below are described with reference to LED or LEDs, but it is understood that this is meant to encompass LED chips and LED packages. The components can have different shapes and sizes beyond those shown and different numbers of LEDs can be included. It is also understood that the embodiments described below are utilize co-planar light sources, but it is understood that non co-planar light sources can also be used. It is also understood that the lamp's LED light source may be comprised of one or multiple LEDs, and in embodiments with more than one LED, the LEDs may have different emission wavelengths. Similarly, some LEDs may have adjacent or contacting phosphor layers or regions, while others may have either adjacent phosphor layers of different composition or no phosphor layer at all.

The present invention is described herein with reference to conversion materials, phosphor layers and phosphor carriers and diffusers being remote to one another. Remote in this context refers being spaced apart from and/or to not being on or in direct thermal contact.

It is also understood that when an element such as a layer, region or substrate is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-sectional view illustrations that are schematic illustrations of embodiments of the invention. As such, the actual thickness of the layers can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

FIG. 4 shows one embodiment of a lamp 50 according to the present invention that comprises a heat sink structure 52 having an optical cavity 54 with a platform 56 for holding a light source 58. Although this embodiment and some embodiments below are described with reference to an optical cavity, it is understood that many other embodiments can be provided without optical cavities. These can include, but are not limited to, light sources being on a planar surface of the lamp structure or on a pedestal. The light source 58 can comprise many different emitters with the embodiment shown comprising an LED. Many different commercially available LED chips or LED packages can be used including but not limited to those commercially available from Cree, Inc. located in Durham, N.C. It is understood that lamp embodiments can be provided without an optical cavity, with the LEDs mounted in different ways in these other embodiments. By way of example, the light source can be mounted to a planar surface in the lamp or a pedestal can be provided for holding the LEDs.

The light source 58 can be mounted to the platform using many different known mounting methods and materials with light from the light source 58 emitting out the top opening of the cavity 54. In some embodiments light source 58 can be mounted directly to the platform 56, while in other embodiments the light source can be included on a submount or printed circuit board (PCB) that is then mounted to the platform 56. The platform 56 and the heat sink structure 52 can comprise electrically conductive paths for applying an electrical signal to the light source 58, with some of the conductive paths being conductive traces or wires. Portions of the platform 56 can also be made of a thermally conductive material and in some embodiments heat generated during operation can spread to the platform and then to the heat sink structure.

The heat sink structure 52 can at least partially comprise a thermally conductive material, and many different thermally conductive materials can be used including different metals such as copper or aluminum, or metal alloys. Copper can have a thermal conductivity of up to 400 W/m-k or more. In some embodiments the heat sink can comprise high purity aluminum that can have a thermal conductivity at room temperature of approximately 210 W/m-k. In other embodiments the heat sink structure can comprise die cast aluminum having a thermal conductivity of approximately 200 W/m-k. The heat sink structure 52 can also comprise other heat dissipation features such as heat fins 60 that increase the surface area of the heat sink to facilitate more efficient dissipation into the ambient. In some embodiments, the heat fins 60 can be made of material with higher thermal conductivity than the remainder of the heat sink. In the embodiment shown the fins 60 are shown in a generally horizontal orientation, but it is understood that in other embodiments the fins can have a vertical or angled orientation. In still other embodiments, the heat sink can comprise active cooling elements, such as fans, to lower the convective thermal resistance within the lamp. In some embodiments, heat dissipation from the phosphor carrier is achieved through a combination of convection thermal dissipation and conduction through the heat sink structure 52. Different heat dissipation arrangements and structures are described in U.S. Patent Application Ser. No. 61/339,516, to Tong et al., entitled "LED Lamp Incorporating Remote Phosphor with Heat Dissipation Features and Diffuser Element," also assigned to Cree, Inc., and is incorporated herein by reference.

Reflective layers 53 can also be included on the heat sink structure 52, such as on the surface of the optical cavity 54. In those embodiments not having an optical cavity the reflective layers can be included around the light source. In some embodiments the surfaces can be coated with a material having a reflectivity of approximately 75% or more to the lamp visible wavelengths of light emitted by the light source 58 and/or wavelength conversion material ("the lamp light"), while in other embodiments the material can have a reflectivity of approximately 85% or more to the lamp light. In still other embodiments the material can have a reflectivity to the lamp light of approximately 95% or more.

The heat sink structure 52 can also comprise features for connecting to a source of electricity such as to different electrical receptacles. In some embodiments the heat sink structure can comprise a feature of the type to fit in conventional electrical receptacles. For example, it can include a feature for mounting to a standard Edison socket, which can comprise a screw-threaded portion which can be screwed into an Edison socket. In other embodiments, it can include a standard plug and the electrical receptacle can be a standard outlet, or can comprise a GU24 base unit, or it can be a clip and the electrical receptacle can be a receptacle which receives and retains the clip (e.g., as used in many fluorescent lights). These are only a few of the options for heat sink structures and receptacles, and other arrangements can also be used that safely deliver electricity from the receptacle to the lamp 50. The lamps according to the present invention can comprise a power supply or power conversion unit that can comprise a driver to allow the bulb to run from an AC line voltage/current and to provide light source dimming capabilities. In some embodiments, the power supply can comprise an offline constant-current LED driver using a non-isolated quasi-resonant flyback topology. The LED driver can fit within the lamp and in some embodiments can comprise a less than 25 cubic centimeter volume, while in other embodiments it can comprise an approximately 20 cubic centimeter volume. In some embodiments the power supply can be non-dimmable but is low cost. It is understood that the power supply used can have different topology or geometry and can be dimmable as well.

A phosphor carrier 62 is included over the top opening of the cavity 54 and a dome shaped diffuser 76 is included over the phosphor carrier 62. In the embodiment shown phosphor carrier covers the entire opening and the cavity opening is shown as circular and the phosphor carrier 62 is a circular disk. It is understood that the cavity opening and the phosphor carrier can be many different shapes and sizes. It is also understood that the phosphor carrier 62 can cover less than the entire cavity opening. As further described below, the diffuser 76 is arranged to disperse the light from the phosphor carrier and/or LED into the desired lamp emission pattern and can comprise many different shapes and sizes depending on the light it receives from and the desired lamp emission pattern.

Embodiments of phosphor carriers according to the present invention can be characterized as comprising a conversion material and thermally conductive light transmitting material, but it is understood that phosphor carriers can also be provided that are not thermally conductive. The light transmitting material can be transparent to the light emitted from the light source 54 and the conversion material should be of the type that absorbs the wavelength of light from the light source and re-emits a different wavelength of light. In the embodiment shown, the thermally conductive light transmitting material comprises a carrier layer 64 and the conversion material comprises a phosphor layer 66 on the phosphor carrier. As further described below, different embodiments can comprise many different arrangements of the thermally conductive light transmitting material and the conversion material.

When light from the light source 58 is absorbed by the phosphor in the phosphor layer 66 it is re-emitted in isotropic directions with approximately 50% of the light emitting forward and 50% emitting backward into the cavity 54. In prior LEDs having conformal phosphor layers, a significant portion of the light emitted backwards can be directed back into the LED and its likelihood of escaping is limited by the extraction efficiency of the LED structure. For some LEDs the extraction efficiency can be approximately 70%, so a percentage of the light directed from the conversion material back into the LED can be lost. In the lamps according to the present invention having the remote phosphor configuration with LEDs on the platform 56 at the bottom of the cavity 54 a higher percentage of the backward phosphor light strikes a surface of the cavity instead of the LED. Coating these surfaces with a reflective layer 53 increases the percentage of light that reflects back into the phosphor layer 66 where it can emit from the lamp. These reflective layers 53 allow for the optical cavity to effectively recycle photons, and increase the emission efficiency of the lamp. It is understood that the reflective layer can comprise many different materials and structures including but not limited to reflective metals or multiple layer reflective structures such as distributed Bragg reflectors. Reflective layers can also be included around the LEDs in those embodiments not having an optical cavity.

The carrier layer 64 can be made of many different materials having a thermal conductivity of 0.5 W/m-k or more, such as quartz, silicon carbide (SiC) (thermal conductivity ~120 W/m-k), glass (thermal conductivity of 1.0-1.4 W/m-k) or sapphire (thermal conductivity of ~40 W/m-k). In other embodiments, the carrier layer 64 can have thermal conductivity greater than 1.0 W/m-k, while in other embodiments it can have thermal conductivity of greater than 5.0 W/m-k. In still other embodiments it can have a thermal conductivity of greater that 10 W/m-k. In some embodiments the carrier layer can have thermal conductivity ranging from 1.4 to 10 W/m-k. The phosphor carrier can also have different thicknesses depending on the material being used, with a suitable range of thicknesses being 0.1 mm to 10 mm or more. It is understood that other thicknesses can also be used depending on the characteristics of the material for the carrier layer. The material should be thick enough to provide sufficient lateral heat spreading for the particular operating conditions. Generally, the higher the thermal conductivity of the material, the thinner the material can be while still providing the necessary thermal dissipation. Different factors can impact which carrier layer material is used including but not limited to cost and transparency to the light source light. Some materials may also be more suitable for larger diameters, such as glass or quartz. These can provide reduced manufacturing costs by formation of the phosphor layer on the larger diameter carrier layers and then singulation into the smaller carrier layers.

Many different phosphors can be used in the phosphor layer 66 with the present invention being particularly adapted to lamps emitting white light. As described above, in some embodiments the light source 58 can be LED based and can emit light in the blue wavelength spectrum. The phosphor layer can absorb some of the blue light and re-emit yellow. This allows the lamp to emit a white light combination of blue and yellow light. In some embodiments, the blue LED light can be converted by a yellow conversion material using a commercially available YAG:Ce phosphor, although a full range of broad yellow spectral emission is possible using conversion particles made of phosphors based on the $(Gd,Y)_3(Al,Ga)_5O_{12}$:Ce system, such as the $Y_3Al_5O_{12}$:Ce (YAG). Other yellow phosphors that can be used for creating white light when used with a blue emitting LED based emitter include but not limited to:

$Tb_{3-x}RE_xO_{12}$:Ce(TAG); RE=Y,Gd,La,Lu; or $Sr_{2-x-y}Ba_xCa_ySiO_4$:Eu.

The phosphor layer can also be arranged with more than one phosphor either mixed in with the phosphor layer 66 or as a second phosphor layer on the carrier layer 64. In some embodiments, each of the two phosphors can absorb the LED light and can re-emit different colors of light. In these embodiments, the colors from the two phosphor layers can be combined for higher CRI white of different white hue (warm white). This can include light from yellow phosphors above that can be combined with light from red phosphors. Different red phosphors can be used including:

$Sr_xCa_{1-x}S$:Eu,Y; Y=halide;

$CaSiAlN_3$:Eu; or $Sr_{2-y}Ca_ySiO_4$:Eu

Other phosphors can be used to create color emission by converting substantially all light to a particular color. For example, the following phosphors can be used to generate green light:

$SrGa_2S_4$:Eu;

$Sr_{2-y}Ba_ySiO_4$:Eu; or $SrSi_2O_2N_2$:Eu.

The following lists some additional suitable phosphors used as conversion particles phosphor layer 66, although others can be used. Each exhibits excitation in the blue and/or UV emission spectrum, provides a desirable peak emission, has efficient light conversion, and has acceptable Stokes shift:

Yellow/Green $(Sr,Ca,Ba)(Al,Ga)_2S_4:Eu^{2+}$ $Ba_2(Mg,Zn)Si_2O_7:Eu^{2+}$ $Gd_{0.46}Sr_{0.31}Al_{1.23}O_xF_{1.38}:Eu^{2+}{}_{0.06}$ $(Ba_{1-x-y}Sr_xCa_y)SiO_4:Eu$ $Ba_2SiO_4:Eu^{2+}$ Red $Lu_2O_3:Eu^{3+}$ $(Sr_{2-x}La_x)(Ce_{1-x}Eu_x)O_4$ $Sr_2Ce_{1-x}Eu_xO_4$ $Sr_{2-x}Eu_xCeO_4$ $SrTiO_3:Pr^{3+},Ga^{3+}$ $CaAlSiN_3:Eu^{2+}$ $Sr_2Si_5N_8:Eu^{2+}$ Different sized phosphor particles can be used including but not limited to particles in the range of 10 nanometers (nm) to 30 micrometers (μm), or larger. Smaller particle sizes typically scatter and mix colors better than larger sized particles to provide a more uniform light. Larger particles are typically more efficient at converting light compared to smaller particles, but emit a less uniform light. In some embodiments, the phosphor can be provided in the phosphor layer 66 in a binder, and the phosphor can also have different concentrations or loading of phosphor materials in the binder. A typical concentration being in a range of 30-70% by weight. In one embodiment, the phosphor concentration is approximately 65% by weight, and is preferably uniformly dispersed throughout the remote phosphor. The phosphor layer 66 can also have different regions with different conversion materials and different concentrations of conversion material.

Different materials can be used for the binder, with materials preferably being robust after curing and substantially transparent in the visible wavelength spectrum. Suitable materials include silicones, epoxies, glass, inorganic glass, dielectrics, BCB, polymides, polymers and hybrids thereof, with the preferred material being silicone because of its high transparency and reliability in high power LEDs. Suitable phenyl- and methyl-based silicones are commercially available from Dow® Chemical. The binder can be cured using many different curing methods depending on different factors such as the type of binder used. Different curing methods include but are not limited to heat, ultraviolet (UV), infrared (IR) or air curing.

Phosphor layer 66 can be applied using different processes including but not limited to spin coating, sputtering, printing, powder coating, electrophoretic deposition (EPD), electrostatic deposition, among others. As mentioned above, the phosphor layer 66 can be applied along with a binder material, but it is understood that a binder is not required. In still other embodiments, the phosphor layer 66 can be separately fabricated and then mounted to the carrier layer 64.

In one embodiment, a phosphor-binder mixture can be sprayed or dispersed over the carrier layer 64 with the binder then being cured to form the phosphor layer 66. In some of these embodiments the phosphor-binder mixture can be sprayed, poured or dispersed onto or over the a heated carrier layer 64 so that when the phosphor binder mixture contacts the carrier layer 64, heat from the carrier layer spreads into and cures the binder. These processes can also include a solvent in the phosphor-binder mixture that can liquefy and lower the viscosity of the mixture making it more compatible with spraying. Many different solvents can be used including but not limited to toluene, benzene, zylene, or OS-20 commercially available from Dow Corning®, and different concentration of the solvent can be used. When the solvent-phosphor-binder mixture is sprayed or dispersed on the heated carrier layer 64 the heat from the carrier layer 64 evaporates the solvent, with the temperature of the carrier layer impacting how quickly the solvent is evaporated. The heat from the carrier layer 64 can also cure the binder in the mixture leaving a fixed phosphor layer on the carrier layer. The carrier layer 64 can be heated to many different temperatures depending on the materials being used and the desired solvent evaporation and binder curing speed. A suitable range of temperature is 90 to 150° C., but it is understood that other temperatures can also be used. Various deposition methods and systems are described in U.S. Patent Application Publication No. 2010/0155763, to Donofrio et al., entitled "Systems and Methods for Application of Optical Materials to Optical Elements," and also assigned to Cree, Inc.

The phosphor layer 66 can have many different thicknesses depending at least partially on the concentration of phosphor material and the desired amount of light to be converted by the phosphor layer 66. Phosphor layers according to the present invention can be applied with concentration levels (phosphor loading) above 30%. Other embodiments can have concentration levels above 50%, while in still others the concentration level can be above 60%. In some embodiments the phosphor layer can have thicknesses in the range of 10-100 microns, while in other embodiments it can have thicknesses in the range of 40-50 microns.

The methods described above can be used to apply multiple layers of the same of different phosphor materials and different phosphor materials can be applied in different areas of the carrier layer using known masking processes. The methods described above provide some thickness control for the phosphor layer 66, but for even greater thickness control the phosphor layer can be ground using known methods to reduce the thickness of the phosphor layer 66 or to even out the thickness over the entire layer. This grinding feature provides the added advantage of being able to produce lamps emitting within a single bin on the CIE chromaticity graph. Binning is generally known in the art and is intended to ensure that the LEDs or lamps provided to the end customer emit light within an acceptable color range. The LEDs or lamps can be tested and sorted by color or brightness into different bins, generally referred to in the art as binning. Each bin typically contains LEDs or lamps from one color and brightness group and is typically identified by a bin code. White emitting LEDs or lamps can be sorted by chromaticity (color) and luminous flux (brightness). The thickness control of the phosphor layer provides greater control in producing lamps that emit light within a target bin by controlling the amount of light source light converted by the phosphor layer. Multiple phosphor carriers 62 with the same thickness of phosphor layer 66 can be provided. By using a light source 58 with substantially the same emission characteristics, lamps can be manufactured having nearly the same emission characteristics that in some instances can fall within a single bin. In some embodiments, the lamp emissions fall within a standard deviation from a point on a CIE diagram, and in some embodiments the standard deviation comprises less than a 10-step McAdams ellipse. In some embodiments the emission of the lamps falls within a 4-step McAdams ellipse centered at CIExy(0.313, 0.323).

The phosphor carrier 62 can be mounted and bonded over the opening in the cavity 54 using different known methods or materials such as thermally conductive bonding materials or a thermal grease. Conventional thermally conductive grease can contain ceramic materials such as beryllium oxide and aluminum nitride or metal particles such colloidal silver. In other embodiments the phosphor carrier can be mounted over the opening using thermal conductive devices such as clamping mechanisms, screws, or thermal adhesive hold phosphor carrier 62 tightly to the heat sink structure to maximize thermal conductivity. In one embodiment a thermal grease layer is used having a thickness of approximately 100 μm and thermal conductivity of k=0.2 W/m-k. This arrangement provides an efficient thermally conductive path for dissipating heat from the phosphor layer 66. As mentioned above, different lamp embodiments can be provided without cavity and the phosphor carrier can be mounted in many different ways beyond over an opening to the cavity.

During operation of the lamp 50 phosphor conversion heating is concentrated in the phosphor layer 66, such as in the center of the phosphor layer 66 where the majority of LED light strikes and passes through the phosphor carrier 62. The thermally conductive properties of the carrier layer 64 spreads this heat laterally toward the edges of the phosphor carrier 62 as shown by first heat flow 70. There the heat passes through the thermal grease layer and into the heat sink structure 52 as shown by second heat flow 72 where it can efficiently dissipate into the ambient.

As discussed above, in the lamp 50 the platform 56 and the heat sink structure 52 can be thermally connected or coupled. This coupled arrangement results in the phosphor carrier 62 and that light source 58 at least partially sharing a thermally conductive path for dissipating heat. Heat passing through the platform 56 from the light source 58 as shown by third heat flow 74 can also spread to the heat sink structure 52. Heat from the phosphor carrier 62 flowing into the heat sink structure 52 can also flow into the platform 56. As further described below, in other embodiments, the phosphor carrier 62 and the light source 54 can have separate thermally conductive paths for dissipating heat, with these separate paths being referred to as "decoupled".

It is understood that the phosphor carriers can be arranged in many different ways beyond the embodiment shown in FIG. 4. The phosphor layer can be on any surface of the carrier layer or can be mixed in with the carrier layer. The phosphor carriers can also comprise scattering layers that can be included on or mixed in with the phosphor layer or carrier layer. It is also understood that the phosphor and scattering layers can cover less than a surface of the carrier layer and in some embodiments the conversion layer and scattering layer can have different concentrations in different areas. It is also understood that the phosphor carrier can have different roughened or shaped surfaces to enhance emission through the phosphor carrier.

As mentioned above, the diffuser is arranged to disperse light from the phosphor carrier and LED into the desired lamp emission pattern, and can have many different shapes and sizes. In some embodiments, the diffuser also can be arranged over the phosphor carrier to mask the phosphor carrier when the lamp is not emitting. The diffuser can have materials to give a substantially white appearance to give the bulb a white appearance when the lamp is not emitting.

There are at least four attributes or characteristics of the diffuser that can be used to control the output beam characteristics for the lamp 50. The first is diffuser geometry independent of the phosphor layer geometry. The second is the diffuser geometry relative to the phosphor layer geometry. The third is diffuser scattering properties including the nature of the scattering layer and smoothness/roughness of the diffuser surfaces. The fourth is the diffuser distribution across the surface such as intentional non-uniformity of the scattering. These attributes allow for control of, for example, the ratio of axially emitted light relative to "sideways" emitted light (~90°), and also relative to "high angle" (>~130°). These attributes can also apply differently depending on the geometry of and pattern of light emitted by the phosphor carrier and the light source.

For two-dimensional phosphor carriers and/or light sources such as those shown in FIG. 4, the light emitted is generally forward directed (e.g. Lambertian). For these embodiments, the attributes listed above can provide for the dispersion of the forward directed emission pattern into broad beam intensity profiles. Variations in the second and fourth attributes that can be particularly applicable to achieving broad beam omnidirectional emission from forward directed emission profile.

For three-dimensional phosphor carriers (described in more detail below) and three dimensional light sources, the light emitted can already have significant emission intensity at greater than 90° provided that the emission is not blocked by other lamp surfaces, such as the heat sink. As a result, the diffuser attributes listed above can be utilized to provide further adjustment or fine-tuning to the beam profile from the phosphor carrier and light source so that it more closely matches the desired output beam intensity, color uniformity, color point, etc. In some embodiments, the beam profile can be adjusted to substantially match the output from conventional incandescent bulbs.

Figure 5:
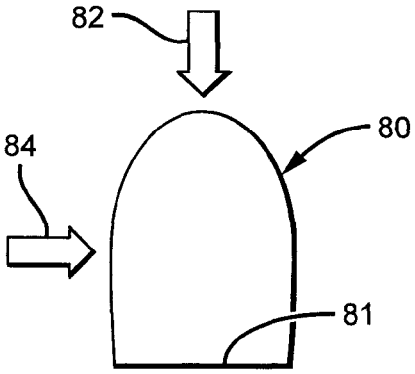
FIG. 5 is a side view of one embodiment of a lamp according to the present invention.

As for the first attribute above regarding diffuser geometry independent of phosphor geometry, in those embodiments where light is emitted uniformly from the diffuser surface, the amount of light directed "forward" (axially or ~0°) relative to sideways (~90°), and relative to "high angle" (>~130°), can depend greatly on the cross sectional area of the diffuser when viewed from that angle. FIG. 5 shows one embodiment of a tall narrow diffuser 80 according to the present invention, which has a small two dimensional phosphor carrier 81. It is characterized by having a circular area when viewed axially along first viewing angle 82 and a larger area when viewed from the side along second viewing angle 84. Correspondingly, such a diffuser would have low axial light emission relative to "sideways" emission. If a heat sink or other light blocking feature is present at the base of the diffuser, increasing the height of the diffuser can increase the amount of backward or high angle emission.

Figure 6:
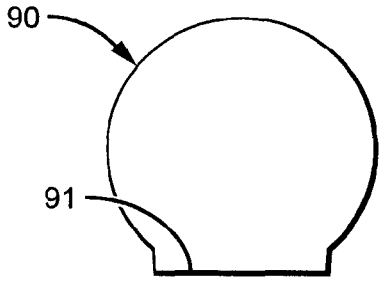
FIG. 6 is a side view of another embodiment of a lamp according to the present invention.

FIG. 6 shows another embodiment of a diffuser 90 according to the present invention that is particularly applicable to uniform omnidirectional emission depending on the emission pattern of the co-planar light source and or phosphor carrier 91. The diffuser 90 has a nearly uniform spherical geometry, which provides a nearly constant cross-sectional area when viewed form all angles. This promotes uniform or nearly omni-directional emission intensity.

Figure 7:
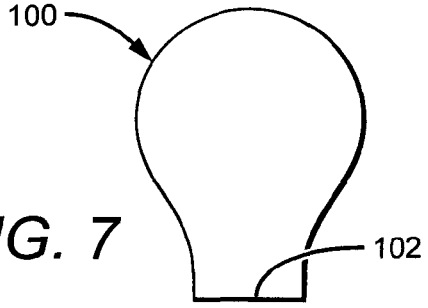
FIG. 7 is a side view of still another embodiment of a lamp according to the present invention.

As for the second attribute, the diffuser geometry relative to the phosphor carrier geometry, FIG. 7 shows another embodiment of a diffuser 100 that is arranged that is particularly applicable to two-dimensional phosphor carriers and co-planar LED light sources that typically provide a forward directed or Lambertian emission pattern. The diffuser 100 is oblong and has a narrow neck 102. By placing the light source and/or phosphor carrier at the base of the diffuser 100, light that would otherwise be directed to a forward angle from the source would be "intercepted" and directed to a higher angle or sideways (~90°) due to the scattering nature of the diffuser surface. This effect can also occur with three-dimensional light sources and phosphor carriers, but can have less of an effect. In some embodiments of these three-dimensional embodiments the diffuser may not need the neck feature, but can take on more of globe shape.

Figure 8:
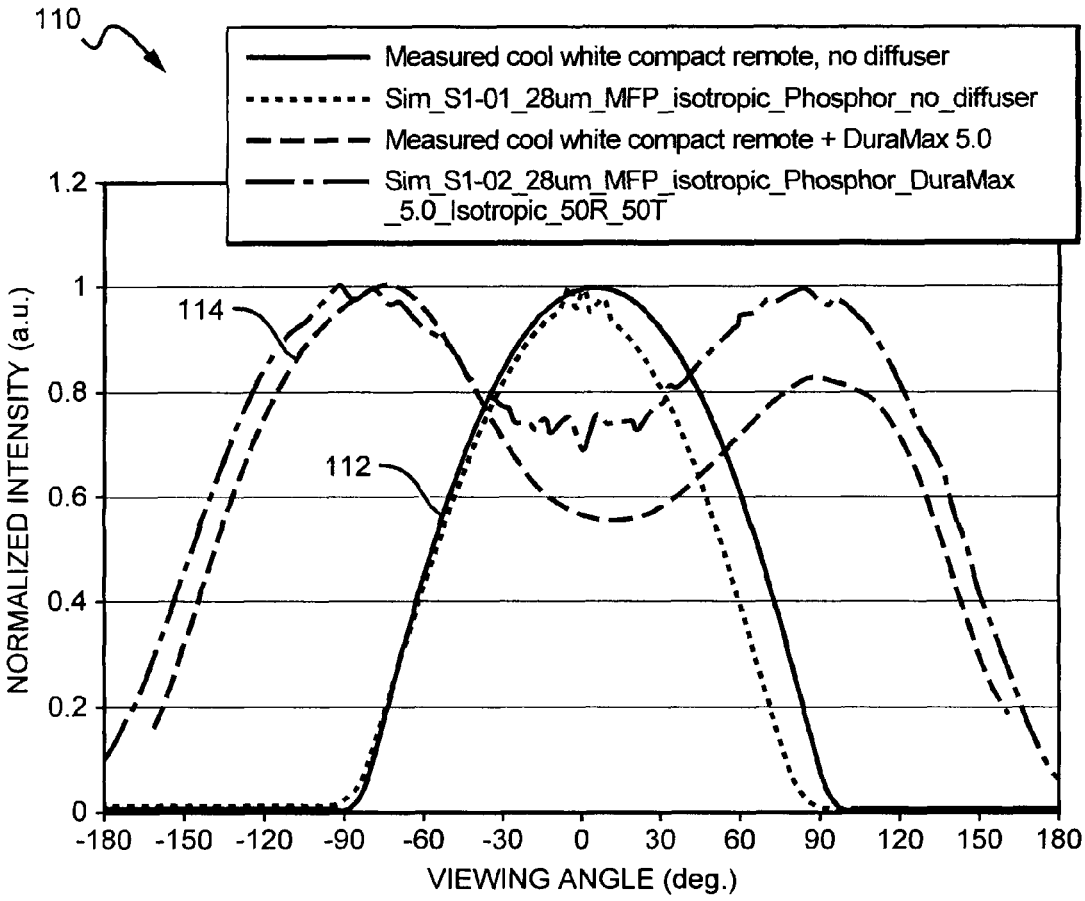
FIG. 8 is a graph showing the emission characteristics of one embodiment of a lamp according to the present invention.

FIG. 8 is a graph 110 showing one embodiment of the forward directed or Lambertian emission pattern 112 from the two dimensional phosphor carrier and co-planar LED light sources. Emission pattern 114 shows the lamp emission pattern after the emission pattern represented by line 112 passes through the diffuser as shown in FIG. 7. The pattern 114 shows reduced emission intensity axially (~0°), but significantly higher emission sideways (~90°). This reflects a more uniform emission pattern compared to the forward directed emission pattern 112.

As for the third attribute listed above, diffuser scattering properties, different embodiments of the diffuser can comprise a carrier made of different materials such as glass or plastics, and one or more scattering films, layers or regions. The scattering layer can be deposited using the methods described above with reference to deposition of the phosphor layer and can comprise a dense packing of particles. The scattering particles can also be included in a binder material that can be the same as those described above in reference to the binder used with the phosphor layer. The scattering particle layer can have different concentrations of scattering particles depending on the application and materials used. A suitable range for scattering particle concentration is from 0.01% to 0.2%, but it is understood that the concentration can be higher or lower. In some embodiments the concentration can be as low as 0.001%. It is also understood that the scattering particle layer can have different concentrations of scattering particles in different regions. For some scattering particles there can be an increase in loss due to absorption for higher concentrations. Thus, the concentrations of the scattering particles can be chosen in order to maintain an acceptable loss figure, while at the same time dispersing the light to provide the desired emission pattern.

The scattering particles can comprise many different materials including but not limited to:

silica;
kaolin;
zinc oxide (ZnO);
yttrium oxide ($Y_2O_3$);
titanium dioxide ($TiO_2$);
barium sulfate ($BaSO_4$);
alumina ($Al_2O_3$);
fused silica ($SiO_2$);
fumed silica ($SiO_2$);
aluminum nitride;
glass beads;
zirconium dioxide ($ZrO_2$);
silicon carbide (SiC);
tantalum oxide ($TaO_5$);
silicon nitride ($Si_3N_4$);
niobium oxide ($Nb_2O_5$);
boron nitride (BN); or
phosphor particles (e.g., YAG:Ce, BOSE)

More than one scattering material in various combinations of materials or combinations of different forms of the same material may be used to achieve a particular scattering effect.

The scattering layer can be located on the inside surface of the diffuser, the outside surface, or can be mixed in with the carrier. The surfaces of the carrier of the scattering layer may be optically smooth or rough. The scattering layer may be composed of a film or particles such as silica or kaolin particles adhered to the surface of the carrier with air between the particles. The scattering layer can also comprise particles in a binder matrix layer such as a film of silica, aluminum, etc. particles in silicon. The layer can be spray coated onto the interior or exterior surface of the carrier or the carrier itself may contain scattering particles. One example of a scattering film which can be molded into the shape of the diffuser is a file commercially available from FusionOptix, Inc.

In general, the scattering material or particles can be characterized by the degree to which light incident on the particles is re-directed from its original course. In the case of individual particles, a larger particle will tend to Mie scatter, leading to a relatively small change in the direction of the light. Smaller particles tend to Reyleigh scatter, leading to a large change in the direction and essentially uniform or isotropic distribution of the light after interaction with the particle. Films composed of the particles can behave in a similar manner. A wide variety of surface features and/or scattering particles can be used, the effectiveness of which is determined by the absorption (lower is better) and index of refraction differences with the surrounding matrix/ambient (larger differences produce more effective scattering).

The smoothness of the diffuser surfaces can be used to affect the amount of light which is directed back towards the light source of phosphor carrier due to the total internal reflection (TIR) effect. A smooth interior surface can lead to TIR and re-direct light which would otherwise be directed towards the source. In contrast, a roughened internal surface does not show this effect. Light which is redirected back towards the source of other internal lamp surfaces may be absorbed, leading to reduced lamp efficiency. Light scattered back towards the phosphor layer can lead to increased amounts of down-conversion and thus a shift in color temperature or color point of the lamp due to the diffuser. However, high degrees of backscattering can also improve uniformity by creating a "lightbox" effect where light is scattered internally in the diffuser leading to a more uniform distribution across the diffuser surface and a more uniform color point and intensity distribution of the lamp emitted beam profile.

For the fourth attribute, diffuser scattering distribution across the surface, the uniformity of the scattering properties across the diffuser surface can be used to control the amount of light emitted from the surface in specific regions and therefore the resulting beam profile. This can be particularly useful when combined with other attributes, such as attribute number two as shown in FIG. 7 having the neck feature in the disperser. By utilizing an oblong diffuser having a narrow neck region, and a rough highly scattering (Rayleigh or isotropic) internal rough surface film in a lamp exhibiting the emission of a two dimensional phosphor carrier and co-planar LED light source, significant portions of light can be directed sideways as shown in FIG. 8. The effect can be magnified by increasing the amount of light that is transmitted through the scattering film in the neck region of the diffuser. If a significant portion of the light emitted by the phosphor carrier and light source interacts with the scattering layer, light will bounce around within the body of the diffuser, which can enhance uniform emission. By creating regions where the scattering film is more transparent, such as by making the scattering film thinner or smoother in such regions, it possible to increase the relative intensity leaving that surface. In the embodiment shown in FIG. 7, the amount of light leaving the neck region into a sideways beam direction can be increased by having a thinner or smoother scattering layer in that region.

Figure 9:
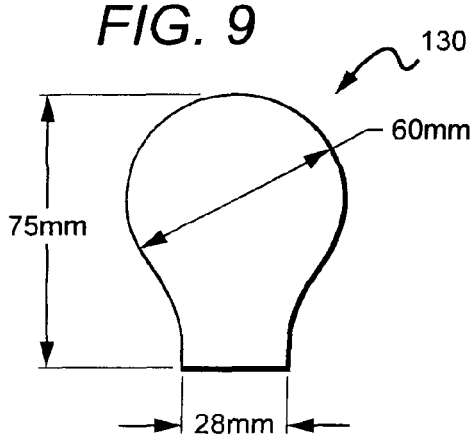
FIG. 9 is a side view of a diffuser according to the present invention.
Figure 10:
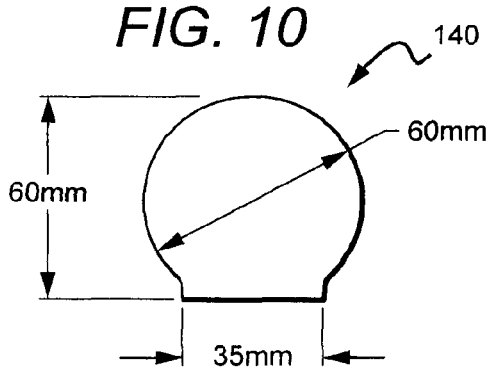
FIG. 10 is a side view of another diffuser according to the present invention.
Figure 11:
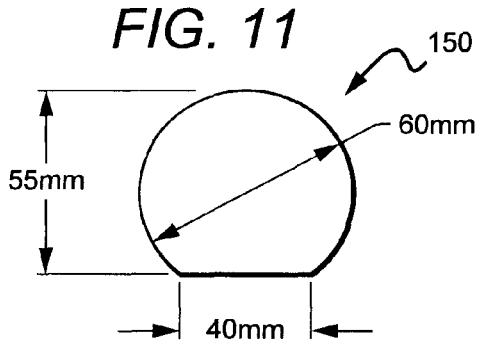
FIG. 11 is a side view of another embodiment diffuser according to the present invention.
Figure 12:
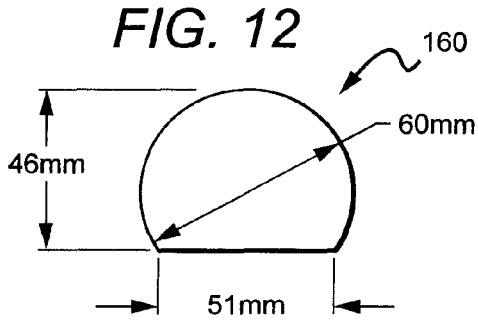
FIG. 12 is a side view of still another diffuser according to the present invention.

These are only some of the ways that these attributes can be combined in different ways to provide the desired emission pattern. The combination can result in many different shapes that can provide many different lamp emission patterns beyond omnidirectional. FIGS. 9-12 show some additional diffuser shapes and sizes that can be used with a two-dimensional carrier phosphor (and three-dimensional phosphors as described below) in lamps according to the present invention. FIG. 9 shows a diffuser 130 similar to the embodiment shown in FIG. 7 and being generally globe shaped with a shorter narrow neck portion. The dimensions for one embodiment of the diffuser 130 are shown in FIG. 9, with the dimensions for the diffusers in FIGS. 10-12 also shown. FIG. 10 shows another embodiment of a diffuser 140 having a shorter neck and retaining much of its globe shape. FIG. 11 shows another embodiment of diffuser 150 having no neck region, but retaining much of its globe shape. FIG. 12 shows still another embodiment of a diffuser 160 where the diffuser comprises more of a hemispheric shape. These shapes provide emitters with different patterns and different levels of efficiency as described below and shown in the attached figures. These are countless other shapes that the diffuser can take and with some additional shapes being mushroom, bullet, cylindrical, egg shapes, oval, etc. In other embodiments the diffuser can take on a shape where it is wider at the base and narrows at least through one portion moving away from the base. These embodiments can take on the shape of being wider at the bottom than the top.

Figure 13:
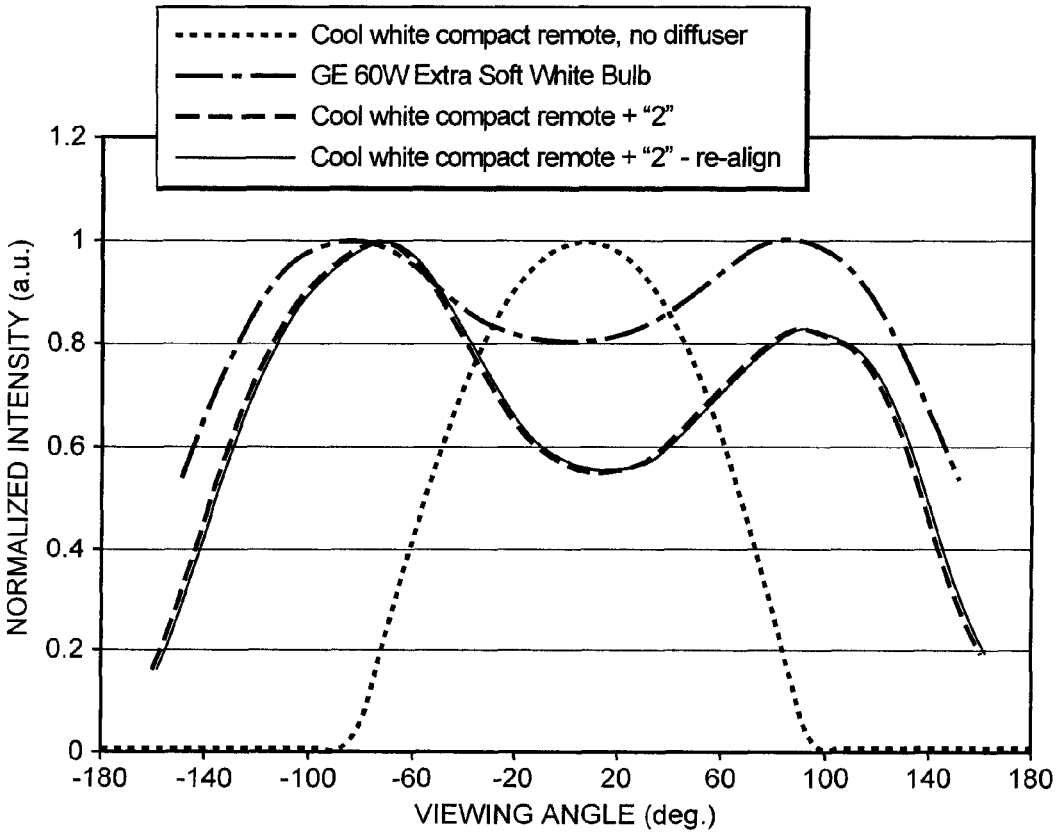
Figure 15:
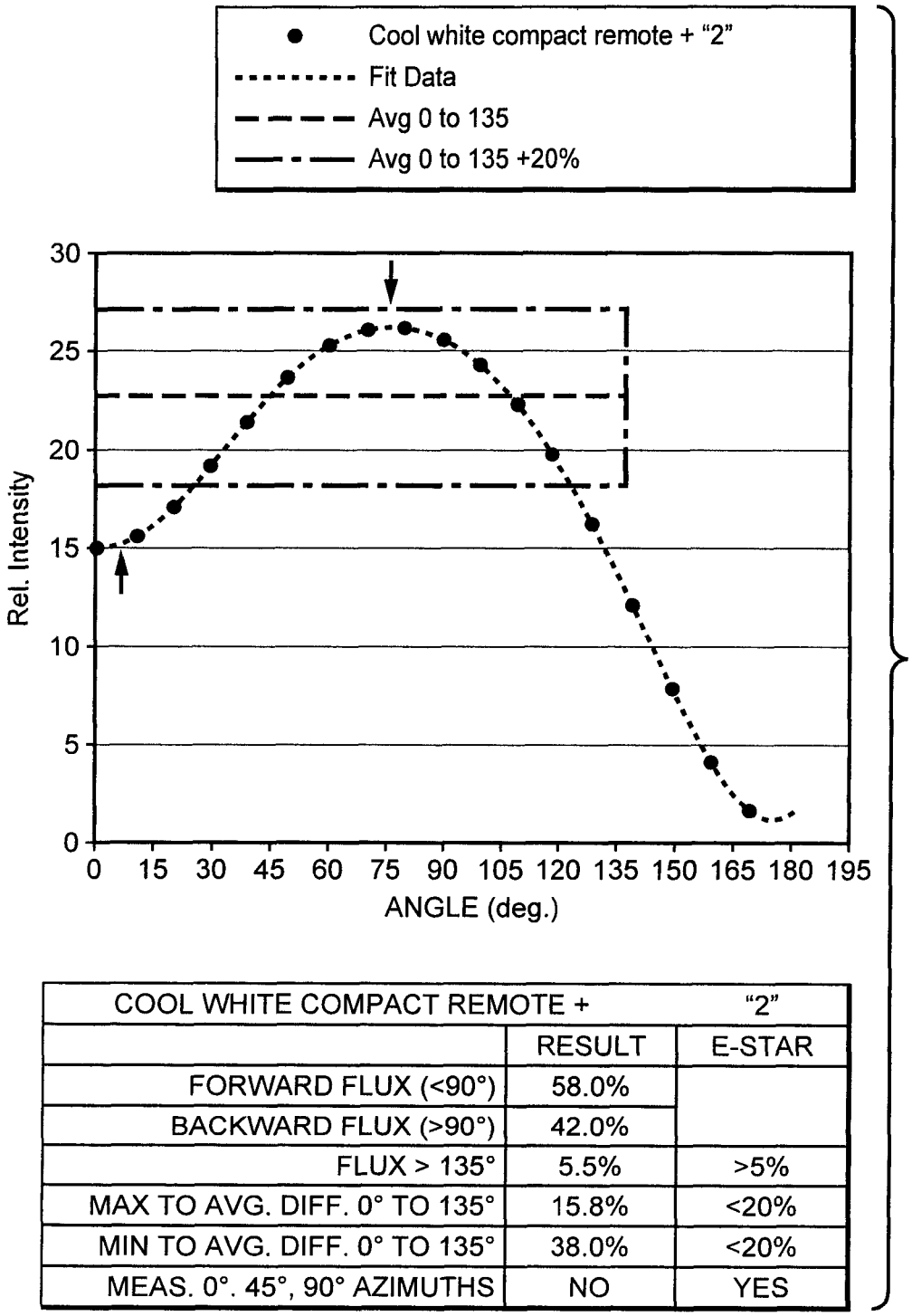
Figure 16:
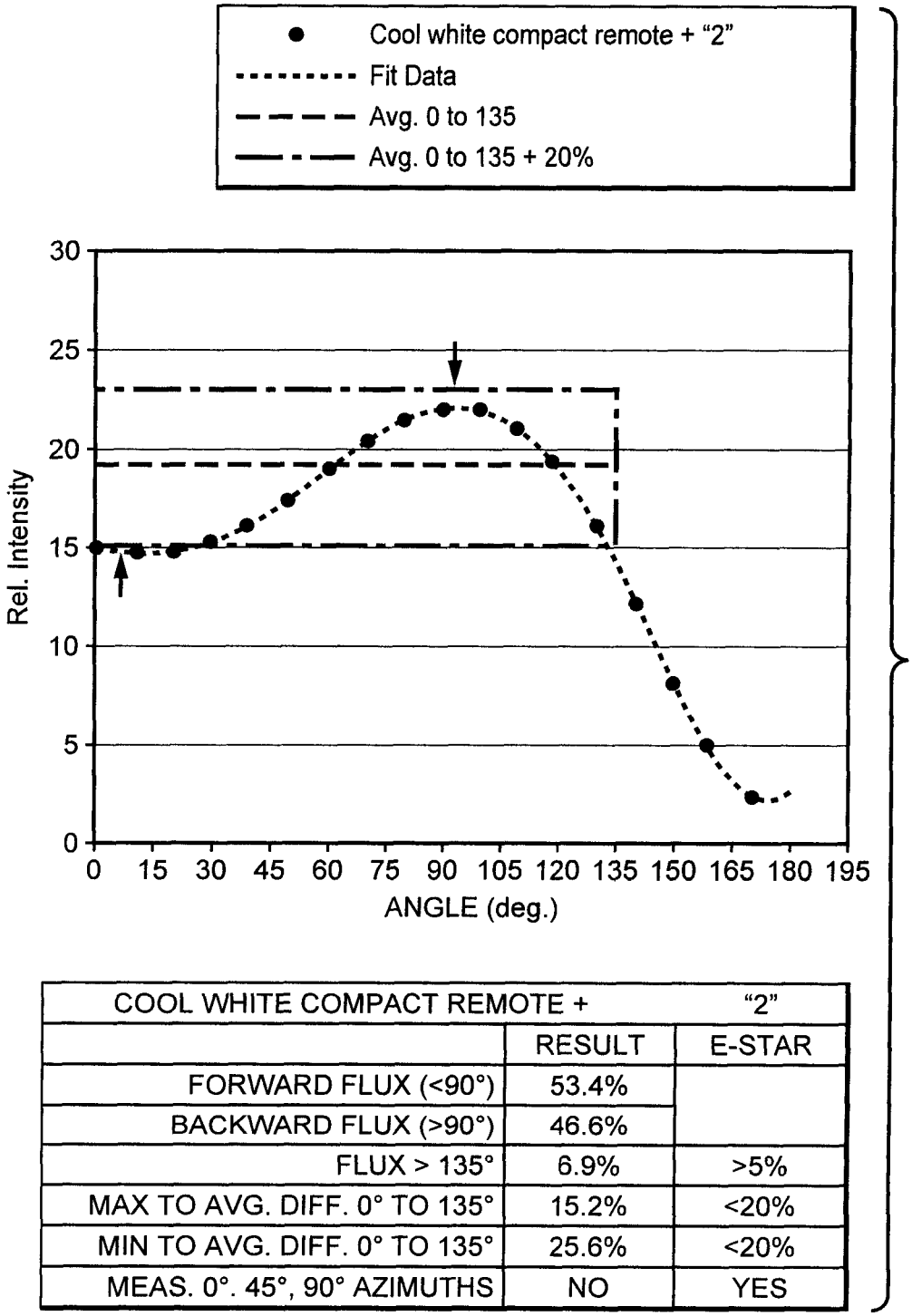
Figure 18:
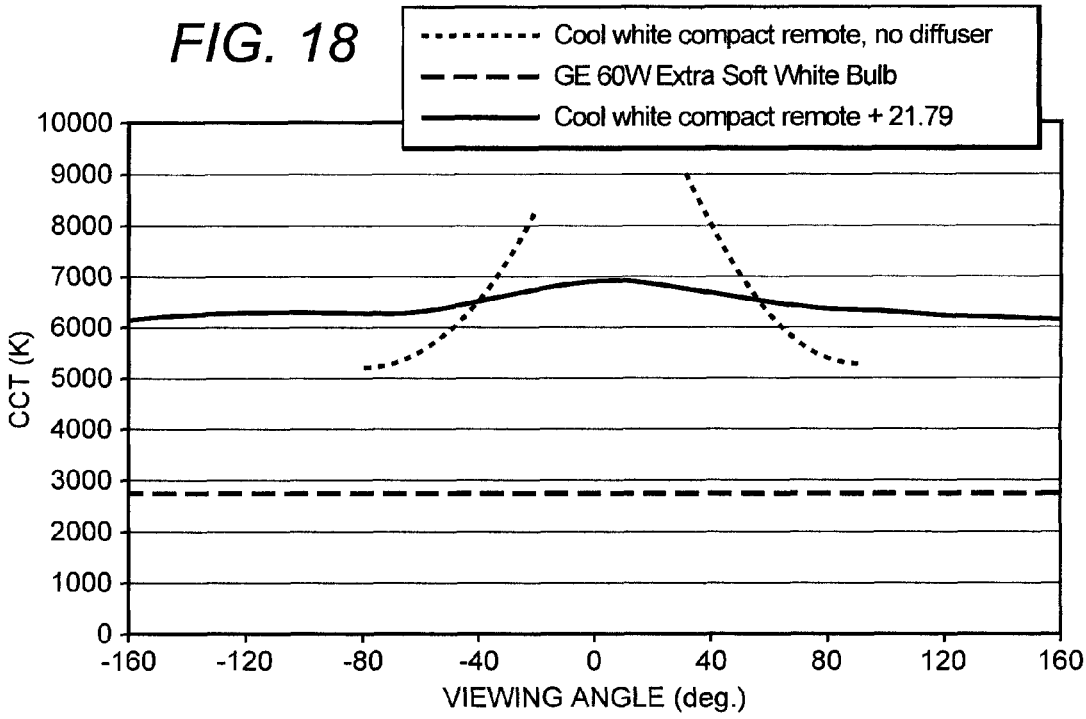
Figure 21:
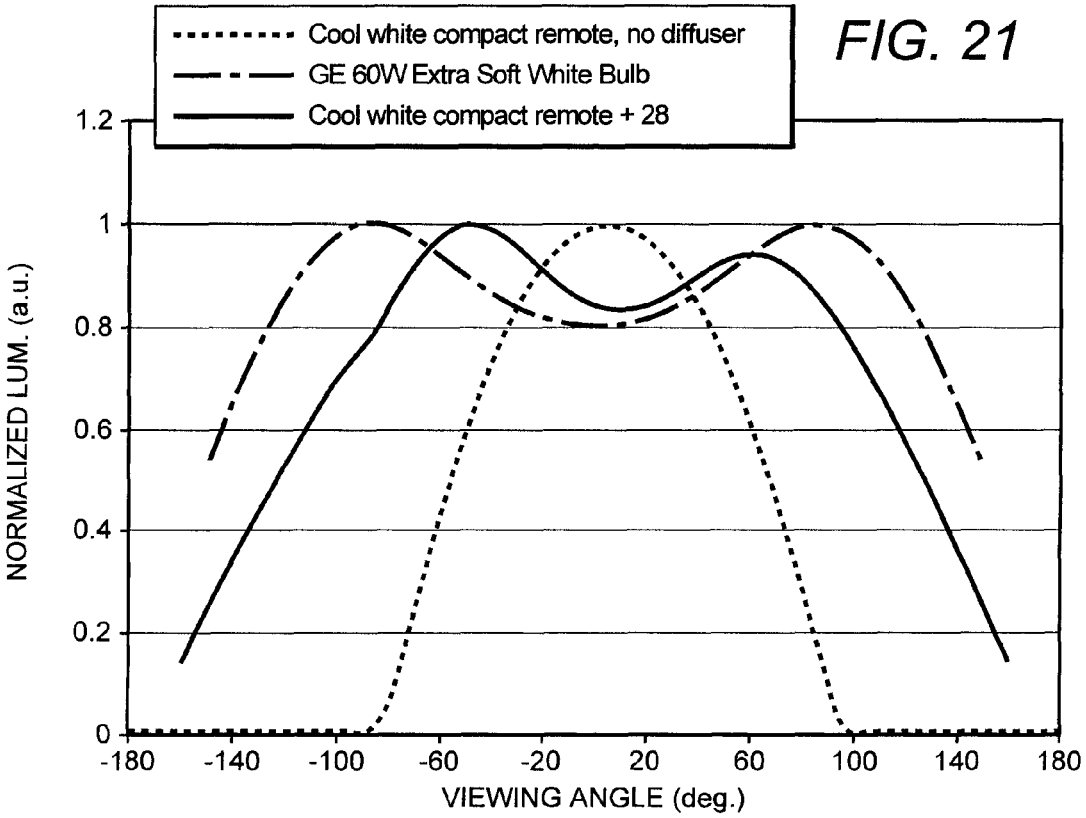
FIGS. 21 through 24 are graphs showing the emission characteristics of a lamp with the diffuser shown in FIG. 11 and flat remote phosphor disk shown schematically in FIG. 30.
Figure 19:
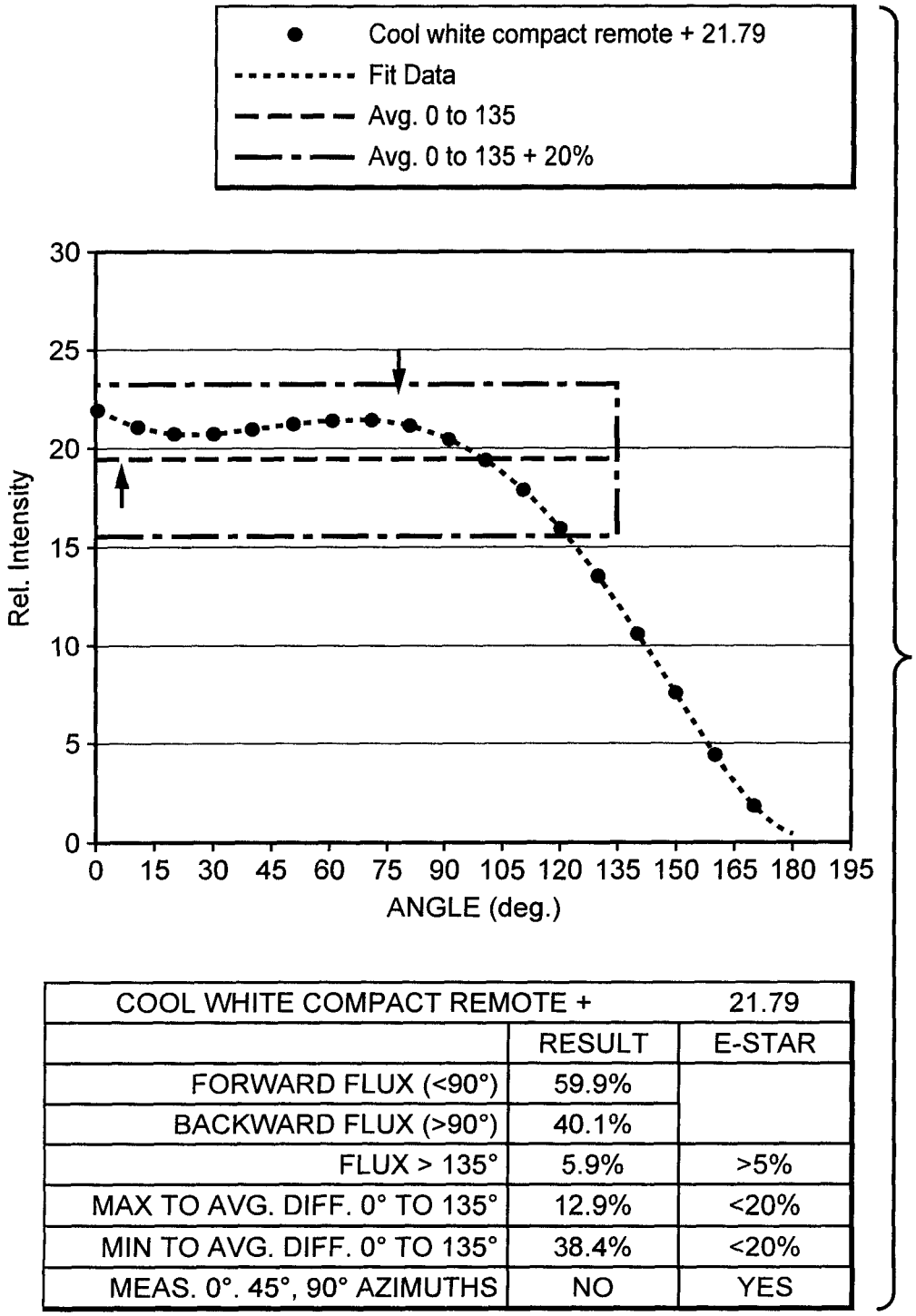
Figure 20:
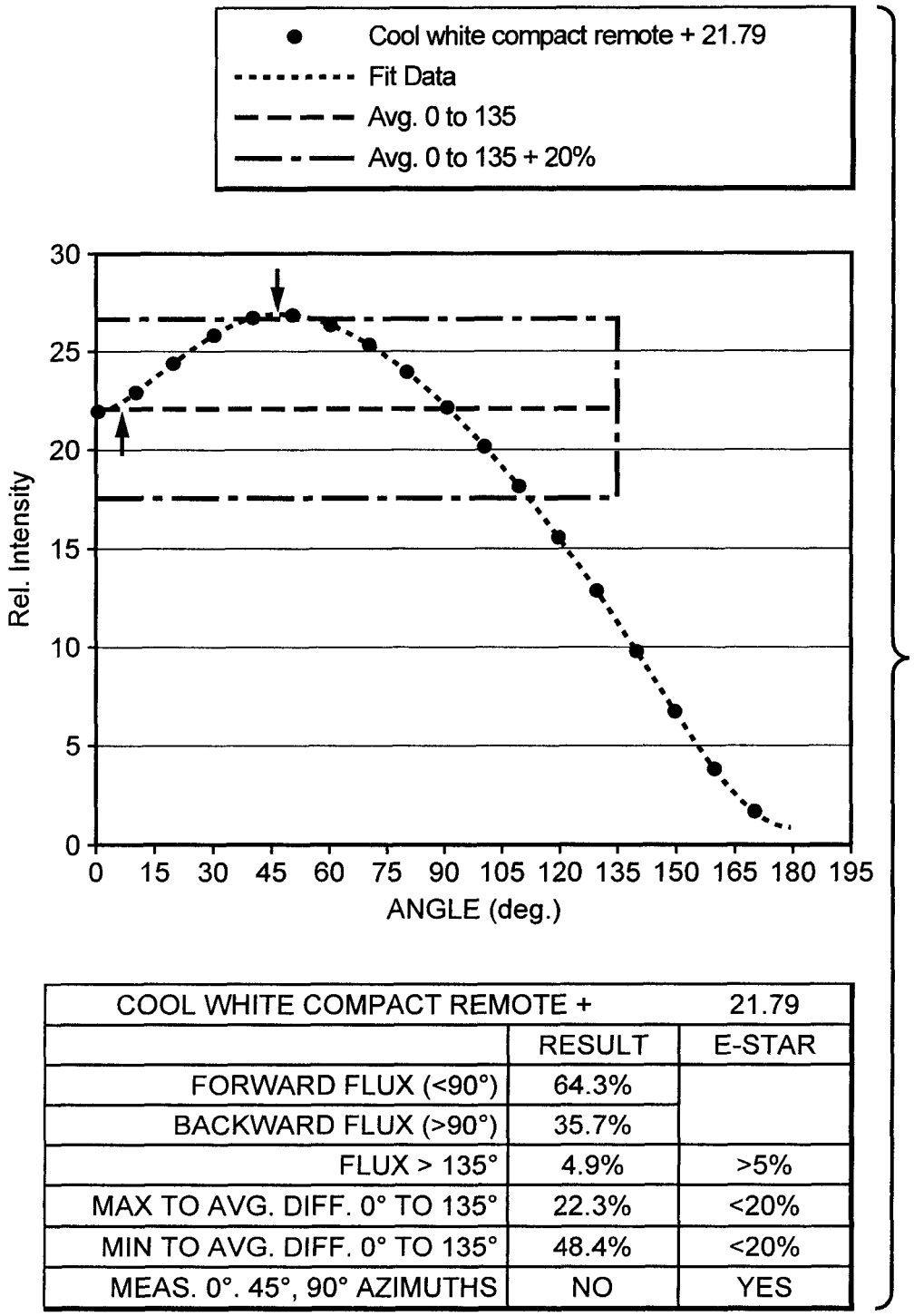
Figure 22:
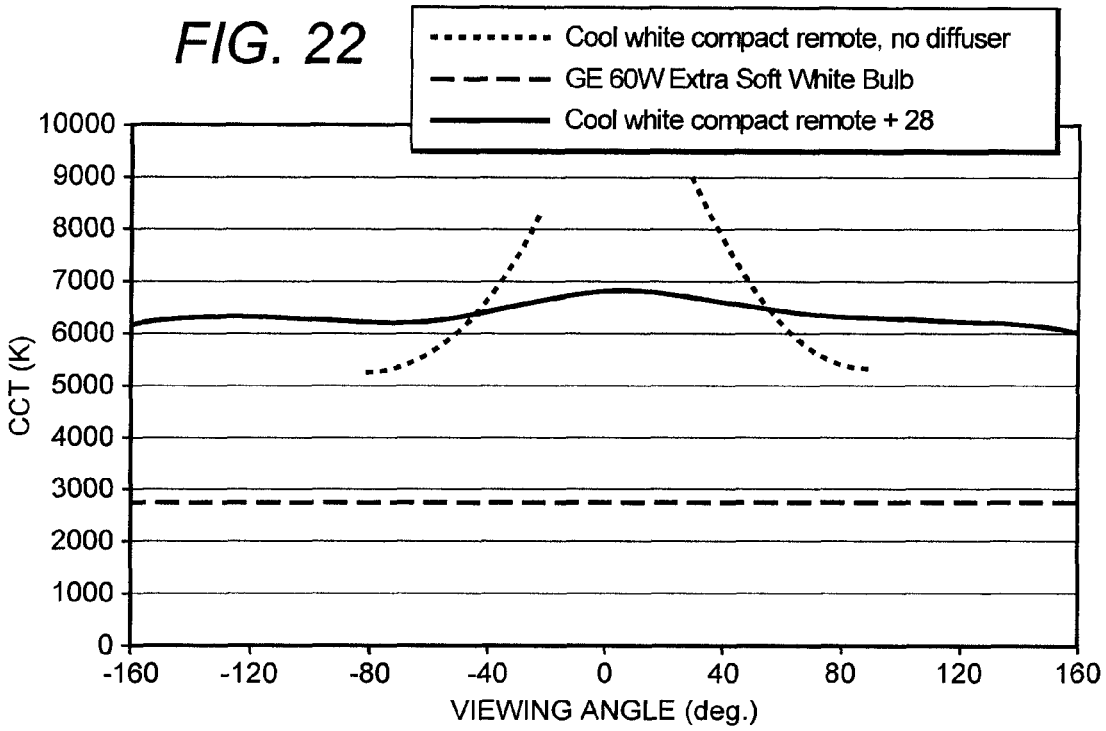
Figure 25:
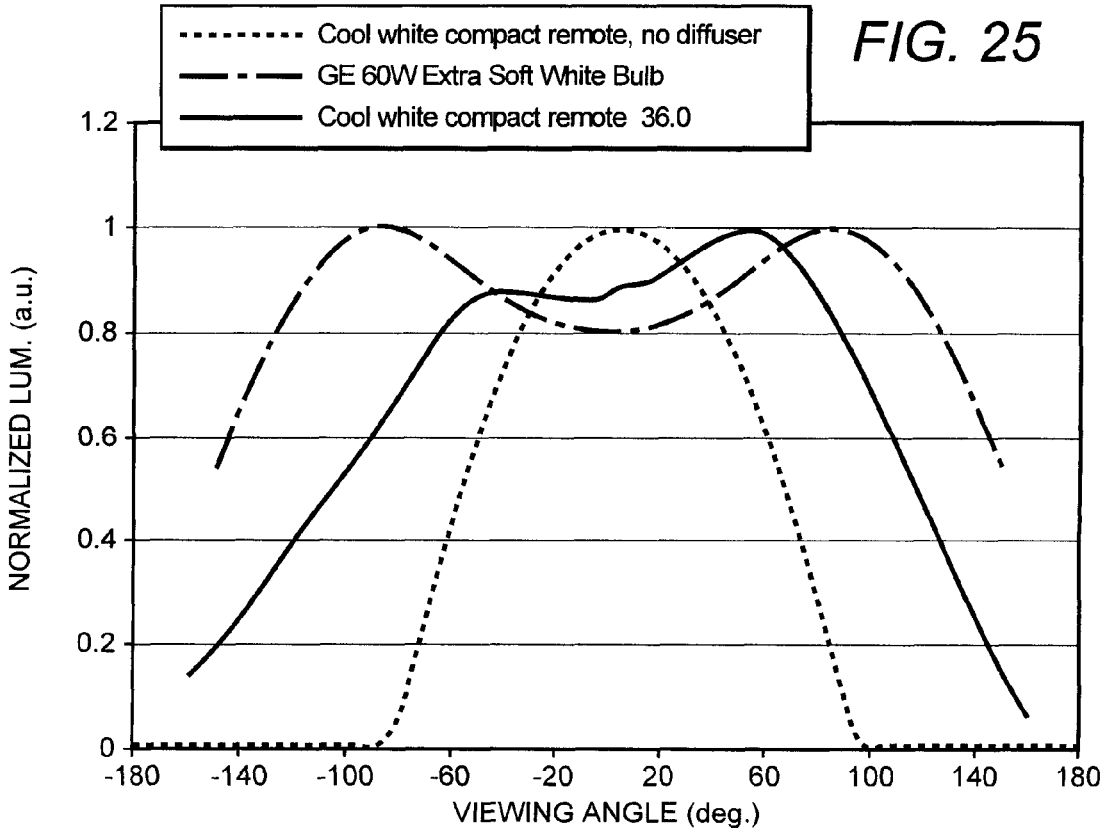
Figure 23:
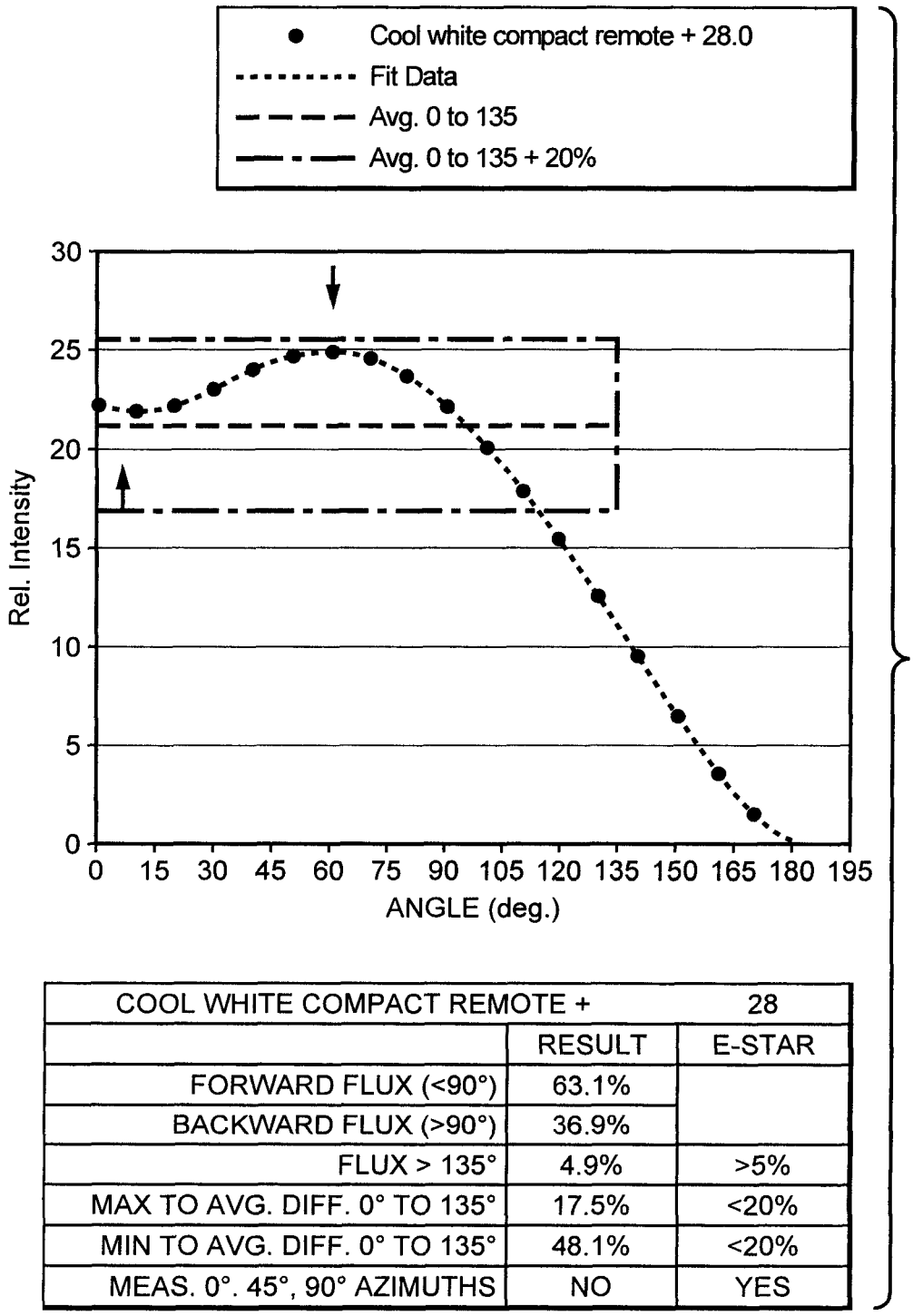
Figure 24:
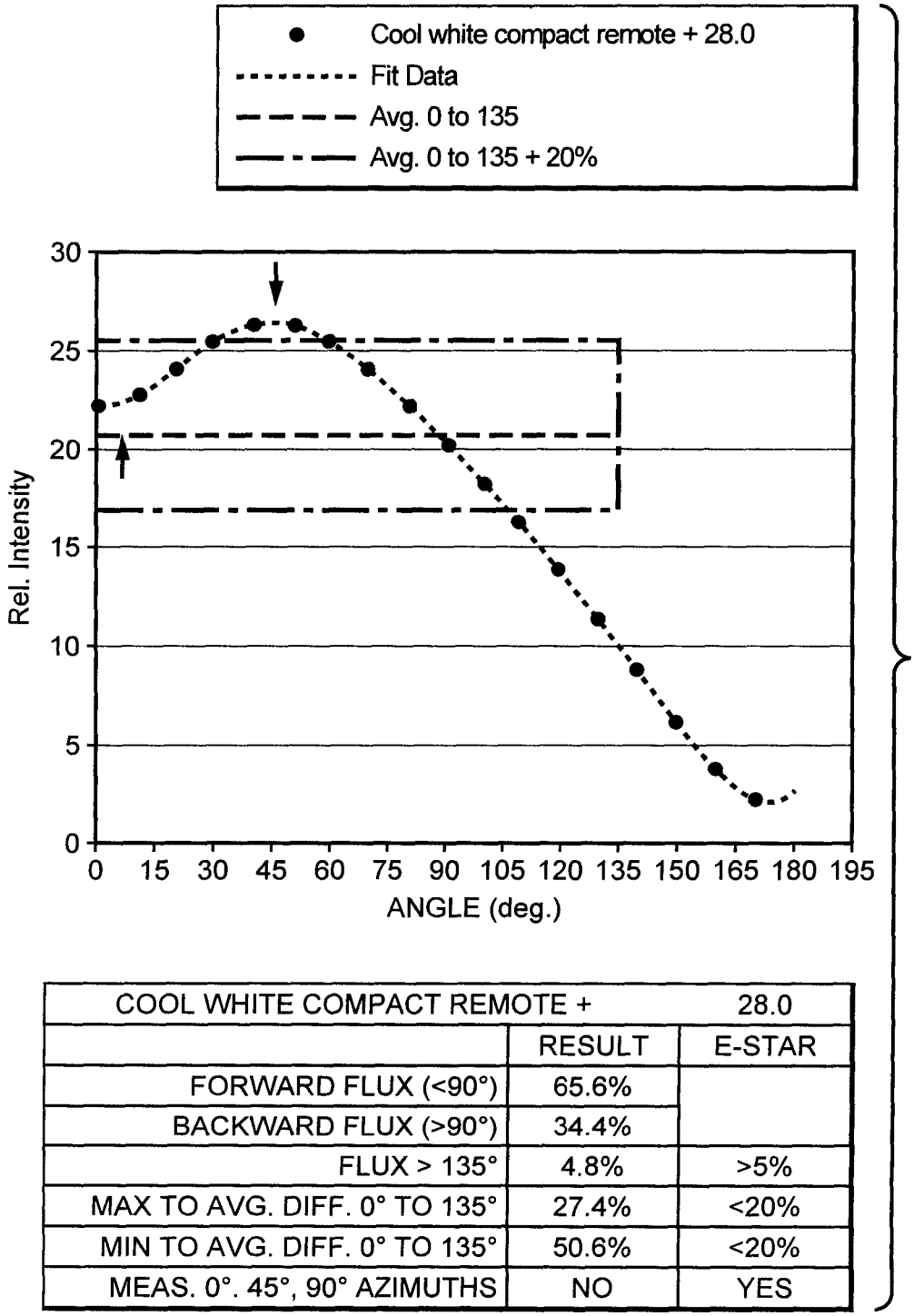
Figure 27:
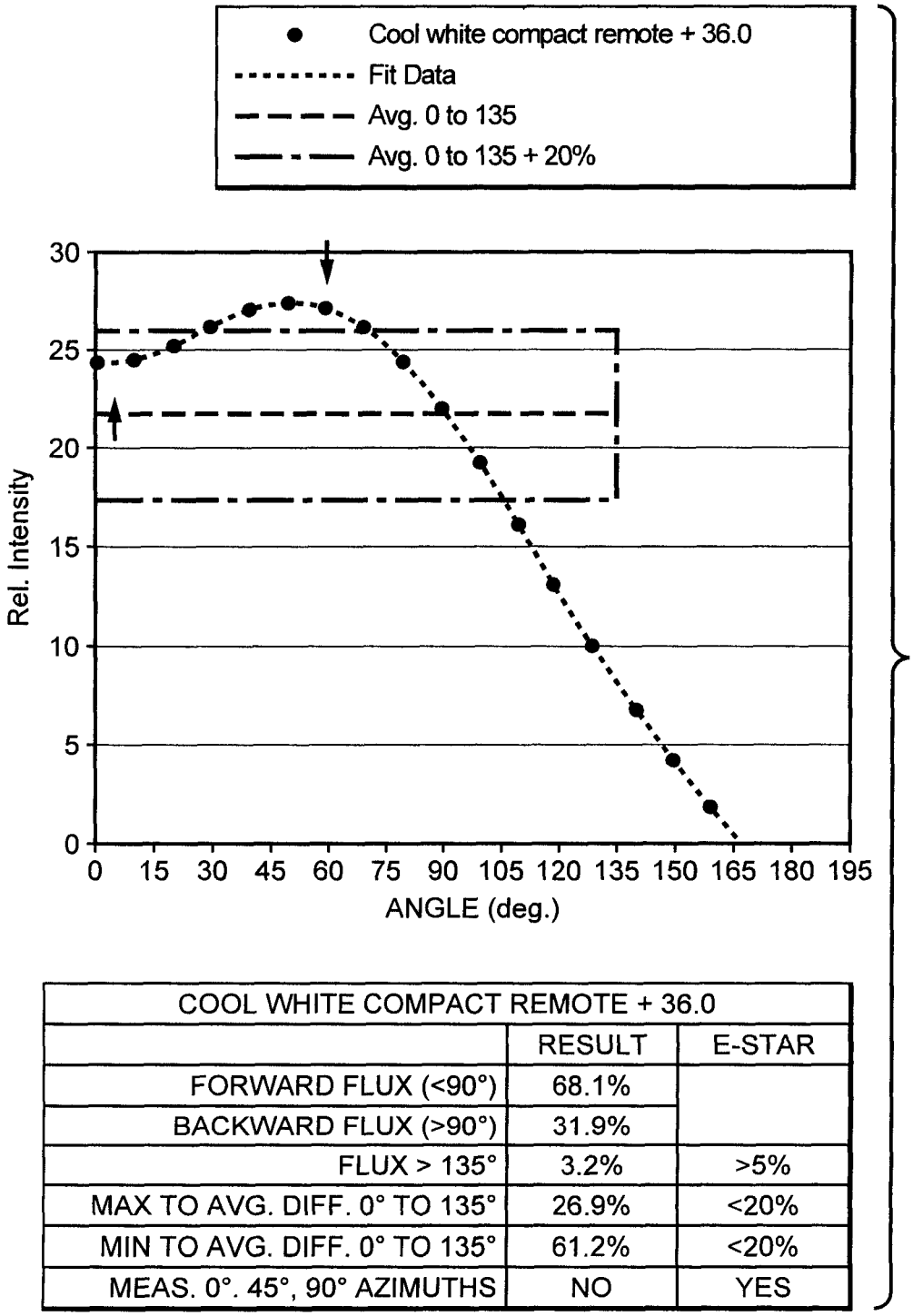
Figure 28:
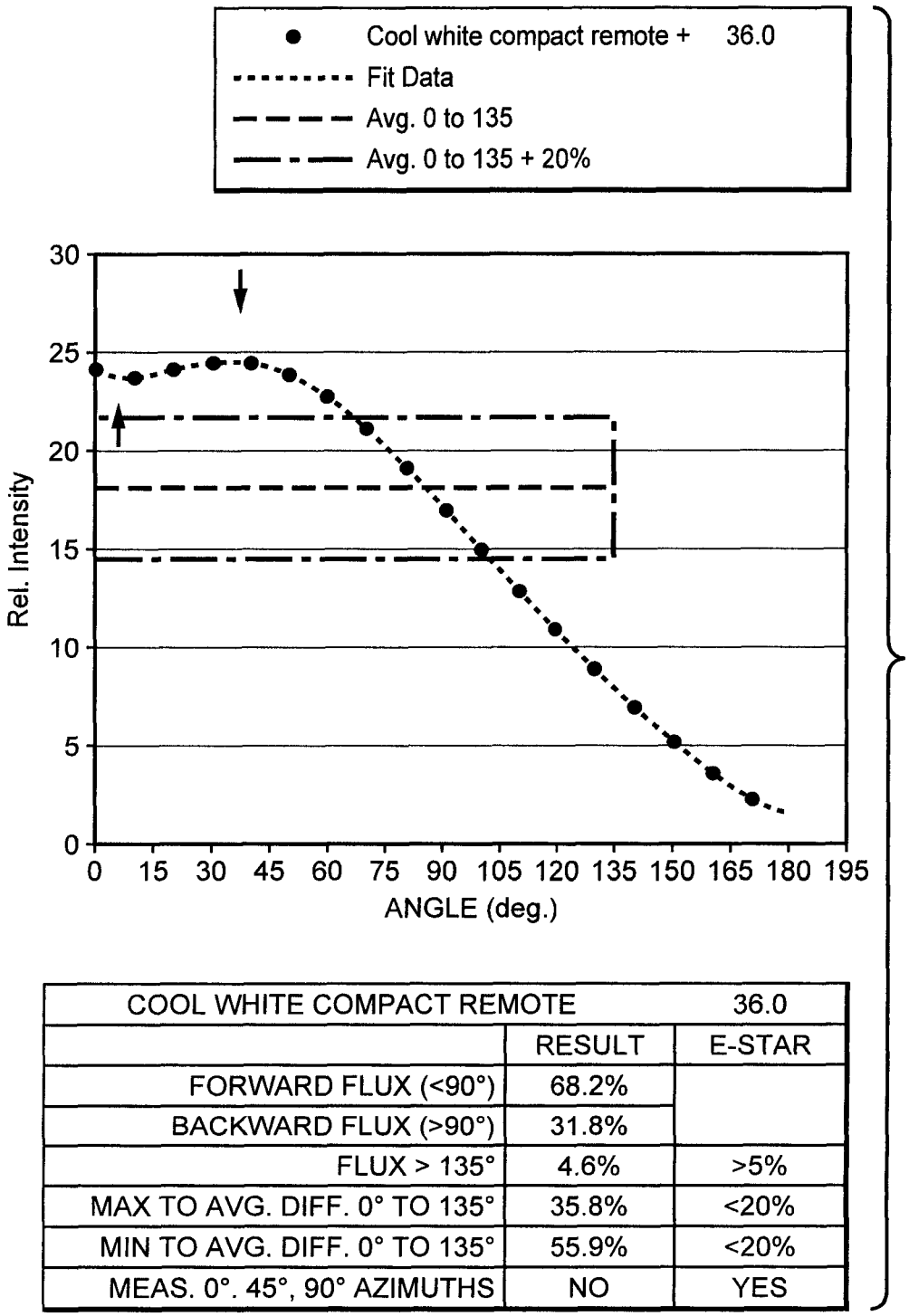

FIGS. 13 through 16 are graphs showing the emission characteristics for a lamp according to the present invention having a two-dimensional phosphor carrier with the diffuser 130 arranged over the phosphor so that light from the phosphor carrier passes through the diffuser. FIGS. 13 and 14 show the emission characteristics of the lamp compared to the lamp without a diffuser, and also compared to a standard General Electric 60 W Extra Soft Light Bulb. FIGS. 15 and 16 show variations in emission intensity from viewing angles 0 to 180°.

FIGS. 17 through 20 are similar to the graphs in FIGS. 13 through 16 and show the emission characteristics for a lamp according to the present invention also having a two-dimensional phosphor carrier with the diffuser 140 arranged over the phosphor carrier. FIGS. 21 through 24 are also similar to those in FIGS. 13 through 16 and show the emission characteristics for another lamp according to the present invention also having a two-dimensional phosphor carrier with the diffuser 150 arranged over the phosphor carrier. Likewise, FIGS. 25 through 28 are also similar to those in FIGS. 13 through 16 and show the emission characteristics for another lamp according to the present invention also having a two-dimensional phosphor carrier with the diffuser 160 arranged over the phosphor carrier.

The lamps according to the present invention can comprise many different features beyond those described above. Referring again to FIG. 4, in those lamp embodiments having a cavity 54 can be filled with a transparent heat conductive material to further enhance heat dissipation for the lamp. The cavity conductive material could provide a secondary path for dissipating heat from the light source 58. Heat from the light source would still conduct through the platform 56, but could also pass through the cavity material to the heat sink structure 52. This would allow for lower operating temperature for the light source 58, but presents the danger of elevated operating temperature for the phosphor carrier 62. This arrangement can be used in many different embodiments, but is particularly applicable to lamps having higher light source operating temperatures compared to that of the phosphor carrier. This arrangement allows for the heat to be more efficiently spread from the light source in applications where additional heating of the phosphor carrier layer can be tolerated.

As discussed above, different lamp embodiments according to the present invention can be arranged with many different types of light sources. FIG. 29 shows another embodiment of a lamp 210 similar to the lamp 50 described above and shown in FIG. 4. The lamp 210 comprises a heat sink structure 212 having a cavity 214 with a platform 216 arranged to hold a light source 218. A phosphor carrier 220 can be included over and at least partially covering the opening to the cavity 214. In this embodiment, the light source 218 can comprise a plurality of LEDs arranged in separate LED packages or arranged in an array in single multiple LED packages. For the embodiments comprising separate LED packages, each of the LEDs can comprise its own primary optics or lens 222. In embodiments having a single multiple LED package, a single primary optic or lens 224 can cover all the LEDs. It is also understood that the LED and LED arrays can have secondary optics or can be provided with a combination of primary and secondary optics. It is understood that the LEDs can be provided without lenses and that in the array embodiments each of the LEDs can have its own lens. Like the lamp 50, the heat sink structure and platform can be arranged with the necessary electrical traces or wires to provide an electrical signal to the light source 218. In each embodiment, the emitters can be coupled on different series and parallel arrangement. In one embodiment eight LEDs can be used that are connected in series with two wires to a circuit board. The wires can then be connected to the power supply unit described above. In other embodiments, more or less than eight LEDs can be used and as mentioned above, commercially available LEDs from Cree, Inc. can be used including eight XLamp® XP-E LEDs or four XLamp® XP-G LEDs. Different single string LED circuits are described in U.S. patent application Ser. No. 12/566,195, to van de Ven et al., entitled "Color Control of Single String Light Emitting Devices Having Single String Color Control," and U.S. patent application Ser. No. 12/704,730 to van de Ven et al., entitled "Solid State Lighting Apparatus with Compensation Bypass Circuits and Methods of Operation Thereof", both of with are incorporated herein by reference.

In the lamps 50 and 210 described above, the light source and the phosphor carrier share a thermal path for dissipating heat, referred to as being thermally coupled. In some embodiments the heat dissipation of the phosphor carrier may be enhanced if the thermal paths for the phosphor carrier and the light source are not thermally connected, referred to as thermally decoupled.

Figure 30:
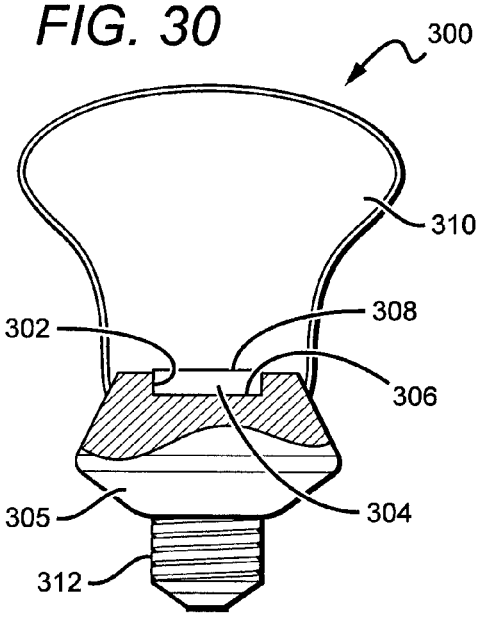
FIG. 30 is a sectional view of another embodiment of a lamp according to the present invention.

FIG. 30 shows still another embodiment of lamp 300 according to the present invention that comprises an optical cavity 302 within a heat sink structure 305. Like the embodiments above, the lamp 300 can also be provided without a lamp cavity, with the LEDs mounted on a surface of the heat sink or on a three dimensional or pedestal structures having different shapes. A planar LED based light source 304 is mounted to the platform 306, and a phosphor carrier 308 is mounted to the top opening of the cavity 302, with the phosphor carrier 308 having any of the features of those described above. In the embodiment shown, the phosphor carrier 308 can be in a flat disk shape and comprises a thermally conductive transparent material and a phosphor layer. It can be mounted to the cavity with a thermally conductive material or device as described above. The cavity 302 can have reflective surfaces to enhance the emission efficiency as described above.

Light from the light source 304 passes through the phosphor carrier 308 where a portion of it is converted to a different wavelength of light by the phosphor in the phosphor carrier 308. In one embodiment the light source 304 can comprise blue emitting LEDs and the phosphor carrier 308 can comprise a yellow phosphor as described above that absorbs a portion of the blue light and re-emits yellow light. The lamp 300 emits a white light combination of LED light and yellow phosphor light. Like above, the light source 304 can also comprise many different LEDs emitting different colors of light and the phosphor carrier can comprise other phosphors to generate light with the desired color temperature and rendering.

The lamp 300 also comprises a shaped diffuser dome 310 mounted over the cavity 302 that includes diffusing or scattering particles such as those listed above. The scattering particles can be provided in a curable binder that is formed in the general shape of dome. In the embodiment shown, the dome 310 is mounted to the heat sink structure 305 and has an enlarged portion at the end opposite the heat sink structure 305. Different binder materials can be used as discussed above such as silicones, epoxies, glass, inorganic glass, dielectrics, BCB, polymides, polymers and hybrids thereof. In some embodiments white scattering particles can be used with the dome having a white color that hides the color of the phosphor in the phosphor carrier 308 in the optical cavity. This gives the overall lamp 300 a white appearance that is generally more visually acceptable or appealing to consumers than the color of the phosphor. In one embodiment the diffuser can include white titanium dioxide particles that can give the diffuser dome 310 its overall white appearance.

The diffuser dome 310 can provide the added advantage of distributing the light emitting from the optical cavity in a more uniform pattern. As discussed above, light from the light source in the optical cavity can be emitted in a generally Lambertian pattern and the shape of the dome 310 along with the scattering properties of the scattering particles causes light to emit from the dome in a more omnidirectional emission pattern. An engineered dome can have scattering particles in different concentrations in different regions or can be shaped to a specific emission pattern. In some embodiments the dome can be engineered so that the emission pattern from the lamp complies with the Department of Energy (DOE) Energy Star defined omnidirectional distribution criteria. One requirement of this standard met by the lamp 300 is that the emission uniformity must be within 20% of mean value from 0 to 135° viewing and; >5% of total flux from the lamp must be emitted in the 135-180° emission zone, with the measurements taken at 0, 45, 90° azimuthal angles. As mentioned above, the different lamp embodiments described herein can also comprise A-type retrofit LED bulbs that meet the DOE Energy Star standards. The present invention provides lamps that are efficient, reliable and cost effective. In some embodiments, the entire lamp can comprise five components that can be quickly and easily assembled.

Like the embodiments above, the lamp 300 can comprise a mounting mechanism of the type to fit in conventional electrical receptacles. In the embodiment shown, the lamp 300 includes a screw-threaded portion 312 for mounting to a standard Edison socket. Like the embodiments above, the lamp 300 can include standard plug and the electrical receptacle can be a standard outlet, or can comprise a GU24 base unit, or it can be a clip and the electrical receptacle can be a receptacle which receives and retains the clip (e.g., as used in many fluorescent lights).

As mentioned above, the space between some of the features of the lamp 300 can be considered mixing chambers, with the space between the light source 306 and the phosphor carrier 308 comprising a first light mixing chamber. The space between the phosphor carrier 308 and the diffuser 310 can comprise a second light mixing chamber, with the mixing chamber promoting uniform color and intensity emission for the lamp. The same can apply to the embodiments below having different shaped phosphor carriers and diffusers. In other embodiments, additional diffusers and/or phosphor carriers can be included forming additional mixing chambers, and the diffusers and/or phosphor carriers can be arranged in different orders.

Figure 31:
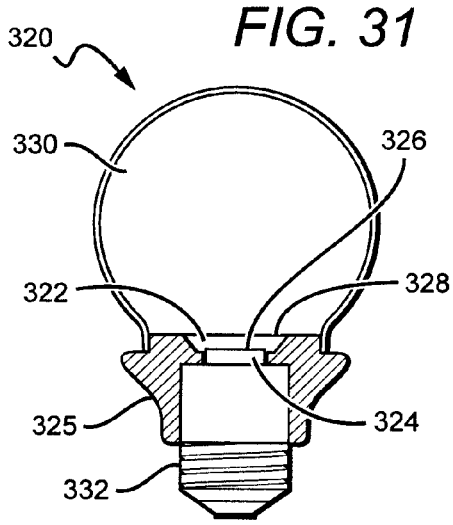
FIG. 31 is a sectional view of another embodiment of a lamp according to the present invention having a diffuser dome.

Different lamp embodiments according to the present invention can have many different shapes and sizes. FIG. 31 shows another embodiment of a lamp 320 according to the present invention that is similar to the lamp 300 and similarly comprises an optical cavity 322 in a heat sink structure 325 with a light source 324 mounted to the platform 326 in the optical cavity 322. Like above, the heat sink structure need not have an optical cavity, and the light sources can be provided on other structures beyond a heat sink structure. These can include planar surfaces or pedestals having the light source. A phosphor carrier 328 is mounted over the cavity opening with a thermal connection. The lamp 320 also comprises a diffuser dome 330 mounted to the heat sink structure 325, over the optical cavity. The diffuser dome can be made of the same materials as diffuser dome 310 described above and shown in FIG. 15, but in this embodiment the dome 300 is oval or egg shaped to provide a different lamp emission pattern while still masking the color from the phosphor in the phosphor carrier 328. It is also noted that the heat sink structure 325 and the platform 326 are thermally de-coupled. That is, there is a space between the platform 326 and the heat sink structure such that they do not share a thermal path for dissipating heat. As mentioned above, this can provide improved heat dissipation from the phosphor carrier compared to lamps not having de-coupled heat paths. The lamp 300 also comprises a screw-threaded portion 332 for mounting to an Edison socket.

Figure 32:
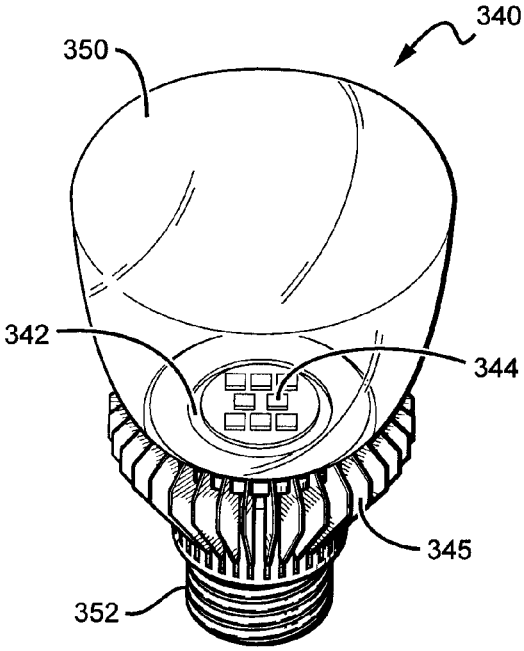
FIG. 32 is a perspective view of another embodiment of a lamp according to the present invention with a diffuser dome having a different shape.
Figure 33:
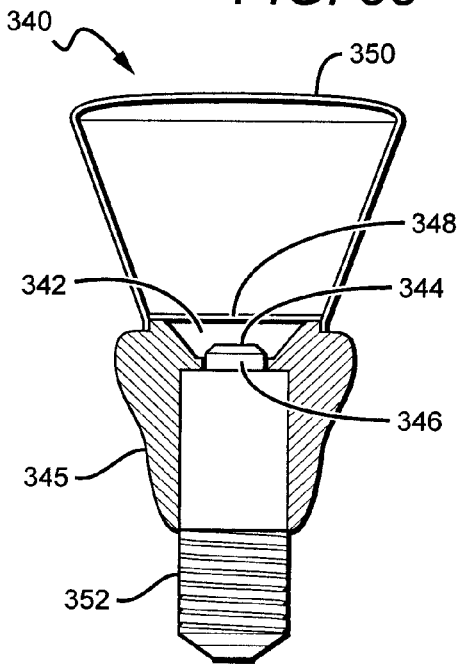
FIG. 33 is a sectional view of the lamp shown in FIG. 32.

FIGS. 32 through 34 show another embodiment of a lamp 340 according to the present invention that is similar to the lamp 320 shown in FIG. 31. It comprises a heat sink structure 345 having an optical cavity 342 with a light source 344 on the platform 346, and a phosphor carrier 348 over the optical cavity. It further comprises a screw-threaded portion 352. It also includes a diffuser dome 350, but in this embodiment the diffuser dome is flattened on top to provide the desired emission pattern while still masking the color of the phosphor.

The lamp 340 also comprises an interface layer 354 between the light source 344 and the heat sink structure 345 from the light source 344. In some embodiments the interface layer can comprise a thermally insulating material and the light source 344 can have features that promote dissipation of heat from the emitters to the edge of the light source's substrate. This can promote heat dissipation to the outer edges of the heat sink structure 345 where it can dissipate through the heat fins. In other embodiments the interface layer 354 can be electrically insulating to electrically isolate the heat sink structure 345 from the light source 344. Electrical connection can then be made to the top surface of the light source.

In the embodiments above, the phosphor carriers are two dimensional (or flat/planar) with the LEDs in the light source being co-planer. It is understood, however, that in other lamp embodiments the phosphor carriers can take many different shapes including different three-dimensional shapes. The term three-dimensional is meant to mean any shape other than planar as shown in the above embodiments. FIGS. 35 through 38 show different embodiments of three-dimensional phosphor carriers according to the present invention, but it is understood that they can also take many other shapes. As discussed above, when the phosphor absorbs and re-emits light, it is re-emitted in an isotropic fashion, such that the 3-dimensional phosphor carrier serves to convert and also disperse light from the light source. Like the diffusers described above, the different shapes of the 3-dimensional carrier layers can emit light in emission patterns having different characteristics that depends partially on the emission pattern of the light source. The diffuser can then be matched with the emission of the phosphor carrier to provide the desired lamp emission pattern.

FIG. 35 shows a hemispheric shaped phosphor carrier 354 comprising a hemispheric carrier 355 and phosphor layer 356. The hemispheric carrier 355 can be made of the same materials as the carrier layers described above, and the phosphor layer can be made of the same materials as the phosphor layer described above, and scattering particles can be included in the carrier and phosphor layer as described above.

In this embodiment the phosphor layer 356 is shown on the outside surface of the carrier 355 although it is understood that the phosphor layer can be on the carrier's inside layer, mixed in with the carrier, or any combination of the three. In some embodiments, having the phosphor layer on the outside surface may minimize emission losses. When emitter light is absorbed by the phosphor layer 356 it is emitted omnidirectionally and some of the light can emit backwards and be absorbed by the lamp elements such as the LEDs. The phosphor layer 356 can also have an index of refraction that is different from the hemispheric carrier 355 such that light emitting forward from the phosphor layer can be reflected back from the inside surface of the carrier 355. This light can also be lost due to absorption by the lamp elements. With the phosphor layer 356 on the outside surface of the carrier 355, light emitted forward does not need to pass through the carrier 355 and will not be lost to reflection. Light that is emitted back will encounter the top of the carrier where at least some of it will reflect back. This arrangement results in a reduction of light from the phosphor layer 356 that emits back into the carrier where it can be absorbed.

The phosphor layer 356 can be deposited using many of the same methods described above. In some instances the three-dimensional shape of the carrier 355 may require additional steps or other processes to provide the necessary coverage. In the embodiments where a solvent-phosphor-binder mixture is sprayed and the carrier can be heated as described above and multiple spray nozzles may be needed to provide the desired coverage over the carrier, such as approximate uniform coverage. In other embodiments, fewer spray nozzles can be used while spinning the carrier to provide the desired coverage. Like above, the heat from the carrier 355 can evaporate the solvent and helps cure the binder.

In still other embodiments, the phosphor layer can be formed through an emersion process whereby the phosphor layer can be formed on the inside or outside surface of the carrier 355, but is particularly applicable to forming on the inside surface. The carrier 355 can be at least partially filled with, or otherwise brought into contact with, a phosphor mixture that adheres to the surface of the carrier. The mixture can then be drained from the carrier leaving behind a layer of the phosphor mixture on the surface, which can then be cured. In one embodiment, the mixture can comprise polyethylen oxide (PEO) and a phosphor. The carrier can be filled and then drained, leaving behind a layer of the PEO-phosphor mixture, which can then be heat cured. The PEO evaporates or is driven off by the heat leaving behind a phosphor layer. In some embodiments, a binder can be applied to further fix the phosphor layer, while in other embodiments the phosphor can remain without a binder.

Like the processes used to coat the planar carrier layer, these processes can be utilized in three-dimensional carriers to apply multiple phosphor layers that can have the same or different phosphor materials. The phosphor layers can also be applied both on the inside and outside of the carrier, and can have different types having different thickness in different regions of the carrier. In still other embodiments different processes can be used such as coating the carrier with a sheet of phosphor material that can be thermally formed to the carrier.

In lamps utilizing the carrier 355, an emitter can be arranged at the base of the carrier so that light from the emitters emits up and passes through the carrier 355. In some embodiments the emitters can emit light in a generally Lambertian pattern, and the carrier can help disperse the light in a more uniform pattern.

FIG. 36 shows another embodiment of a three dimensional phosphor carrier 357 according to the present invention comprising a bullet-shaped carrier 358 and a phosphor layer 359 on the outside surface of the carrier. The carrier 358 and phosphor layer 359 can be formed of the same materials using the same methods as described above. The different shaped phosphor carrier can be used with a different emitter to provide the overall desired lamp emission pattern. FIG. 37 shows still another embodiment of a three dimensional phosphor carrier 360 according to the present invention comprising a globe-shaped carrier 361 and a phosphor layer 362 on the outside surface of the carrier. The carrier 361 and phosphor layer 362 can be formed of the same materials using the same methods as described above.

FIG. 38 shows still another embodiment phosphor carrier 363 according to the present invention having a generally globe shaped carrier 364 with a narrow neck portion 365. Like the embodiments above, the phosphor carrier 363 includes a phosphor layer 366 on the outside surface of the carrier 364 made of the same materials and formed using the same methods as those described above. In some embodiments, phosphor carriers having a shape similar to the carrier 364 can be more efficient in converting emitter light and re-emitting light from a Lambertian pattern from the light source, to a more uniform emission pattern.

Embodiments having a three-dimensional structure holding the LED, such as a pedestal, can provide an even more dispersed light pattern from the three-dimensional phosphor carrier. In these embodiments, the LEDs can be within the phosphor carrier at different angles so that they provide a light emitting pattern that is less Lambertian than a planar LED light source. This can then be further dispersed by the three-dimensional phosphor carrier, with the disperser fine-tuning the lamp's emission pattern.

Figure 39:
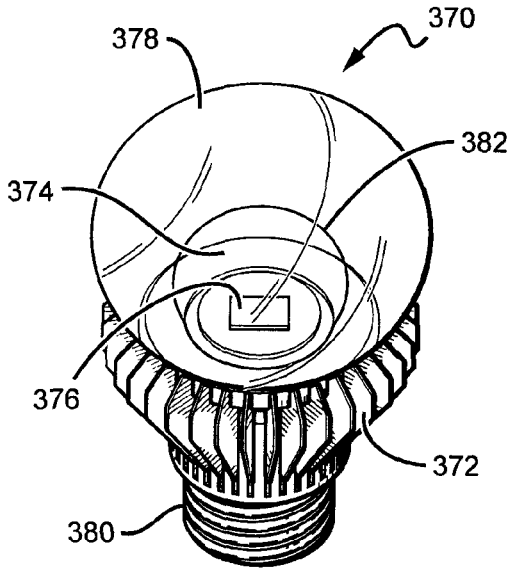
FIG. 39 is a perspective view of another embodiment of a lamp according to the present invention with a three-dimensional phosphor carrier.
Figure 41:
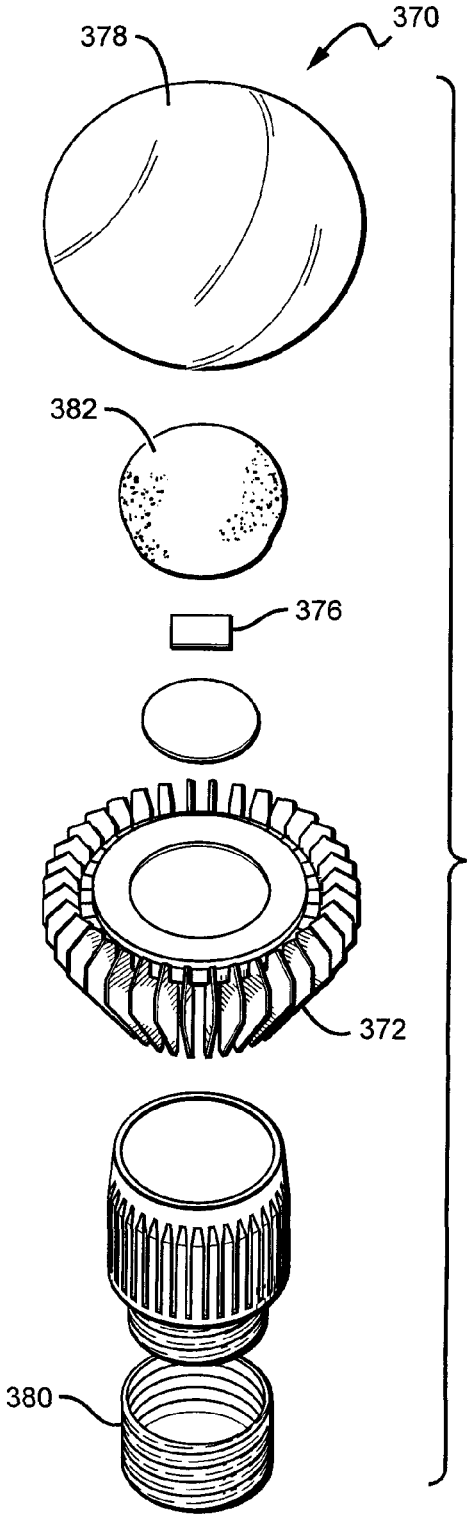
FIG. 41 is an exploded view of the lamp shown in FIG. 39.
Figure 40:
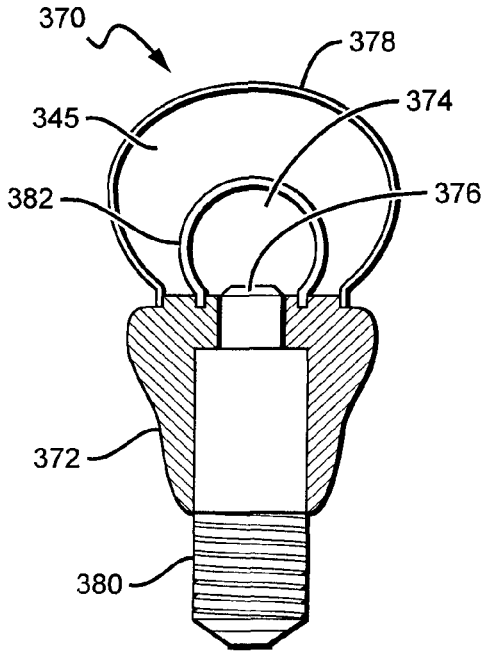
FIG. 40 is a sectional view of the lamp shown in FIG. 39.

FIGS. 39 through 41 show another embodiment of a lamp 370 according to the present invention having a heat sink structure 372, optical cavity 374, light source 376, diffuser dome 378 and a screw-threaded portion 380. This embodiment also comprises a three-dimensional phosphor carrier 382 that includes a thermally conductive transparent material and one phosphor layer. It is also mounted to the heat sink structure 372 with a thermal connection. In this embodiment, however, the phosphor carrier 382 is hemispheric shaped and the emitters are arranged so that light from the light source passes through the phosphor carrier 382 where at least some of it is converted.

The three dimensional shape of the phosphor carrier 382 provides natural separation between it and the light source 376. Accordingly, the light source 376 is not mounted in a recess in the heat sink that forms the optical cavity. Instead, the light source 376 is mounted on the top surface of the heat sink structure 372, with the optical cavity 374 formed by the space between the phosphor carrier 382 and the top of the heat sink structure 372. This arrangement can allow for a less Lambertian emission from the optical cavity 374 because there are no optical cavity side surfaces to block and redirect sideways emission.

In embodiments of the lamp 370 utilizing blue emitting LEDs for the light source 376 and yellow phosphor, the phosphor carrier 382 can appear yellow, and the diffuser dome 378 masks this color while dispersing the lamp light into the desired emission pattern. In lamp 370, the conductive paths for the platform and heat sink structure are coupled, but it is understood that in other embodiments they can be decoupled.

FIG. 42 shows one embodiment of a lamp 390 according to the present invention comprising an eight LED light source 392 mounted on a heat sink 394 as described above. The emitters can be coupled together in many different ways and in the embodiment shown are serially connected. It is noted that in this embodiment the emitters are not mounted in an optical cavity, but are instead mounted on top planar surface of the heat sink 394. FIG. 43 shows the lamp 390 shown in FIG. 42 with a dome-shaped phosphor carrier 396 mounted over the light source 392. The lamp 390 shown in FIG. 43 can be combined with the diffuser 398 as shown in FIGS. 44 and 45 to form a lamp dispersed light emission.

Figure 46:
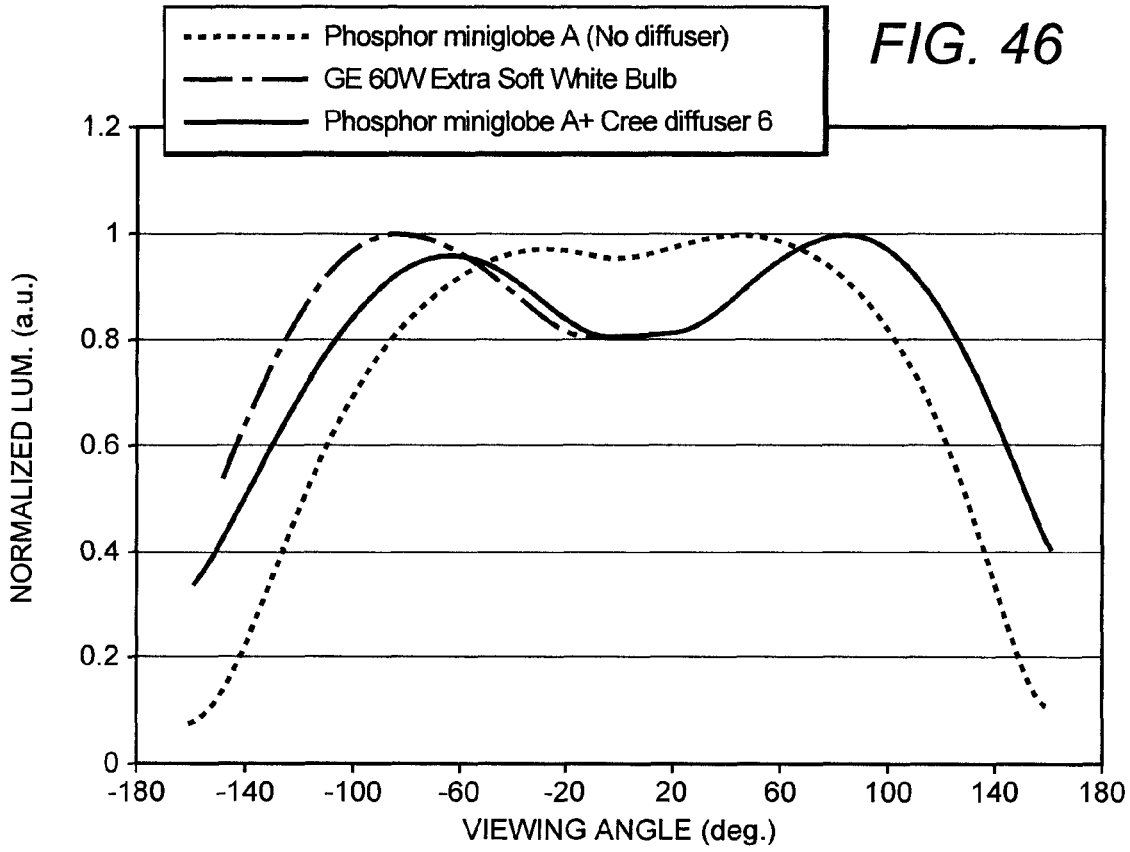
FIGS. 46 through 49 are graphs showing the emission characteristics of a lamp with the globe shaped phosphor carrier in FIG. 43 and dome shaped diffuser shown in FIGS. 44 and 45.
Figure 47:
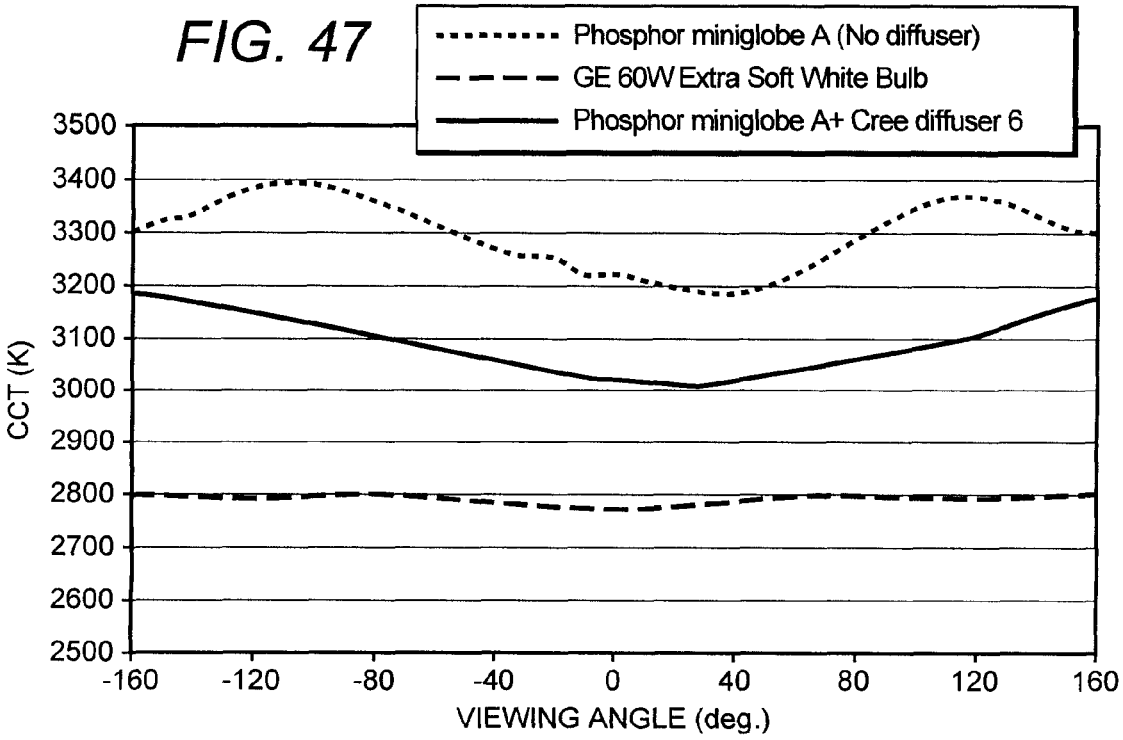
Figure 48:
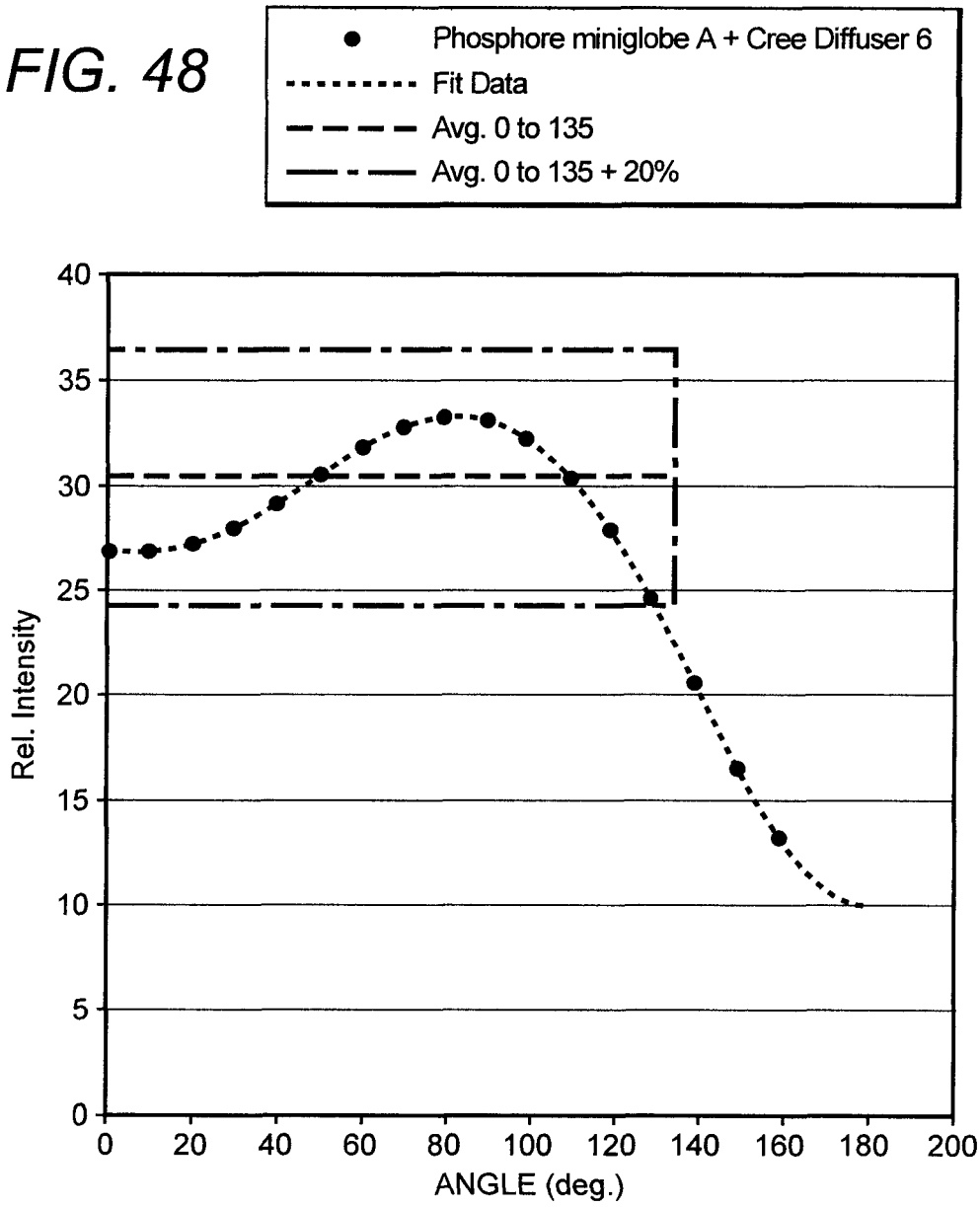
Figure 49:
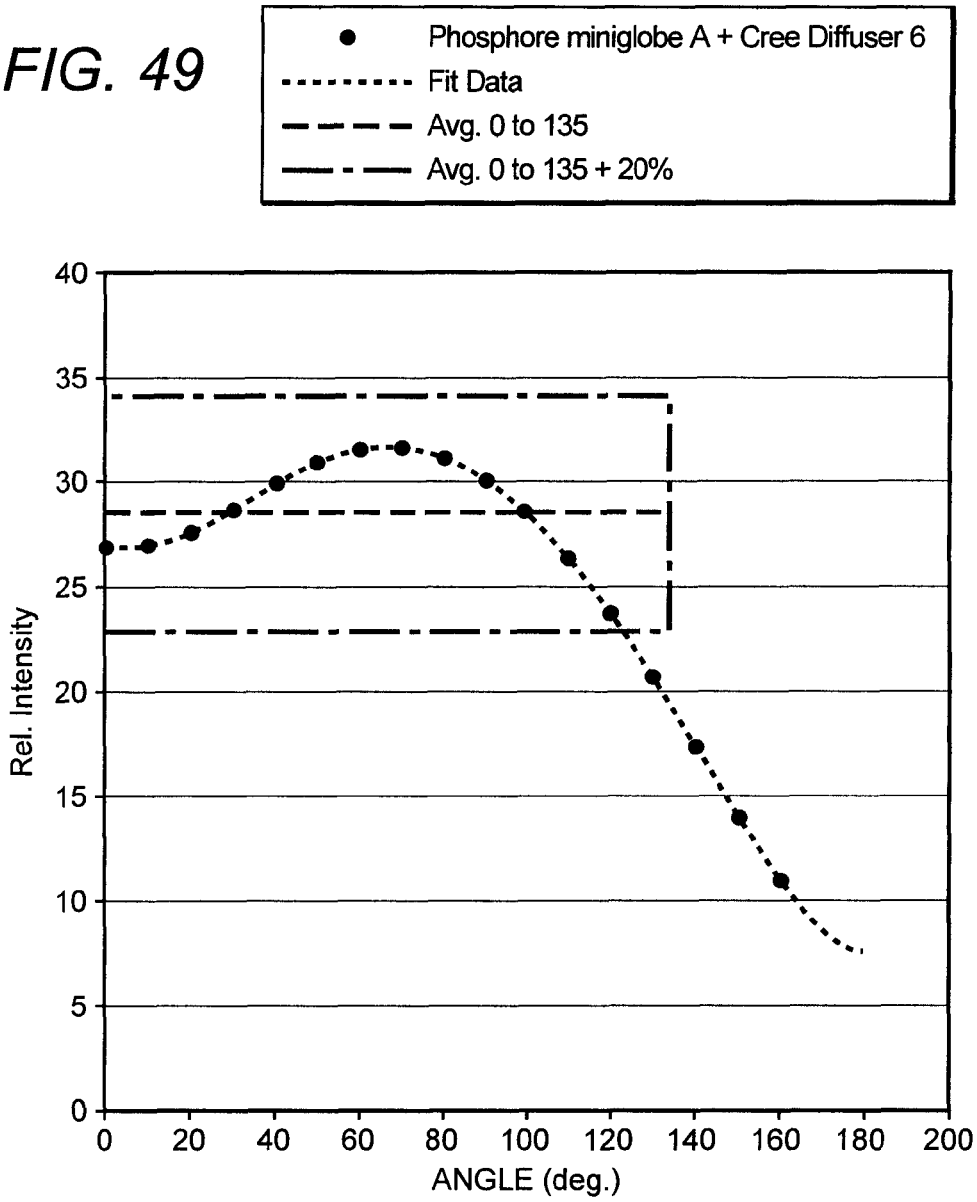
Figure 52:
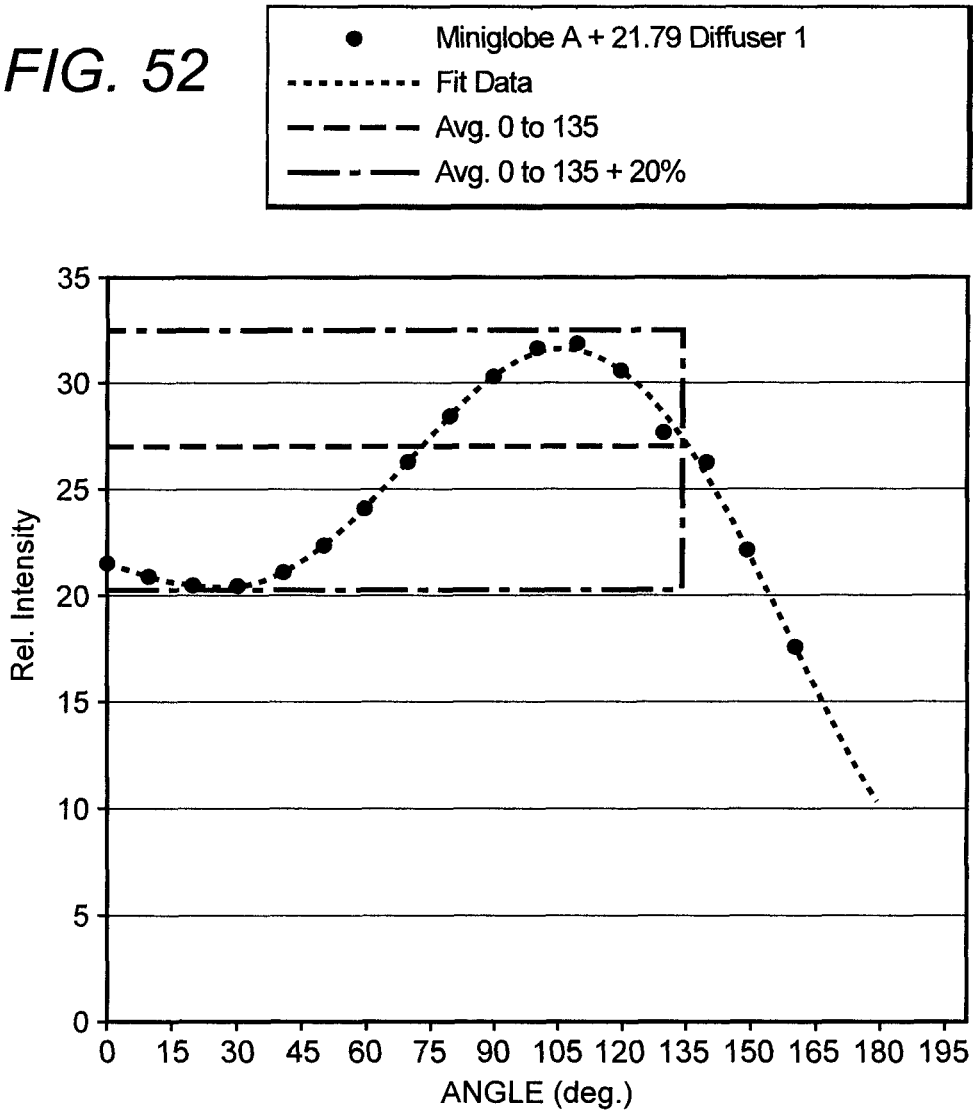
Figure 53:
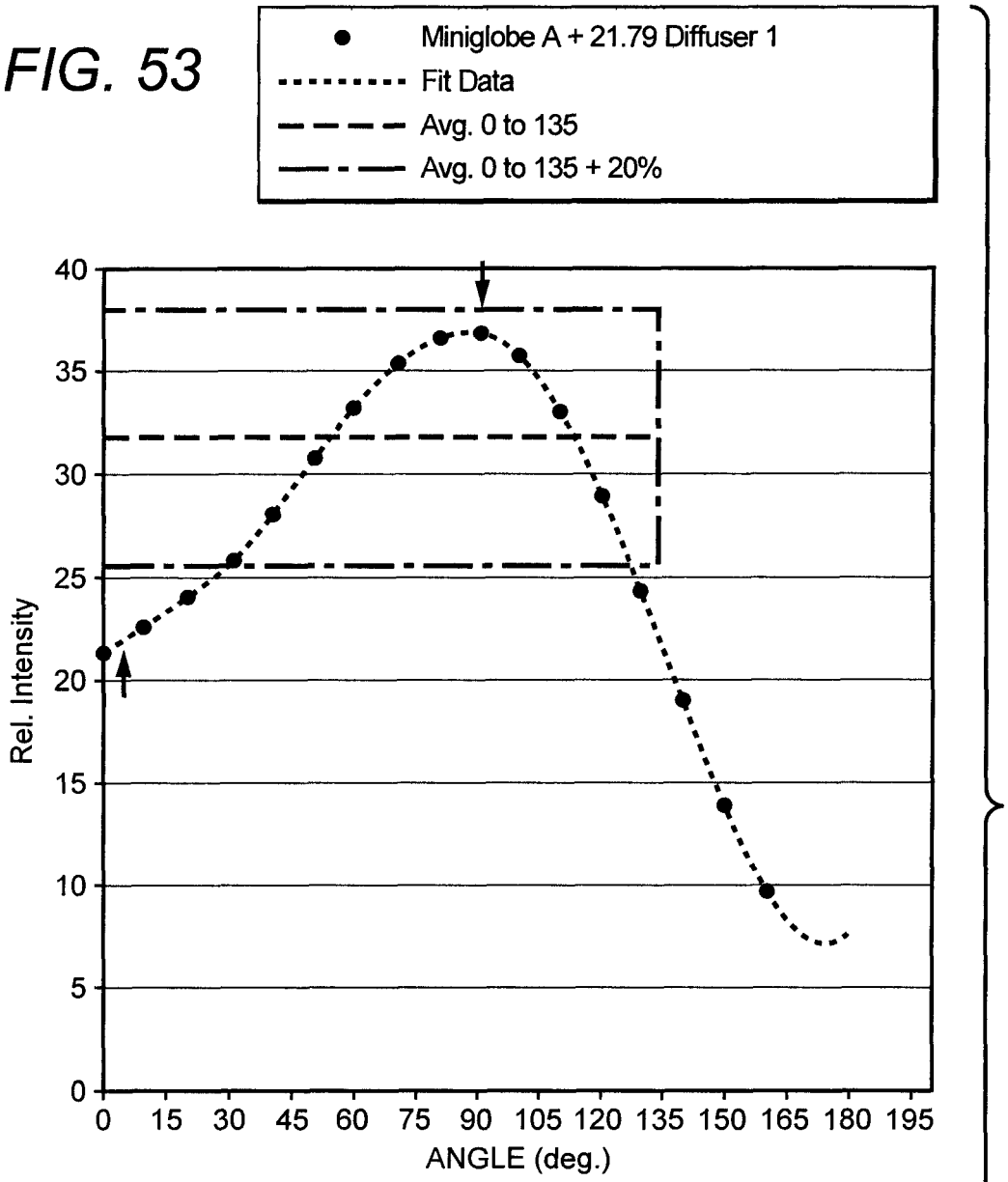
Figure 56:
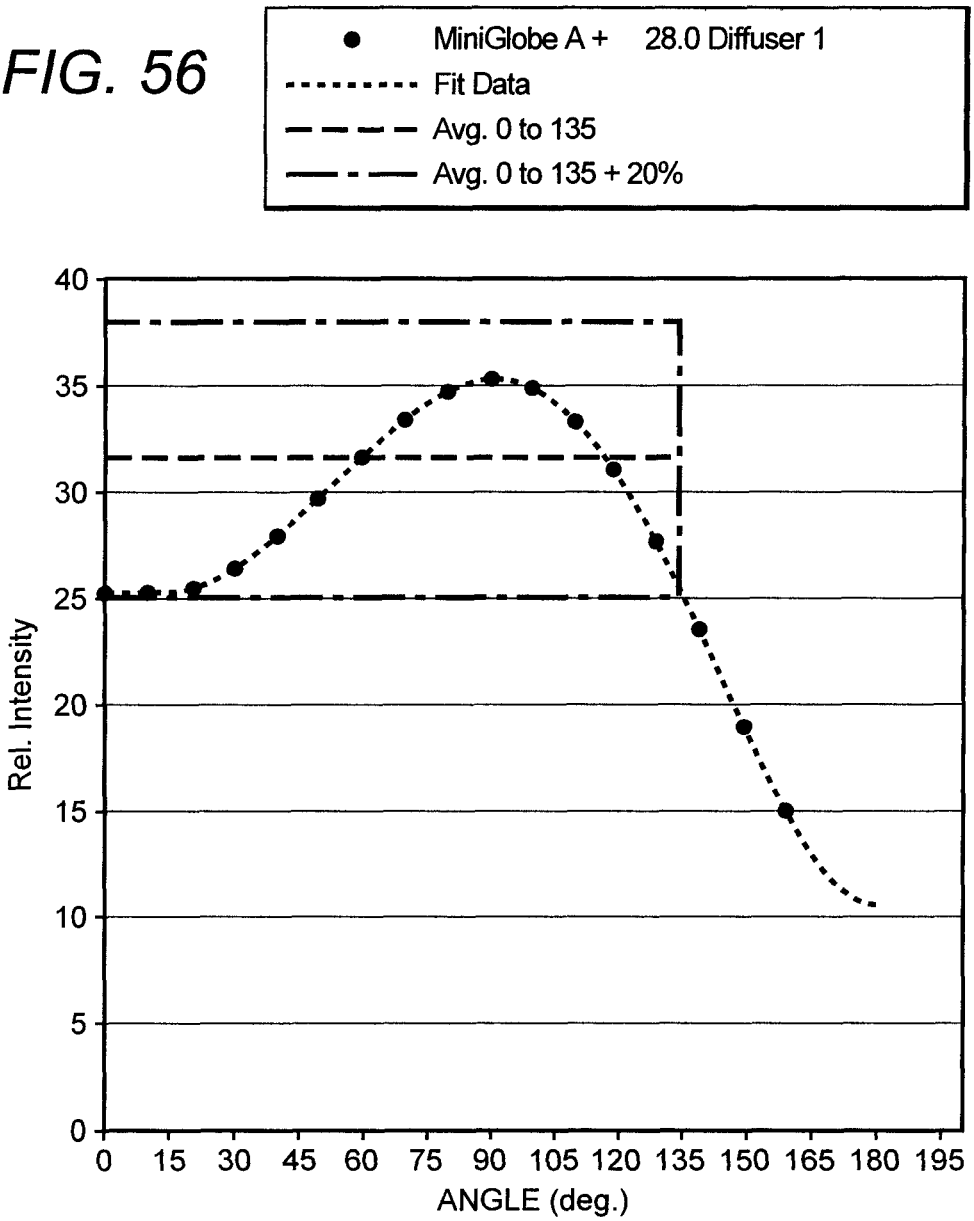
Figure 57:
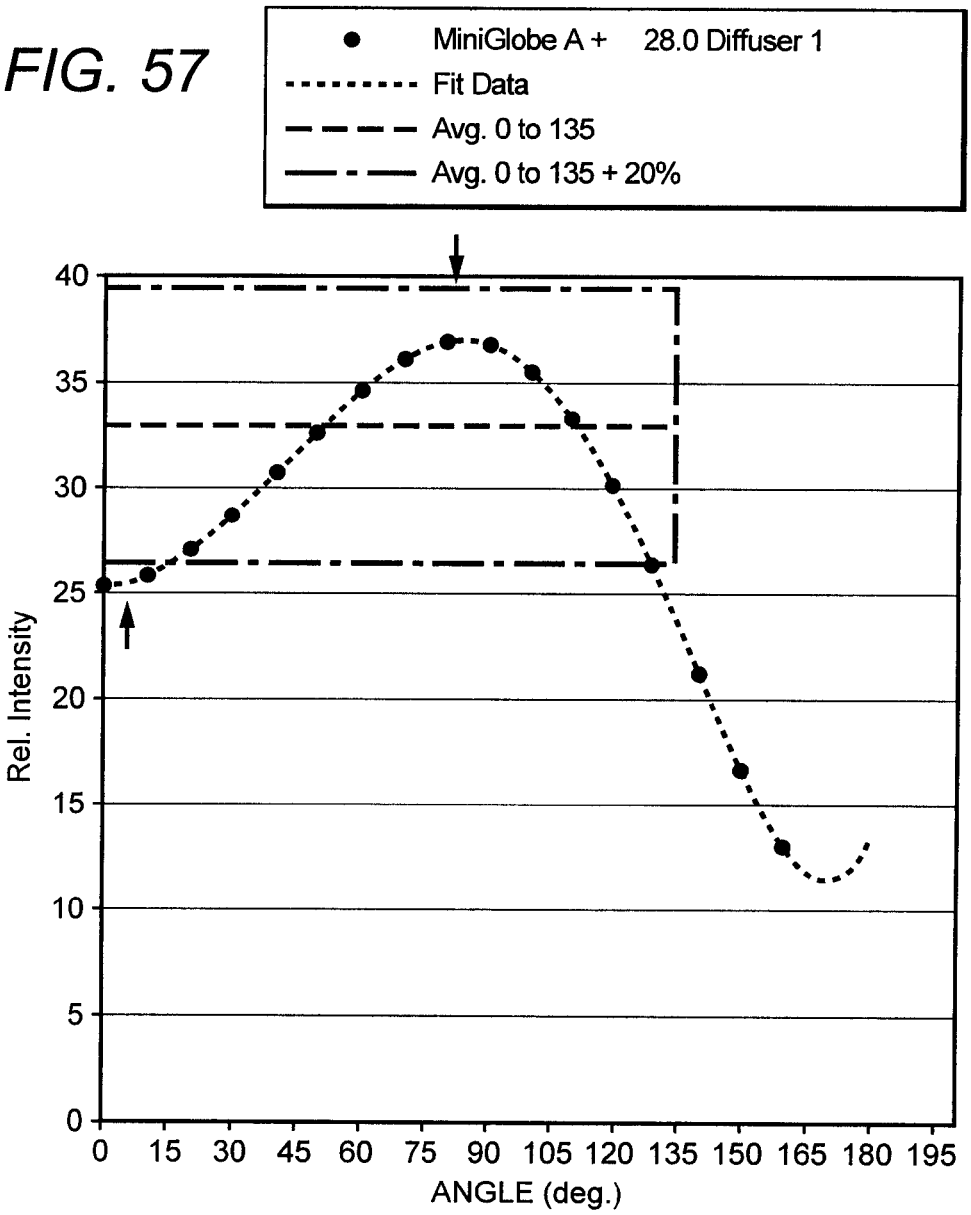
Figure 60:
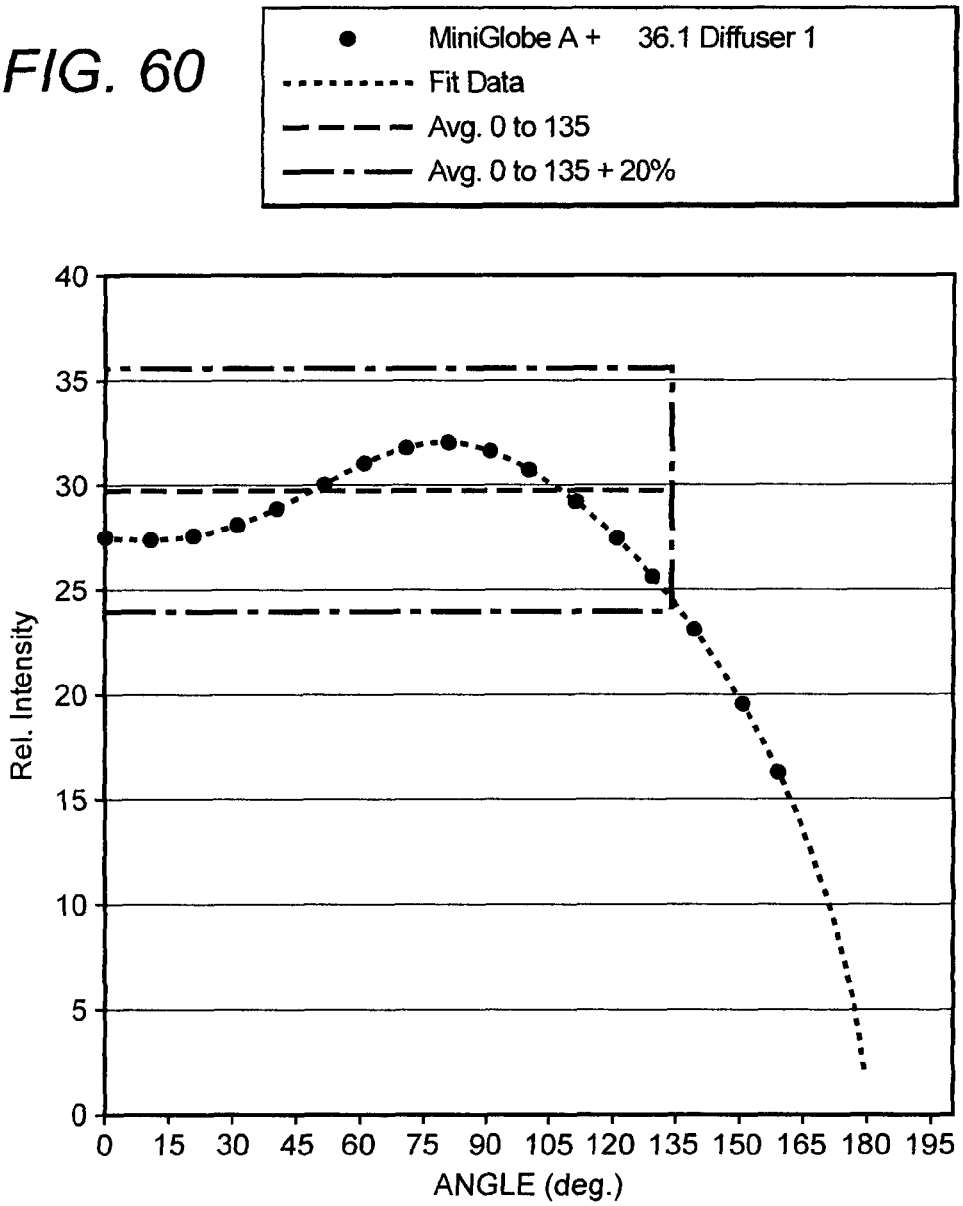
Figure 61:
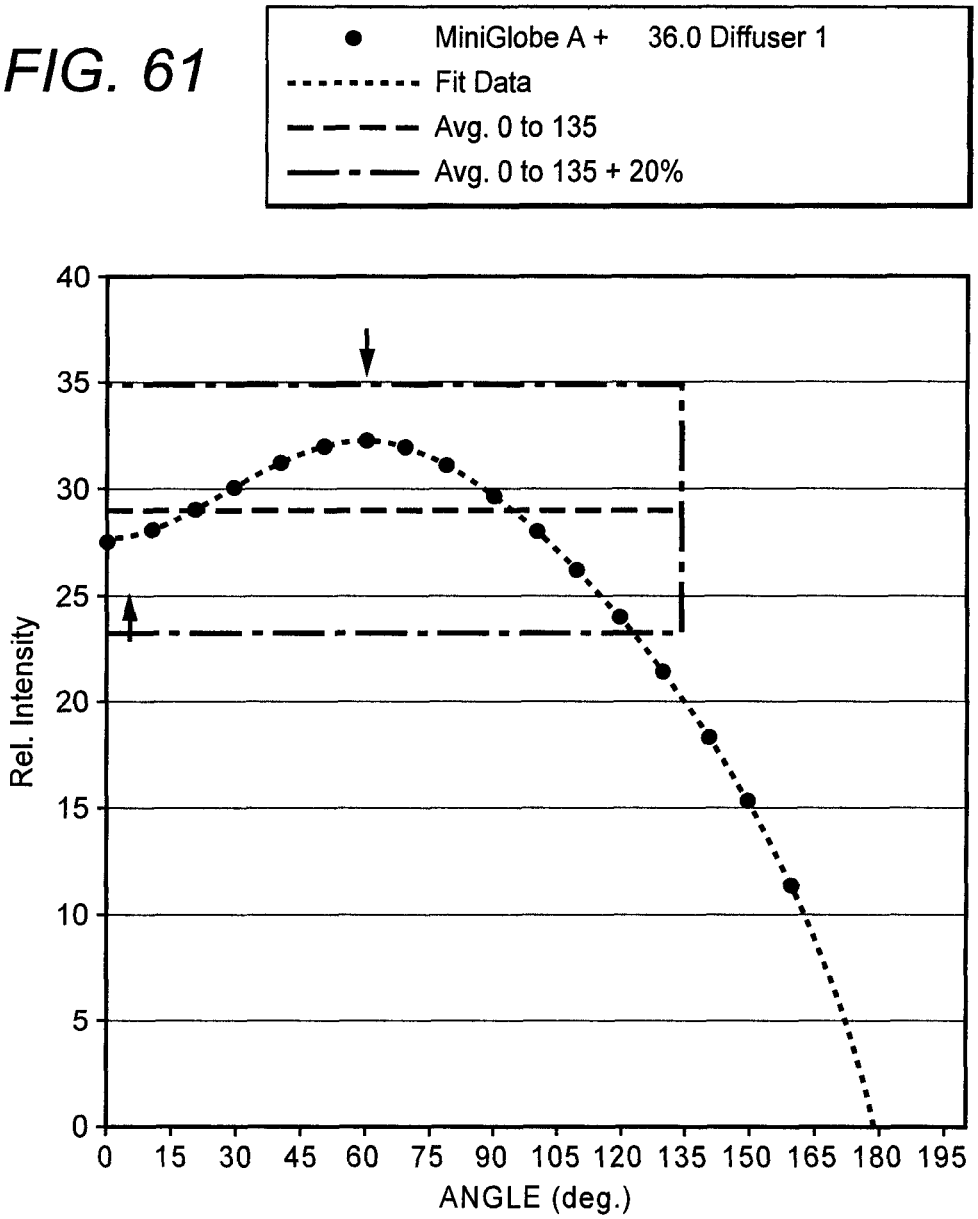

FIGS. 46 through 49 are graphs showing the emission characteristics for a lamp 390 according to the present invention having a dome shaped three-dimensional phosphor carrier with the diffuser 398 arranged over the phosphor so that light from the phosphor carrier passes through the diffuser. FIGS. 46 and 47 show the emission characteristics of the lamp compared to the lamp without a diffuser, and also compared to a standard General Electric 60 W Extra Soft Light Bulb. FIGS. 48 and 49 show variations in emission intensity from viewing angles 0 to 180°.

FIGS. 50 through 53 are similar to the graphs in FIGS. 46 through 49 and show the emission characteristics for a lamp according to the present invention also having a dome shaped three-dimensional phosphor carrier with the diffuser 140 as shown in FIG. 10 arranged over the phosphor carrier. FIGS. 54 through 57 are also similar to those in FIGS. 46 through 49 and show the emission characteristics for another lamp according to the present invention also having a dome shaped three-dimensional phosphor carrier with the diffuser 150 as shown in FIG. 11 arranged over the phosphor carrier. Likewise, FIGS. 58 through 61 are also similar to those in FIGS. 46 through 49 and show the emission characteristics for another lamp according to the present invention also having a dome shaped three-dimensional phosphor carrier with the diffuser 160 as shown in FIG. 12 arranged over the phosphor carrier.

Figure 62:
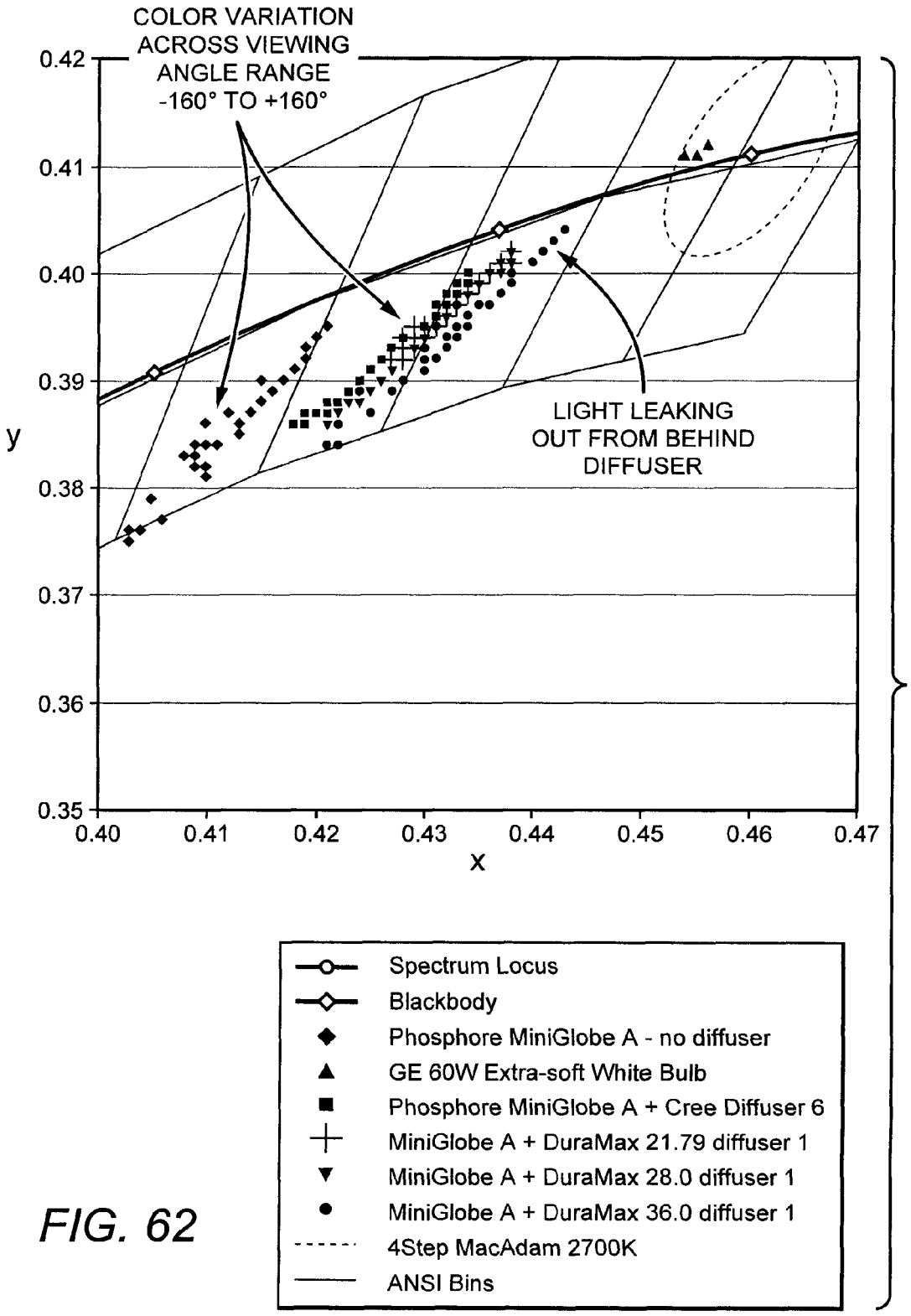
FIG. 62 is a CIE chromaticity diagram showing the color distribution over viewing angle characteristics for lamps according to the present invention.
Figure 63:
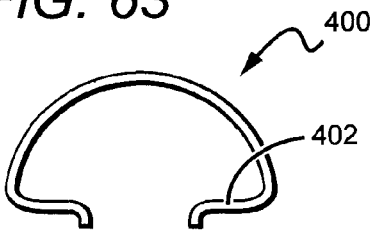
FIG. 63 is a sectional view of still another embodiment of a diffuser according to the present invention.

FIG. 62 is comprises primarily a CIE diagram showing the color variation across viewing angles for the different lamp embodiments described above and shown in FIGS. 42 through 61. FIG. 63 shows another embodiment of a diffuser 400 that can be used in those embodiments experiencing leakage of phosphor carrier light, such as through the edges of the heat sink. The base 402 of the diffuser 400 can diffuse the light passing by these edges.

Figure 64:
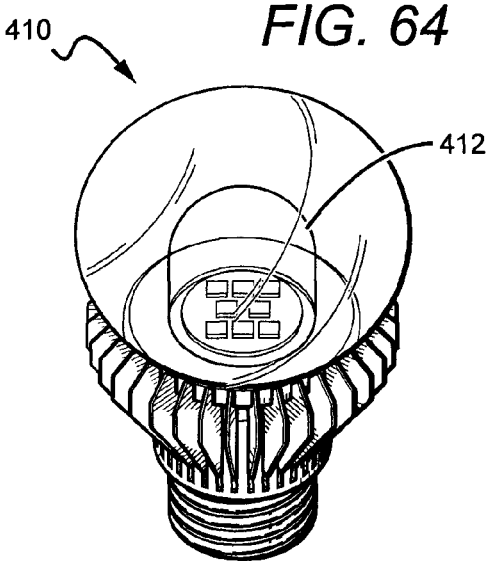
FIG. 64 is a perspective view of another embodiment of a lamp according to the present invention with a three-dimensional phosphor carrier.
Figure 65:
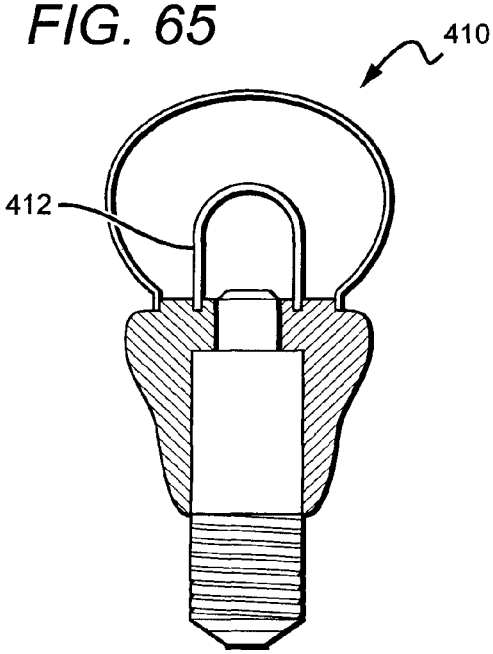
FIG. 65 is a sectional view of the lamp shown in FIG. 64.
Figure 66:
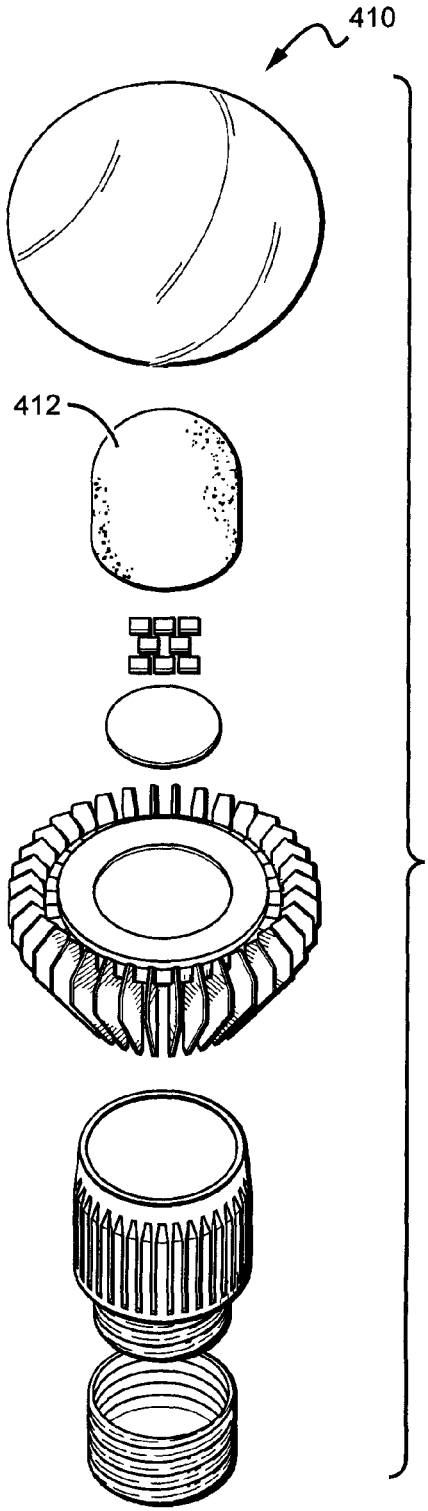
FIG. 66 is an exploded view of the lamp shown in FIG. 64.

FIGS. 64 through 66 show still another embodiment of a lamp 410 according to the present invention. It comprises many of the same features as the lamp 370 shown in FIGS. 39 through 41 above. In this embodiment, however, the phosphor carrier 412 is bullet shaped and functions in much the same way as the other embodiments of phosphor carriers described above. It is understood that these are only a couple of the different shapes that the phosphor carrier can take in different embodiments of the invention.

FIG. 67 shows another embodiment of a lamp 420 according to the present invention that also comprises a heat sink 422 with an optical cavity 424 having a lights source 426 and phosphor carrier 428. The lamp 420 also comprises a diffuser dome 430 and screw threaded portion 432. In this embodiment, however, the optical cavity 424 can comprise a separate collar structure 434, as shown in FIG. 68 that is removable from the heat sink 422. This provides a separate piece that can more easily be coated by a reflective material than the entire heat sink. The collar structure 434 can be threaded to mate with threads in the heat sink structure 422. The collar structure 434 can provide the added advantage of mechanically clamping down the PCB to the heat sink. In other embodiments the collar structure 434 can comprise a mechanical snap-on device instead of threads for easier manufacture.

As mentioned above, the shape and geometry of the three dimensional phosphor carriers can assist in transforming the emission pattern of the emitters to another more desirable emission pattern. In one embodiment, it can assist in changing a Lambertian emission pattern into a more uniform emission pattern at different angles. The disperser can then further transform the light from the phosphor carrier to the final desired emission pattern, while at the same time masking the yellow appearance of the phosphor when the light is off. Other factors can also contribute to the ability of the emitter, phosphor carrier and disperser combination to produce the desired emission pattern. FIG. 69 shows one embodiment of the emitter footprint 440, phosphor carrier footprint 442 and disperser footprint 444 for one lamp embodiment according to the present invention. The phosphor carrier footprint 442 and disperser footprint 444 show the lower edge of both these features around the emitter 440. Beyond the actual shape of these features, the distance D1 and D2 between the edges of these features can also impact the ability of the phosphor carrier and disperser to provide the desired emission pattern. The shape of these features along with the distances between the edges can be optimized based on the emission pattern of the emitters, to obtain the desired lamp emission pattern.

It is understood that in other embodiments different portions of the lamp can be removed such as the entire optical cavity. These features making the collar structure 414 removable could allow for easier coating optical cavity with a reflective layer and could also allow for removal and replacement of the optical cavity in case of failure.

The lamps according to the present invention can have a light source comprising many different numbers of LEDs with some embodiments having less than 30 and in other embodiments having less than 20. Still other embodiments can have less than 10 LEDs, with the cost and complexity of the lamp light source generally being lower with fewer LED chips. The area covered by the multiple chips light source in some embodiments can be less that 30 $mm^2$ and in other embodiments less than 20 $mm^2$. In still other embodiments it can be less that 10 $mm^2$. Some embodiments of lamps according to the present invention also provide a steady state lumen output of greater than 400 lumens and in other embodiments greater than 600 lumens. In still other embodiments the lamps can provide steady state lumen output of greater than 800 lumens. Some lamp embodiments can provide this lumen output with the lamp's heat management features allowing the lamp to remain relatively cool to the touch. In one embodiment that lamp remains less that 60° C. to the touch, and in other embodiments it remains less that 50° C. to the touch. In still other embodiments the lamp remains less than 40° C. to the touch.

Some embodiments of lamps according to the present invention can also operate at an efficiency of greater than lumens per watt, and in other embodiments at an efficiency of greater than 50 lumens per watt. In still other embodiments that lamps can operate at greater than 55 lumens per watt. Some embodiments of lamps according to the present invention can produce light with a color rendering index (CRI) greater than 70, and in other embodiments with a CRI greater than 80. In still other embodiments the lamps can operate at a CRI greater than 90. One embodiment of a lamp according to the present invention can have phosphors that provide lamp emission with a CRI greater than 80 and a lumen equivalent of radiation (LER) greater than 320 lumens/optical Watt @ 3000K correlated color temperature (CCT).

Lamps according to the present invention can also emit light in a distribution that is within 40% of a mean value in the 0 to 135° viewing angles, and in other embodiment the distribution can be within 30% of a mean value at the same viewing angles. Still other embodiments can have a distribution of 20% of a mean value at the same viewing angles in compliance with Energy Star specifications. The embodiments can also emit light that is greater than 5% of total flux in the 135 to 180° viewing angles.

It is understood that lamps or bulbs according to the present invention can be arranged in many different ways beyond the embodiments described above. The embodiments above are discussed with reference to a remote phosphor but it is understood that alternative embodiments can comprise at least some LEDs with conformal phosphor layer. This can be particularly applicable to lamps having light sources emitting different colors of light from different types of emitters. These embodiments can otherwise have some or all of the features described above.

FIGS. 70 through 85 show additional lamp or bulb embodiments arranged according to the present invention. FIG. 70 shows one embodiment of a lamp 450 comprising a planar submount or heat sink 452 having an array of co-planar LEDs 454 on the top surface of the heat sink 452. A three-dimensional or non-planar phosphor carrier 456 is mounted to the heat sink 452 over the LEDs 454 with a space between the LEDs 454 and the phosphor carrier 456. A diffuser 458 is included over the phosphor carrier 456 with a space between the two. The elements of the lamp 450 and the embodiments described below in FIGS. 71 to 85 can have the same properties and can be fabricated in the same way as corresponding elements in the lamps described in the embodiments above. In this embodiment, the phosphor carrier 456 and diffuser 458 are essentially spherical with the diffuser 458 masking the phosphor carrier 456.

FIG. 71 is another embodiment of a lamp 460 according to the present invention having submount or heat sink 462 with co-planar LEDs 464 mounted to the heat sink 462 and a phosphor carrier 466 mounted over and spaced apart from the LEDs 464. A diffuser 468 is mounted over and spaced apart from the phosphor carrier 466, with both again being essentially spherical. In this embodiment the heat sink 462 has greater depth and in one embodiment can have a cube shape. The diffuser 468 is mounted to a side surface of the heat sink 462 and the phosphor carrier 466 is mounted to the top surface of the heat sink 462. FIG. 72 shows another embodiment of a lamp 470 according to the present invention having a similar heat sink 472, co-planar LEDs 474 and diffuser 478 as those shown in the lamp 460 of FIG. 71. A phosphor carrier 476 is also included that is mounted to the side surface of the heat sink 472.

FIG. 73 shows another embodiment of lamp 480 according to the present invention that is similar to the lamp 450 in FIG. 71, and comprises a submount or heat sink 482, with a phosphor carrier 486 and diffuser 488. It also comprise LEDs 484 that in this embodiment are mounted on a pedestal 489 having angled surfaces so that the LEDs 484 are not co-planar and can emit light in different directions. FIG. 74 shows another embodiment of a lamp 490 according to the present invention having a cube shaped submount or heat sink 492, a phosphor carrier 496 and a diffuser 498. LEDs 494 are also included, but in this embodiment they are on side surfaces of the heat sink 492 such that the LEDs 494 are emitting in different directions. It is understood that the LEDs 494 can also be on other surfaces of the heat sink 492, and that the phosphor 496 and diffuser 498 can be spherical shaped or many other shapes such as tube shaped.

FIGS. 75 through 77 show different embodiments of lamps that can be arranged as flood lights. FIG. 75 shows one embodiment of a lamp 500 having co-planar LEDs 502 mounted at a base of a housing 504 having side surfaces 505 that can be opaque to the lamp light and can be reflective. A phosphor carrier 506 is mounted within the housing 504 over and spaced apart from the LEDs 502. A diffuser 508 is mounted to the housing over and spaced apart from the phosphor carrier 506. FIG. 76 shows another embodiment of a lamp 510 according to the present invention that is similar to lamp 500, but in this embodiment the LEDs 512 are mounted on a pedestal 514 so that they are not co-planar. FIG. 77 shows another embodiment of a lamp 520 according to the present invention that is similar to lamp 510, but having a spherical shaped phosphor carrier 522 mounted over the LEDs 524.

Different embodiments can have many different arrangements and shapes, and FIG. 78 shows another embodiment of a lamp 530 comprising a two-dimensional lamp panel. LEDs 532 are mounted within a housing 534 having opaque/reflective side surfaces 535. A phosphor converter 536 and a diffuser 538 are mounted to the housing 534 over and spaced apart from the LEDs 532. FIG. 79 shows another embodiment of lamp 540 comprising a two-dimensional two side emitting panel/box. In this embodiment LED 542 can be mounted on opposite sides of the box emitting towards each other. A phosphor carrier 544 can run the length of the box on the edge of the LEDs 542 and diffuser 546 runs the length of the box outside of a spaced apart from the phosphor carrier 544. FIG. 80 shows still another embodiment of a lamp 550 according to the present invention that is similar to lamp 540 but in this embodiment is a two-dimensional one side emitting panel/box having a backside reflector 552.

FIG. 81 shows another embodiment of a lamp 560 according to the present invention similar to the lamp 540 shown in FIG. 79. In this embodiment however, the phosphor carrier 562 and diffuser 564 are tube shaped and can comprise a waveguide or air at least partially along the length of the phosphor carrier between the LEDs 566. FIG. 82 shows another embodiment of a lamp 570 according to the present invention that is similar to the lamp 560, and has tube shaped phosphor carrier 572 and diffuser 574. In the embodiment the lamp 570 further comprises a graded extraction element waveguide 576 running at least partially along the length of the phosphor carrier 572 between the LEDs 578. FIG. 83 shows another embodiment of lamp 580 according to the present invention that is also similar to the lamp 560 but in this embodiment a portion of the tubular shaped diffuser can comprise a reflector 582.

FIG. 84 shows still another embodiment of lamp 590 according to the present invention comprising a two-dimensional uniform light emission panel. An array of co-planar LEDs 592 is mounted on the edge of a cavity or substrate 594. A phosphor carrier 596 is mounted over and spaced apart from the LEDs 592 and a multiple diffuser layers 598 are mounted over and spaced apart from the phosphor carrier. The bottom surface of the substrate 594 can comprise a reflective surface, with this arrangement a panel light source emitting at least some in a direction perpendicular to the substrate 594.

FIG. 85 shows still another embodiment of a lamp 600 that can be arranged as a flood light similar to the embodiments in FIGS. 75 to 77. The lamp 600 comprises a housing 602 with opaque or reflective side surfaces, with LEDs 604 mounted at the base of the housing 602. A diffuser 606 is also mounted to the housing 602 and is spaced apart from the LEDs 604. A three-dimensional waveguide 608 is included in the housing 602 between the LEDs 604 and the diffuser with the LEDs 604 emitting light into the waveguide 608. At least some of the surfaces of the waveguide 608 are covered by a phosphor or phosphor carrier 610, with LED light passing through the waveguide interacting with the phosphor 608 and being converted.

Figure 87:
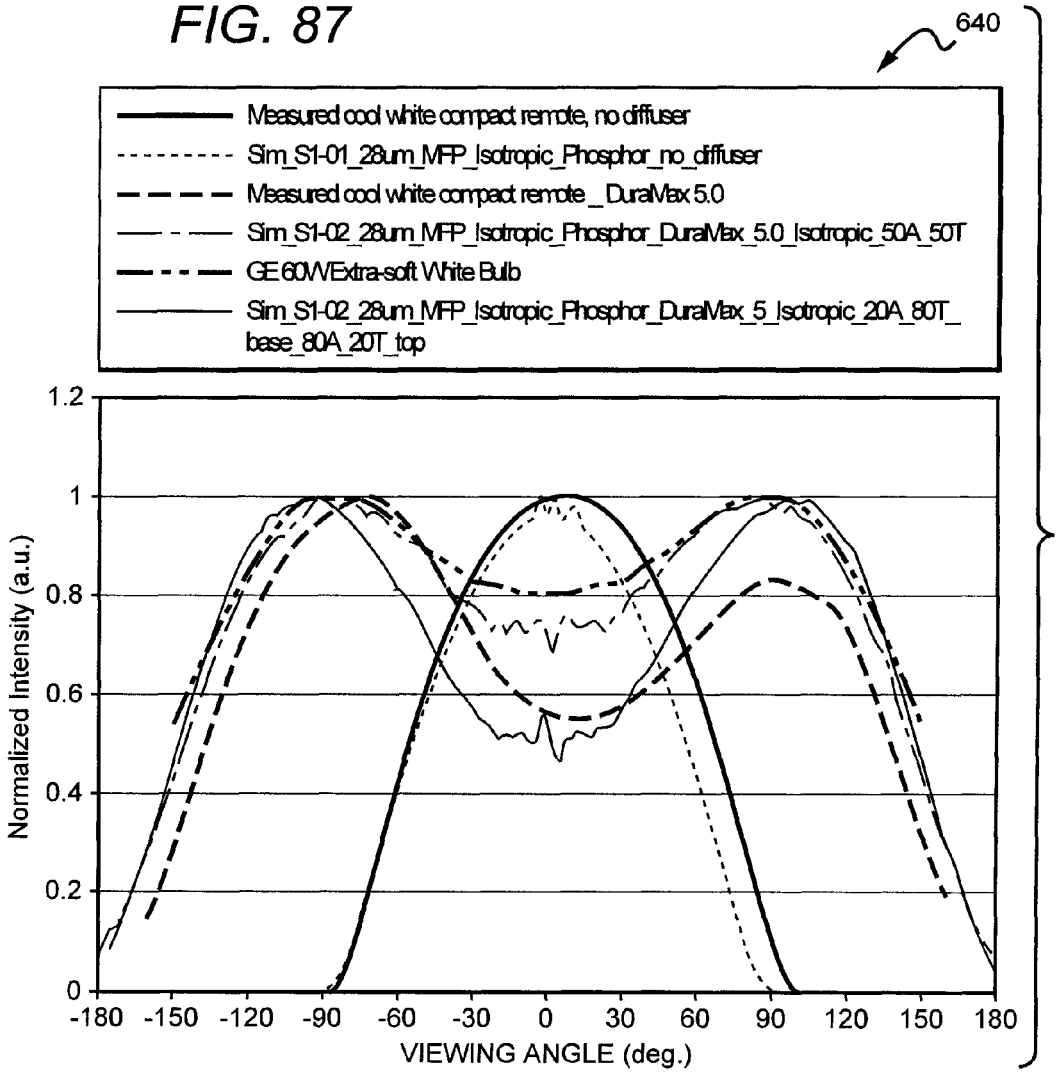
FIG. 87 is graph showing the emission characteristics of the lamp in FIG. 86.

As mentioned above, the diffusers according to the present invention can have different regions that scatter and transmit different amounts of light from the lamp light source to obtain the desired lamp emission pattern. Referring again to the diffuser shape shown in FIGS. 7 and 9, different regions of the diffuser can have regions with different scattering and transmission properties to obtain the an omnidirectional emission. FIG. 86 shows one embodiment of a lamp 620 according to the present invention comprising a diffuser 621 with a lower portion 622 at the base of the diffuser can have scattering (reflecting) and transmission properties different from the upper portion 624. In this embodiment, the lower portion 622 reflects approximately 20% of the light passing through it and transmits approximately 80%. The upper portion 624 reflects 80% of the light passing through it and transmits approximately 20%. FIG. 87 is a graph 640 showing the improved lamp emission characteristics that can be realized by a lamp comprising the diffuser 621, with a co-planar light source and planar or two dimensional phosphor carrier. The transmission of the necked geometry can increase the amount of light directed sideways (~90°) relative to light emitted axially (~0°).

Figure 89:
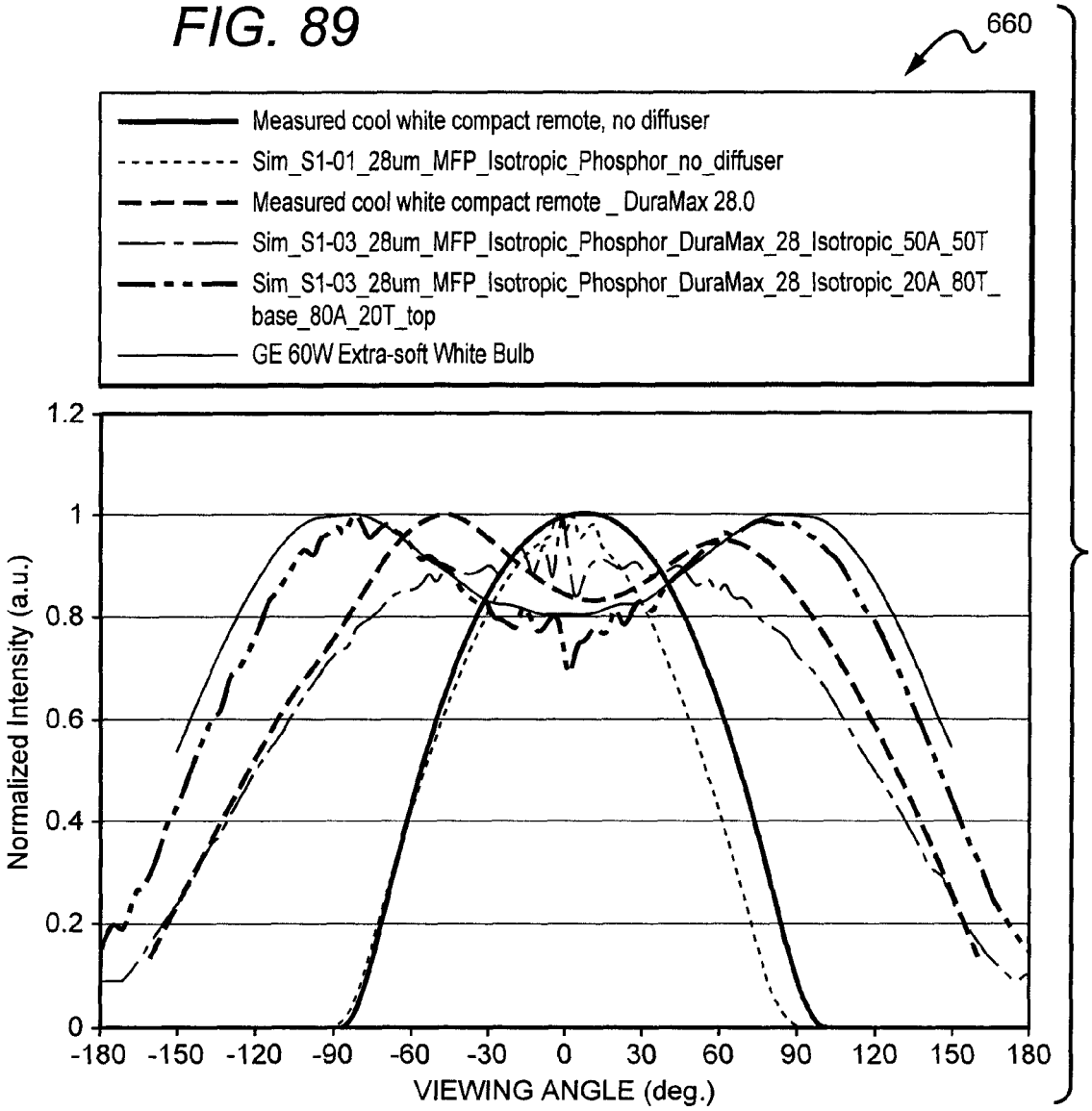
FIG. 89 is graph showing the emission characteristics of the lamp in FIG. 86.

FIG. 88 shows another embodiment of a lamp 650 according to the present invention that having diffuser 652 with a shape similar to diffuser 90 shown in FIG. 6. The lower portion 654 at the base of the diffuser can have having scattering (reflecting) and transmission properties different from the upper portion 656. In this embodiment, the lower portion 654 reflects approximately 20% of the light passing through it and transmits approximately 80%. The upper portion 656 reflects 80% of the light passing through it and transmits approximately 20%. FIG. 89 is a graph 660 showing the improved emission characteristics that can be realized by a lamp comprising the diffuser 652, with a co-planar light source and planar or two dimensional phosphor carrier. By increasing the amount of light transmitted through the lower portion of the diffuser 652, it is possible to achieve nearly an incandescent-like intensity distribution when combining a planar (Lambertian) light with a nearly spherical diffuser. This distribution may also be created by modifying the thickness, scattering particle density, particle size or nature, etc., such that, for example, the thickness of the scattering layer deposited on the lower portion 654 is less than that deposited on the upper portion 656.

Although the present invention has been described in detail with reference to certain preferred configurations thereof, other versions are possible. Therefore, the spirit and scope of the invention should not be limited to the versions described above.

We claim:

1. A solid state lamp, comprising:

a light emitting diode (LED) based light source;

a remote wavelength conversion material carrier spaced from said LED light source;

a diffuser distinct from said remote wavelength conversion material carrier wherein said diffuser comprises a geometry and light scattering properties configured to disperse the light from said LED light source and wavelength conversion material carrier in a substantially omnidirectional emission pattern, wherein said diffuser geometry comprises a neck at its base, wherein at least a portion of said remote wavelength conversion material carrier is at the base of said diffuser;

wherein said conversion material carrier comprises a carrier layer and a phosphor layer.

2. The solid state lamp of claim 1, wherein said diffuser further comprising a bulb portion.

3. The solid state lamp of claim 1, wherein said light scattering properties comprise non-uniform light scattering properties.

4. The solid state lamp of claim 1, wherein said LED light source comprises a plurality of co-planar LEDs and said remote wavelength conversion material carrier comprises a substantially planar shape.

5. The solid state lamp of claim 1, wherein said LED light source comprises a plurality of co-planar LEDs and said remote wavelength conversion material carrier comprises a substantially planar shape, wherein said diffuser has a lower portion which transmits more light than the corresponding upper portion.

6. The solid state lamp of claim 1, wherein said LED light source comprises a plurality of co-planar LEDs and said remote wavelength conversion material carrier comprises a substantially planar shape, wherein said diffuser comprises a substantially globe shape having a lower portion which transmits more light than the corresponding upper portion.

7. The solid state lamp of claim 1, wherein the emission from said LED based light source and said remote wavelength conversion material carrier is forward directed.

8. The solid state lamp of claim 1, wherein the emission from said LED based light source and said remote wavelength conversion material carrier is forward directed, wherein said diffuser has a lower portion which transmits more light than the corresponding upper portion.

9. The solid state lamp of claim 1, wherein the emission from said LED based light source and said remote wavelength conversion material carrier is forward directed, wherein said diffuser comprises a substantially globe shape having a lower portion which transmits more light than the corresponding upper portion.

10. The solid state lamp of claim 1, wherein said remote wavelength conversion material carrier absorbs light from said light source and re-emits light in a dispersed pattern, wherein said diffuser comprises a globe shape.

11. A solid state lamp, comprising:

a forward emitting light emitting diode (LED) based light source;

a substantially flat remote phosphor carrier spaced from said LED light source;

a diffuser distinct from said remote phosphor carrier, said diffuser comprising a scattering material and comprising a geometry configured to disperse light from said LED light source and said phosphor carrier in a substantially uniform lamp emission pattern of light, wherein said diffuser geometry comprises a neck at its base, wherein at least a portion of said phosphor carrier is at the base of said diffuser.

12. The solid state lamp of claim 11, that is narrow at its base.

13. The solid state lamp of claim 11, wherein said diffuser has regions of non-uniform transparencies.

14. The solid state lamp of claim 11, wherein said diffuser has a lower portion which transmits more light than the corresponding upper portion.

15. The solid state lamp of claim 11, wherein said diffuser comprises a substantially globe shape having a lower portion which transmits more light than the corresponding upper portion.

16. The solid state lamp of claim 11, wherein the emission from said LED based light source and said remote phosphor carrier is forward directed, wherein said diffuser has a lower portion which transmits more light than the corresponding upper portion.

17. The solid state lamp of claim 11, wherein said remote phosphor carrier absorbs light from said light source and re-emits light in a dispersed pattern, wherein said diffuser comprises a globe shape.

18. The solid state lamp of claim 11, wherein said diffuser comprises a bulb with a scattering material.

19. The solid state lamp of claim 18, wherein said diffuser comprises a scattering film, layer or region.

20. The solid state lamp of claim 18, wherein said diffuser comprises a layer of scattering particles.

21. The solid state lamp of claim 20, wherein said layer of scattering particles comprises non-uniform scatter properties.

22. The solid state lamp of claim 20, wherein said layer of scattering particles has one or more regions that are more transparent.

23. The solid state lamp of claim 20, wherein said layer of scattering particles comprise one or more regions that are smooth.

24. The solid state lamp of claim 20, wherein said layer of scattering particles comprise one or more regions that are roughened.

25. The solid state lamp of claim 20, wherein said layer of scattering particles comprises an isotropic scattering properties.

26. The solid state lamp of claim 11, wherein said diffuser comprises a bulb with a layer of scattering particles.

27. The solid state lamp of claim 26, wherein said layer of scattering particles is on the inside surface or outside surface of said bulb, or both.

28. The solid state lamp of claim 26, wherein said layer of scattering particles is within said bulb.

29. The solid state lamp of claim 26, wherein said bulb comprises glass or plastic.

30. A solid state lamp, comprising:

a light emitting diode (LED) based light source;

a three dimensional remote phosphor carrier comprising a neck and spaced from said LED light source;

a three dimensional diffuser distinct from said remote phosphor carrier and having a shape and varying scattering properties configured such that light emitted from the diffuser has reduced variation in spatial emission intensity profile over an angular range compared to the light emitted from the remote phosphor carrier, wherein said diffuser comprises a neck, wherein at least a portion of said remote phosphor carrier is at the base of said diffuser.

31. The solid state lamp of claim 30, wherein said diffuser has a lower portion which transmits more light than the corresponding upper portion.

32. The solid state lamp of claim 30, wherein said diffuser comprises a substantially globe shape.

33. The solid state lamp of claim 30, wherein said diffuser comprises a lower portion which transmits more light than the corresponding upper portion.

34. The solid state lamp of claim 30, wherein said diffuser comprises a bulb with a scattering material.

35. The solid state lamp of claim 30, wherein said diffuser comprises a scattering film, layer or region.

36. The solid state lamp of claim 30, wherein said diffuser comprises a layer of scattering particles.

37. The solid state lamp of claim 36, wherein said layer of scattering particles comprises non-uniform scatter properties.

38. The solid state lamp of claim 36, wherein said layer of scattering particles has one or more regions of reduced scattering properties.

39. The solid state lamp of claim 36, wherein said layer of scattering particles has a region of reduced scattering properties at the base of said diffuser.

40. The solid state lamp of claim 39, wherein the exposed surface of the said layer of scattering particles is smooth.

41. The solid state lamp of claim 39, wherein the exposed surface of the said layer of scattering particles is roughened.

42. The solid state lamp of claim 30, wherein said diffuser comprises a bulb with a layer of scattering particles.

43. The solid state lamp of claim 42, wherein said layer of scattering particles is on the inside surface or outside surface of said bulb, or both.

44. The solid state lamp of claim 42, wherein said layer of scattering particles is within said bulb.

45. The solid state lamp of claim 42, further comprising a heat sink, said bulb extending beyond the edge of said heat sink.

46. The solid state lamp of claim 1, wherein said remote wavelength conversion material comprises substantially planar top and bottom surfaces.

47. The solid state lamp of claim 1, wherein said remote wavelength conversion material carrier is disk-shaped.

48. The solid state lamp of claim 1, wherein said LED based light source is in a cavity below said remote wavelength conversion material carrier and said diffuser.

49. The solid state lamp of claim 11, wherein said remote phosphor carrier comprises a carrier layer and a phosphor layer.

50. The solid state lamp of claim 11, wherein said remote phosphor carrier comprises a phosphor-binder mixture.

51. The solid state lamp of claim 11, wherein said remote phosphor carrier is disk-shaped.

52. The solid state lamp of claim 30, wherein said three dimensional remote phosphor carrier comprises a carrier layer and a phosphor layer.

53. The solid state lamp of claim 30, wherein said three dimensional remote phosphor carrier comprises a phosphor-binder mixture.

54. The solid state lamp of claim 1, wherein said remote wavelength conversion material comprises a three-dimensional shape, wherein said diffuser comprises a substantially globe shape.

55. The solid state lamp of claim 1, wherein said remote wavelength conversion material comprises a three-dimensional shape, wherein said diffuser comprises a lower portion which transmits more light than the corresponding upper portion.

56. The solid state lamp of claim 1, wherein said remote wavelength conversion material comprises a three-dimensional shape, wherein said diffuser comprises a substantially globe shape having a lower portion which transmits more light than the corresponding upper portion.

57. The solid state lamp of claim 1, wherein said diffuser comprises a three dimensional shape having surface regions which transmit more light relative to other surface regions.

58. The solid state lamp of claim 11, wherein said remote phosphor comprises a three-dimensional shape, wherein said diffuser comprises a lower portion which transmits more light than the corresponding upper portion.

* * * * *